US011297948B2

(12) United States Patent
Jacobs et al.

(10) Patent No.: US 11,297,948 B2
(45) Date of Patent: Apr. 12, 2022

(54) CHAIR ASSEMBLIES, TABLE ASSEMBLIES, MODULAR COMPONENTS FOR USE WITHIN CHAIR ASSEMBIES AND TABLE ASSEMBLIES, AND PARTS FOR USE WITHIN THE MODULAR COMPONENTS

(71) Applicants: Matthew Jacobs, Holland, MI (US); Frederick Jacobs, Holland, MI (US); Terry Plumert, Grand Haven, MI (US); Steven Hayden, Muskegon, MI (US)

(72) Inventors: Matthew Jacobs, Holland, MI (US); Frederick Jacobs, Holland, MI (US); Terry Plumert, Grand Haven, MI (US); Steven Hayden, Muskegon, MI (US)

( * ) Notice: Subject to any disclaimer, the term of this patent is extended or adjusted under 35 U.S.C. 154(b) by 0 days.

(21) Appl. No.: 16/940,324

(22) Filed: Jul. 27, 2020

(65) Prior Publication Data

US 2020/0352336 A1 Nov. 12, 2020

Related U.S. Application Data

(63) Continuation of application No. 16/181,585, filed on Nov. 6, 2018, now Pat. No. 10,722,032.

(Continued)

(51) Int. Cl.

| | |
|---|---|
| ***A47C 1/02*** | (2006.01) |
| ***A47C 1/121*** | (2006.01) |
| ***A47C 1/024*** | (2006.01) |
| ***A47C 1/023*** | (2006.01) |
| ***A47C 7/62*** | (2006.01) |
| ***A47C 7/72*** | (2006.01) |
| ***A63J 25/00*** | (2009.01) |

(Continued)

(52) U.S. Cl.

CPC ..... *A47C 1/121* (2013.01); *A47C 1/023* (2013.01); *A47C 1/024* (2013.01); *A47C 7/622* (2018.08); *A47C 7/725* (2013.01); *A63J 25/00* (2013.01); *A47B 83/02* (2013.01); *A47C 1/124* (2013.01); *A47C 1/13* (2013.01); *A47C 7/008* (2013.01); *A47C 7/30* (2013.01); *A47C 7/70* (2013.01)

(58) Field of Classification Search

CPC ..... A47C 1/121; A47C 1/023; A47C 1/024; A47C 1/124; A47C 1/13; A47C 7/622; A47C 7/725; A47C 7/008; A47C 7/30; A47C 7/70; A63J 25/00

USPC ..... 297/188.01

See application file for complete search history.

(56) References Cited

U.S. PATENT DOCUMENTS

2006/0192415 A1* 8/2006 Steenson ..... A47C 7/68 297/161

2008/0236452 A1* 10/2008 Pratt ..... A47C 7/72 108/13

(Continued)

*Primary Examiner* — Mark R Wendell

(74) *Attorney, Agent, or Firm* — James E. Shultz, Jr.

(57) ABSTRACT

Chair assemblies (e.g., powered recliner chairs, rocker style chairs, fixed position chairs, chairs with pivoting seats, recliner chairs, a sub-combination thereof, or a combination thereof), tables and trays are provided. More particularly, chair assemblies (e.g., powered recliner chairs, rocker style chairs, fixed position chairs, chairs with pivoting seats, recliner chairs, a sub-combination thereof, or a combination thereof), tables and trays, modular components for use within the chair, table, and tray assemblies, and parts for use within the modular components are provided.

19 Claims, 69 Drawing Sheets

Related U.S. Application Data

(60) Provisional application No. 62/911,052, filed on Oct. 4, 2019, provisional application No. 63/012,653, filed on Apr. 20, 2020, provisional application No. 63/035,924, filed on Jun. 8, 2020.

(51) Int. Cl.

| | |
|---|---|
| *A47C 7/00* | (2006.01) |
| *A47C 1/124* | (2006.01) |
| *A47C 1/13* | (2006.01) |
| *A47C 7/70* | (2006.01) |
| *A47C 7/30* | (2006.01) |
| *A47B 83/02* | (2006.01) |

(56) References Cited

U.S. PATENT DOCUMENTS

| | | | | |
|---|---|---|---|---|
| 2009/0288123 | A1* | 11/2009 | Havlovick | B64D 11/0624 725/77 |
| 2014/0110977 | A1* | 4/2014 | Madrigal | A47C 7/622 297/173 |
| 2014/0340828 | A1* | 11/2014 | Truong | H05K 7/16 361/679.22 |
| 2017/0101187 | A1* | 4/2017 | Noske | B60N 3/004 |
| 2017/0105531 | A1* | 4/2017 | Jacobs | A47C 1/126 |
| 2017/0105540 | A1* | 4/2017 | Jacobs | A47C 1/03211 |
| 2017/0355465 | A1* | 12/2017 | Trimble | B60N 3/004 |
| 2018/0281966 | A1* | 10/2018 | Chuang | A47B 46/00 |
| 2018/0354398 | A1* | 12/2018 | Lamb | F16M 11/38 |
| 2019/0357689 | A1* | 11/2019 | Plouffe | A47C 7/705 |
| 2020/0076351 | A1* | 3/2020 | Belverio | H02S 10/40 |

* cited by examiner

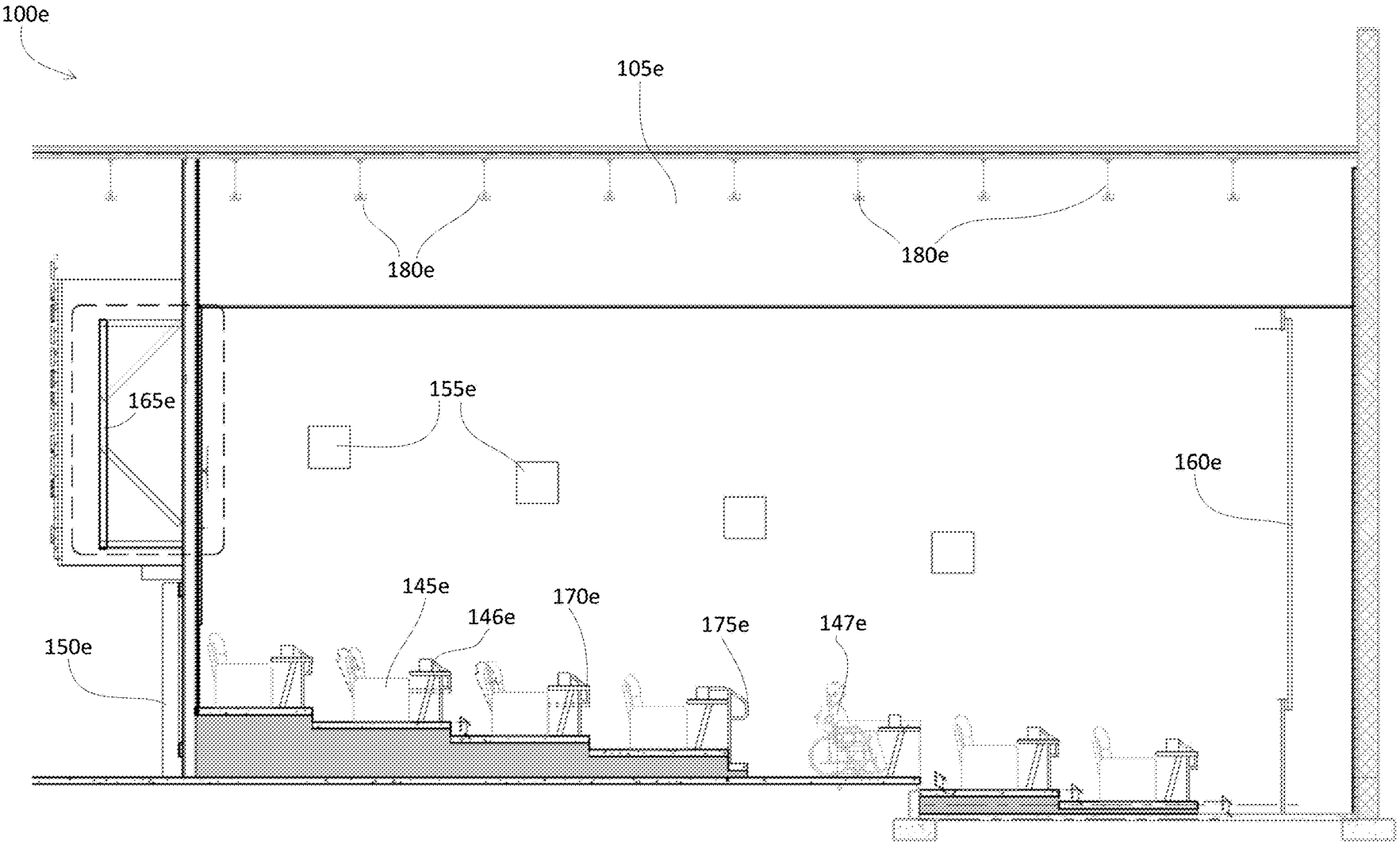
Fie. 1E 400c
435c
VPP
VDD
GND
+24V
SeatSW
P3
Q_NMOS_SGD
Q_PMOS_GSD
Q6
Q7
Q9
Q10
Aisle Num
Lights
P4
455c
AuxCam
P9
460c
465c
470c
CommIN
CommOut
P1
P15
tx
rx
TP1
Hole
WIM
P14
475c
TP2
uslights
ESP
P2
ESPRX
GPIO0
GPIO2
RST
480c
ESPreset
TP3
ESPTX
ESPtx
C4
C6
C11
10uf
.1uf
10uf

CHAIR ASSEMBLIES, TABLE ASSEMBLIES, MODULAR COMPONENTS FOR USE WITHIN CHAIR ASSEMBIES AND TABLE ASSEMBLIES, AND PARTS FOR USE WITHIN THE MODULAR COMPONENTS

CROSS REFERENCE TO RELATED APPLICATIONS

The present application is a continuation-in-part of U.S. Pat. No. 10,722,032, filed Nov. 6, 2018, entitled CHAIR ASSEMBLIES, MODULAR COMPONENTS FOR USE WITHIN CHAIR ASSEMBIES, AND PARTS FOR USE WITHIN THE MODULAR COMPONENTS, the entire disclosure of which is incorporated herein by reference thereto.

This application claims benefit, under 35 USC 119(e), of U.S. Provisional Patent Application Ser. No. 62/911,052, filed Oct. 14, 2019, entitled CHAIR ASSEMBLIES, TABLE ASSEMBLIES, MODULAR COMPONENTS FOR USE WITHIN CHAIR ASSEMBIES AND TABLE ASSEMBLIES, AND PARTS FOR USE WITHIN THE MODULAR COMPONENTS; 63/012,653, filed Apr. 4, 2020, entitled CHAIR ASSEMBLIES, TABLE ASSEMBLIES, MODULAR COMPONENTS FOR USE WITHIN CHAIR ASSEMBIES AND TABLE ASSEMBLIES, AND PARTS FOR USE WITHIN THE MODULAR COMPONENTS; 63/012,653, filed Apr. 20, 2020, entitled CHAIR ASSEMBLIES, TABLE ASSEMBLIES, MODULAR COMPONENTS FOR USE WITHIN CHAIR ASSEMBIES AND TABLE ASSEMBLIES, AND PARTS FOR USE WITHIN THE MODULAR COMPONENTS; and 63/035,924, filed Jun. 8, 2020, entitled CHAIR ASSEMBLIES, TABLE ASSEMBLIES, MODULAR COMPONENTS FOR USE WITHIN CHAIR ASSEMBIES AND TABLE ASSEMBLIES, AND PARTS FOR USE WITHIN THE MODULAR COMPONENTS, the entire disclosures of which are incorporated herein by reference thereto.

TECHNICAL FIELD

The present disclosure generally relates to chair assemblies (e.g., powered recliner chairs, rocker style chairs, fixed position chairs, chairs with pivoting seats, recliner chairs, support surfaces, tables, trays, a sub-combination thereof, or a combination thereof) and table assemblies. More particularly, the present disclosure relates to chair assemblies (e.g., powered recliner chairs, rocker style chairs, fixed position chairs, chairs with pivoting seats, recliner chairs, support surfaces, tables, trays, a sub-combination thereof, or a combination thereof) and table assemblies, modular components for use within the chair assemblies, support surface assemblies, table assemblies, tray assemblies, parts for use within the modular components and related manufacturing and installation methods.

BACKGROUND

Chair assemblies (e.g., powered recliner chairs, rocker style chairs, fixed position chairs, chairs with pivoting seats, recliner chairs, tables and trays, a sub-combination thereof, or a combination thereof) and/or table assemblies are often installed in dine-in theaters, gymnasiums, auditoriums, stadiums, theaters, arenas, conference centers, cinemas, home theaters, places of worship (e.g., a church), education facilities, classrooms, performance halls and the like.

Powered recliner chair assemblies and chair assemblies with pivoting seats may reduce space requirements when compared to chair assemblies that do not include pivoting seats. For example, when a chair assembly with a pivoting seat is unoccupied, the seat may automatically pivot upward such that the seat does not extend as far into a related row compared to when the seat is occupied. Similarly, when a powered recliner chair assembly is unoccupied, the chair assembly may automatically reorient to an upright (retracted) orientation. Thereby, more powered recliner chair assemblies and/or chair assemblies with pivoting seats may be installed within a given venue space compared to chair assemblies without pivoting seats. Space usage/constraints may also apply to installations that include tables/trays (i.e., the tables and/or trays may be configured to automatically reorient from an in-use orientation to a stowed orientation).

Chair assemblies (e.g., powered recliner chairs, rocker style chairs, beam-mounted chair assemblies, fixed position chairs, chairs with pivoting seats, tables and trays, a sub-combination thereof, or a combination thereof) typically include a plethora of individual parts. Many of the corresponding components, assembled from the individual parts, are complex. Manufacturing of the parts and assembly of the components is time consuming and expensive. Installation of a plurality of chair assemblies (e.g., powered recliner chairs, rocker style chairs, fixed position chairs, chairs with pivoting seats, tables and trays, a sub-combination thereof, or a combination thereof), starting with the individual parts on site, requires a protracted amount of time and resources and involves a wide variety of likelihood for error and lost parts.

Related venues are incorporating dine-in options, in-house brewery facilities, venue cleaning systems, venue emergency systems, venue ticketing systems, patron interaction systems, etc. Electrical systems are needed that accommodate related venue operations.

Chair assemblies (e.g., powered recliner chairs, rocker style chairs, fixed position chairs, chairs with pivoting seats, tables and trays, a sub-combination thereof, or a combination thereof) are needed that minimize part manufacturing time, maximize material usage and reduce component assembly time and chair installation time. Chair assemblies (e.g., powered recliner chairs, rocker style chairs, fixed position chairs, chairs with pivoting seats, tables and trays, a sub-combination thereof, or a combination thereof) are also needed that minimize associated row widths while satisfying venue ingress/egress building code requirements. Furthermore, chair assemblies (e.g., powered recliner chairs, rocker style chairs, fixed position chairs, chairs with pivoting seats, tables and trays, a sub-combination thereof, or a combination thereof) are needed that minimize the need for skilled labor during installation.

SUMMARY

A table assembly for use with a chair may include a mounting structure and a table slide mechanism attached to the mounting structure. The table assembly may also include a table mounted to the table slide mechanism. The table slide mechanism may be configured such that, when the table is reoriented from a chair ingress/egress orientation to an in-use orientation, a side-to-side table movement distance is proportional to a backward table movement distance.

In another embodiment, a table assembly for use with a chair may include a mounting structure and a table slide mechanism. The table slide mechanism may include at least one linear draw slide. The at least one linear draw slide may be mounted to the mounting structure diagonal with respect to a front surface of a respective chair. The table assembly may also include a table mounted to the table slide mechanism. The table slide mechanism may be configured such that, when the table is reoriented from a chair ingress/egress orientation to an in-use orientation, a side-to-side table movement and a backward table movement distance define a diagonal table movement.

In a further embodiment, a table assembly for use with at least two chairs may include a mounting structure, a first table slide mechanism attached to the mounting structure, and a second table slide mechanism attached to the mounting structure. The table assembly may also include a first table mounted to the first table slide mechanism. The first table slide mechanism may be configured such that, when the first table is reoriented from a chair ingress/egress orientation to an in-use orientation, a side-to-side first table movement distance is proportional to a backward first table movement distance. The table assembly may further include a second table mounted to the second table slide mechanism. The second table slide mechanism may be configured such that, when the second table is reoriented from a chair ingress/egress orientation to an in-use orientation, a side-to-side second table movement distance is proportional to a backward second table movement distance. A side-to-side first table movement may be opposite a side-to-side second table movement.

A venue having a plurality of chair assemblies and a plurality of table assemblies may include a first chair and table assembly located on a first venue floor section. The venue may also include a second chair assembly located on a second venue floor section. An elevation of the second venue floor section may be below an elevation of the first venue floor section. The second venue floor elevation may include a walkway in front of the first chair and table assembly and behind the second chair assembly.

In another embodiment, a venue having a plurality of chair assemblies and a plurality of table assemblies may include a first chair and table assembly located on a first venue floor section. The venue may also include a second chair assembly located on a second venue floor section. An elevation of the second venue floor section may be below an elevation of the first venue floor section. The first venue floor elevation may include a walkway in front of the first chair and table assembly and behind the second chair assembly.

A movable table assembly may include a concessions button fixed to the movable table assembly.

In another embodiment, a movable table assembly may include an illumination source fixed to the movable table assembly.

In a further embodiment, a chair and table assembly may include at least two movable chairs and at least one table. The at least two movable chairs may be repositionable relative to the at least one table such that occupants of the at least two movable chairs have a similar view of an event within an associated venue. The at least two movable chairs may be repositionable relative to the at least one table such that occupants of the at least two movable chairs have a view of one another.

A control system for a powered chair assembly may include a controller that may be correlated with a physical location of a respective chair within a venue.

In another embodiment, a control system for a powered chair assembly may include a controller that may be correlated with a physical location of a respective chair within a venue. The physical location may be designated by a row number and a chair number.

In a further embodiment, a control system for a powered table assembly may include a controller that may be correlated with a physical location of a respective table within a venue.

In yet a further embodiment, a control system for a powered table assembly may include a controller that may be correlated with a physical location of a respective table within a venue. The physical location may be designated by a row number and a chair number.

In another embodiment, a removable tray assembly may include a tray and a cup holder adaptor. The cup holder adaptor may include a concentric cup holder engagement.

In a further embodiment, a removable tray assembly may include a tray and a cup holder adaptor. The cup holder adaptor may include a non-concentric cup holder engagement.

A movable surface assembly for use with seating may include a support structure having a mounting structure. The mounting structure may be configured to be mounted to at least one of: a venue floor, a venue riser, a venue surface, a venue structure, or a chair structure. The movable surface assembly may also include a movable surface attachment fixed to the support structure, and a movable surface linear slide mechanism having a stationary portion fixed to the movable surface attachment and a linear slide portion slidingly engaged with the linear stationary portion. The movable surface assembly may further include a movable surface rotation mechanism having a rotate stationary portion fixed to the linear slide portion and a rotation portion rotatably engaged with the rotate stationary portion. The movable surface assembly may yet further include a movable surface fixed to the rotation portion.

In another embodiment, a movable surface assembly for use with seating may include a support structure having a mounting structure. The mounting structure may be configured to be mounted to at least one of: a venue floor, a venue riser, a venue surface, a venue structure, or a chair structure. The movable surface assembly may also include a movable surface attachment fixed to the support structure, and a movable surface rotation mechanism having a rotate stationary portion fixed to the movable surface attachment and a rotation portion rotatably engaged with the rotate stationary portion. The movable surface assembly may further include a movable surface linear slide mechanism having a stationary portion fixed to the rotation portion and a linear slide portion slidingly engaged with the linear stationary portion. The movable surface assembly may yet further include a movable surface fixed to the linear slide portion.

In a further embodiment, a movable surface assembly for use with venue seating a support structure having a mounting structure. The mounting structure may be configured to be mounted to at least one of: a venue floor, a venue riser, a venue surface, a venue structure, or a chair structure. The movable surface assembly may also include a movable surface attachment fixed to the support structure, and a first movable surface linear slide mechanism having a first stationary portion fixed to the movable surface attachment and a first linear slide portion slidingly engaged with the first linear stationary portion. The movable surface assembly may further include a first movable surface rotation mechanism having a first rotate stationary portion fixed to the first linear slide portion and a first rotation portion rotatably engaged with the first rotate stationary portion. The movable surface assembly may yet further include a first movable surface fixed to the first rotation portion. The movable surface assembly may include a second movable surface linear slide mechanism having a second stationary portion fixed to the movable surface attachment and a second linear slide portion slidingly engaged with the second linear stationary portion. The movable surface assembly may also include a second movable surface rotation mechanism having a second rotate stationary portion fixed to the second linear slide portion and a second rotation portion rotatably engaged with the second rotate stationary portion. The movable surface assembly may further include a second movable surface fixed to the second rotation portion.

An adjustable chair standard may include a first standard portion. The first standard portion may include at least one mounting foot, a first set of second standard portion engagements, and a second set of second standard portion engagements. The adjustable chair standard may also include a second standard portion. The second standard portion may include a set of first standard portion engagements. When the first set of second standard portion engagements is fixed proximate the set of first standard portion engagements, the first standard portion may be secured in a first orientation with respect to the second standard portion. When the second set of second standard portion engagements is fixed proximate the set of first standard portion engagements, the first standard portion may be secured in a second orientation with respect to the second standard portion. The second orientation may be different than the first orientation.

In another embodiment, an adjustable chair standard may include a first standard portion. The first standard portion may include at least one mounting foot and a set of second standard portion engagements. The adjustable chair standard may also include a second standard portion. The second standard portion may include at least one chair seat pivot attachment, an arm rest attachment, a first set of first standard portion engagements, and a second set of first standard portion engagements. When the first set of first standard portion engagements is fixed proximate the set of second standard portion engagements, the first standard portion may be secured in a first orientation with respect to the second standard portion. When the second set of first standard portion engagements is fixed proximate the set of second standard portion engagements, the first standard portion may be secured in a second orientation with respect to the second standard portion. The second orientation may be different than the first orientation.

In a further embodiment, an adjustable chair assembly standard may include a first standard portion. The first standard portion may include at least one mounting foot, a first set of second standard portion engagements, and a second set of second standard portion engagements. The adjustable chair standard may also include a second standard portion. The second standard portion may include at least one of: a foldable tray attachment or a table attachment, and a set of first standard portion engagements. When the first set of second standard portion engagements is fixed proximate the set of first standard portion engagements, the first standard portion may be secured in a first orientation with respect to the second standard portion. When the second set of second standard portion engagements is fixed proximate the set of first standard portion engagements, the first standard portion may be secured in a second orientation with respect to the second standard portion. The second orientation may be different than the first orientation.

In yet a further embodiment, a chair assembly may include a repositionable surface (e.g., a table, a tray, etc.) effected by rotation or translation or combination therein of members to aid in the use and or storage of said surface.

An assembly for use in a rocker style chair may include a spring assembly having a rubber body, a bottom cap, secured to a bottom side of the rubber body, including a first fastener hole, a second fastener hole and a bottom bushing hole. A bottom bushing may extend through the bottom bushing hole. The spring may also include a first fastener extending through the first fastener hole. The first fastener may include a first enlarged head that is larger than the first fastener hole and the first enlarged head may be trapped between the bottom side of the rubber body and the bottom cap. The spring may further include a second fastener extending through the second fastener hole. The second fastener may include a second enlarged head that is larger than the second fastener hole and the second enlarged head may be trapped between the bottom side of the rubber body and the bottom cap. The assembly may also include a landing bracket having a substantially flat, horizontal surface including a front spring assembly fastener hole, a rear spring assembly fastener hole, and an over-travel bolt opening configured to receive the bottom bushing of the spring assembly such that a substantially flat bottom surface of the spring assembly rests on the substantially flat, horizontal surface when the spring assembly is position proximate the landing bracket.

In another embodiment, an assembly for use in a rocker style chair may include a spring secured to a landing bracket. The spring may include a rubber body including a top side, a bottom side, a first side, a second side, a front end side, a rear end side, a top bushing located on the top side, a bottom bushing located on the bottom side, a substantially cylindrically shaped over-travel bolt passageway extending through the top bushing, through the rubber body from the top side to the bottom side and through the bottom bushing. The spring may also include a top cap, secured to the top side of the rubber body, including a first fastener hole, a second fastener hole and a top bushing hole. The top bushing may extend through the top bushing hole. The spring may further include a bottom cap, secured to the bottom side of the rubber body, including a third fastener hole, a fourth fastener hole and a bottom bushing hole. The bottom bushing may extend through the bottom bushing hole. The spring may yet further include a first fastener extending through the first fastener hole. The first fastener may include a first enlarged head that may be larger than the first fastener hole and the first enlarged head may be trapped between the top side of the rubber body and the top cap. The spring may also include a second fastener extending through the second fastener hole. The second fastener may include a second enlarged head that may be larger than the second fastener hole and the second enlarged head may be trapped between the top side of the rubber body and the top cap. The spring may further include a third fastener extending through the third fastener hole. The third fastener may include a third enlarged head that may be larger than the third fastener hole and the third enlarged head may be trapped between the bottom side of the rubber body and the bottom cap. The spring may yet further include a fourth fastener extending through the fourth fastener hole. The fourth fastener may include a fourth enlarged head that may be larger than the fourth fastener hole and the fourth enlarged head may be trapped between the bottom side of the rubber body and the bottom cap.

In a further embodiment, an assembly for use in a rocker style chair may include a spring attached to a landing bracket. The landing bracket may include a substantially flat, horizontal surface including a front spring assembly fastener hole, a rear spring assembly fastener hole and an over-travel bolt opening. The over-travel bolt opening may be configured to receive a bottom bushing of a spring assembly such that a substantially flat bottom surface the spring assembly may rest on the substantially flat, horizontal surface when the spring assembly is position proximate the landing bracket. The landing bracket may also include a side surface extending downward from the substantially flat, horizontal surface at approximately a ninety degree angle with respect to the substantially flat, horizontal surface. The side surface may be configured to attach the landing bracket to a standard.

An assembly for use in a rocker style chair may include a spring assembly having a rubber body, a bottom cap, secured to a bottom side of the rubber body, including a first fastener hole, a second fastener hole and a bottom bushing hole. A bottom bushing may extend through the bottom bushing hole. The spring may also include a first fastener extending through the first fastener hole. The first fastener may include a first enlarged head that is larger than the first fastener hole and the first enlarged head may be trapped between the bottom side of the rubber body and the bottom cap. The spring may further include a second fastener extending through the second fastener hole. The second fastener may include a second enlarged head that is larger than the second fastener hole and the second enlarged head may be trapped between the bottom side of the rubber body and the bottom cap. The assembly may also include a landing bracket having a substantially flat, horizontal surface including a front spring assembly fastener hole, a rear spring assembly fastener hole, and an over-travel bolt opening configured to receive the bottom bushing of the spring assembly such that a substantially flat bottom surface of the spring assembly rests on the substantially flat, horizontal surface when the spring assembly is position proximate the landing bracket.

In another embodiment, a seat bracket for use in a rocker style chair may include an over-travel bolt nut receptacle, wherein the over-travel bolt nut receptacle is configured to receive an associated over-travel bolt nut and to prevent the over-travel bolt nut from rotating when the over-travel bolt nut is received within the over-travel bolt nut receptacle. The seat bracket may further include a seat assembly fastener hole and corresponding seat assembly fastening receptacle, wherein the seat assembly fastening receptacle is configured to receive an associated seat assembly fastening head and to prevent the seat assembly fastening from rotating when the seat assembly fastening head is received within the seat assembly fastening head receptacle.

In a further embodiment, a seat bracket for use in a rocker style chair include at least one fastener head receptacle, wherein the at least one fastener head receptacle is configured to receive a fastener head and to prevent the fastener head from rotating when a fastener head is received within the fastener head receptacle. The seat bracket may further include a substantially flat bottom surface that is configured to engage a substantially flat surface of an associated spring assembly.

In yet another embodiment, a rocker style chair is provided. The rocker style chair may include a modular left-hand standard assembly including a left-hand landing bracket, wherein the left-hand landing bracket is shaped from a first landing bracket blank. The rocker style chair may also include a modular right-hand standard assembly including a right-hand landing bracket, wherein the right-hand landing bracket is shaped from a second landing bracket blank and wherein the second landing bracket blank is substantially the same shape as the first landing bracket blank and the right-hand landing bracket is substantially a mirror image of the left-hand landing bracket. The rocker style chair may further include a modular chair seat assembly and a modular chair back assembly.

In yet a further embodiment, a method of installing at least one chair assembly at an installation site is provided. The method may include assembling at least two modular standard assemblies at a first site. The method may also include assembling at least one modular chair seat assembly at a second site. The method may further include assembling at least one modular chair back assembly at a third site. The method may yet further include delivering the at least two modular standard assemblies, the at least one modular chair seat assembly and the at least one modular chair back assembly to the installation site, wherein a geographic location of the first site, a geographic location of the second site and a geographic location of the third site are different than a geographic location of the installation site. The method may also include placing the at least one modular chair seat assembly and the at least one modular chair back assembly proximate the at least two modular standard assemblies, at the installation site, in a free standing, final resting position at the installation site, without using any hand tools or fasteners, to define at least one rocker style chair.

In another embodiment, a plurality of chairs may be provided. The plurality of chairs may include at least one modular left-hand standard assembly including a left-hand landing bracket, wherein the left-hand landing bracket is shaped from a first landing bracket blank. The plurality of chairs may also include at least one modular center standard assembly including a left-hand landing bracket and a right-hand landing bracket, wherein the right-hand landing bracket is shaped from a second landing bracket blank and wherein the second landing bracket blank is substantially the same shape as the first landing bracket blank and the right-hand landing bracket is substantially a mirror image of the left-hand landing bracket. The plurality of chairs may further include at least one modular right-hand standard assembly including a right-hand landing bracket. The plurality of chairs may yet further include at least two modular chair seat assemblies and at least two modular chair back assemblies.

In a further embodiment, a singular modular standard may be utilized to support a rocker style chair or a fixed position style chair.

In yet further embodiments, at least one component and/or assembly is provided that may be used on either a right-side of an associated chair or a left-side of the associated chair.

In another embodiment, a movable surface assembly for use with seating may include a support structure having a mounting structure. The mounting structure may be configured to be mounted to at least one of: a venue floor, a venue riser, a venue surface, a venue structure, or a chair structure. The assembly may also include a movable surface attachment fixed to the support structure, a movable surface linear-curve movement mechanism fixed to the movable surface attachment, and a movable surface fixed to the linear-curve movement mechanism.

In a further embodiment, a movable surface assembly for use with seating may include a support structure having a mounting structure. The mounting structure is configured to be mounted to at least one of: a venue floor, a venue riser, a venue surface, a venue structure, or a chair structure. The assembly may also include a movable surface attachment fixed to the support structure, a movable surface curve-linear movement mechanism fixed to the movable surface attachment, and a movable surface fixed to the curve-linear movement mechanism.

In yet a further embodiment, a movable surface assembly for use with venue seating may include a support structure having a mounting structure. The mounting structure may be configured to be mounted to at least one of: a venue floor, a venue riser, a venue surface, a venue structure, or a chair structure. The assembly may also include a movable surface attachment fixed to the support structure, a first movable surface arc-path movement mechanism fixed to the movable surface attachment, and a first movable surface fixed to the first arc-path movement mechanism. The assembly may further include a second movable surface arc-path movement mechanism fixed to the movable surface attachment and a second movable surface fixed to the second arc-path movement mechanism.

BRIEF DESCRIPTION OF THE DRAWINGS

The figures described below depict various aspects of rocker style chairs and rocker style chairs with pivoting seats, components for use within the chairs and parts for use within the components that are disclosed herein. It should be understood that each figure depicts an embodiment of a particular aspect of the disclosed chairs, components and/or parts, and that each of the figures is intended to accord with a possible embodiment thereof. Furthermore, wherever possible, the following description refers to the reference numerals included in the following figures, in which features depicted in multiple figures may be designated with consistent reference numerals and/or consistent reference numerals having a differing concatenated letter.

FIGS. 1B-G depict plan views of example venues that include powered chair assemblies and/or table assemblies, and a computer system for managing powered chair assemblies, table assemblies, venue concessions, venue employee payroll, venue ticketing, customer loyalty, etc.;

DETAILED DESCRIPTION

Powered recliner chair assemblies, rocker style chair assemblies, rocker style chair assemblies with pivoting seats, and repositionable tray assemblies of the present disclosure may be installed within dine-in theaters, gymnasiums, auditoriums, stadiums, theaters, arenas, conference centers, cinemas, places of worship (e.g., a church, a synagogue, a mosque, a temple, etc.), education facilities, classrooms, performance halls, home theaters and the like. The individual powered recliner chair assemblies, rocker style chair assemblies, rocker style chair assemblies with pivoting seats, and repositionable tray assemblies, and/or a related installation structure, may include power and/or data connections and related systems for use by a chair occupant and/or a venue operator.

The powered recliner chair assemblies, rocker style chair assemblies, rocker style chair assemblies with pivoting seats, and repositionable tray assemblies of the present disclosure may be assembled, on site, starting with a set of modular components. For example, each rocker style chair may include a left-hand standard module, a right-hand standard module, a chair seat module and a chair back module (i.e., each rocker style chair may include four modular components). When two, or more, rocker style chairs are installed side-by-side in a row, each rocker style chair, within a row of side-by-side rocker style chairs, may share a center standard module. In any event, the individual modular components (e.g., left-hand standard module, right-hand standard module, center standard module, chair seat module and chair back module) may be pre-assembled off site. As a result, on-site installation time is minimized, the need for on-site skilled labor is minimized, the likelihood of losing parts on-site is minimized, on-site assembly errors are minimized, etc.

Similarly, the powered recliner chair assemblies and table assemblies may be at least partially assembled remote from an associated venue site, and the associated subassemblies may be shipped to the venue site for installation. Likewise, associated electrical components and systems may be shipped to a venue site for final installation by, for example, non-skilled labor. For example, electrical power and/or control components and/or subassemblies may include plug-in connections and/or wire routing features.

Figure 1A:
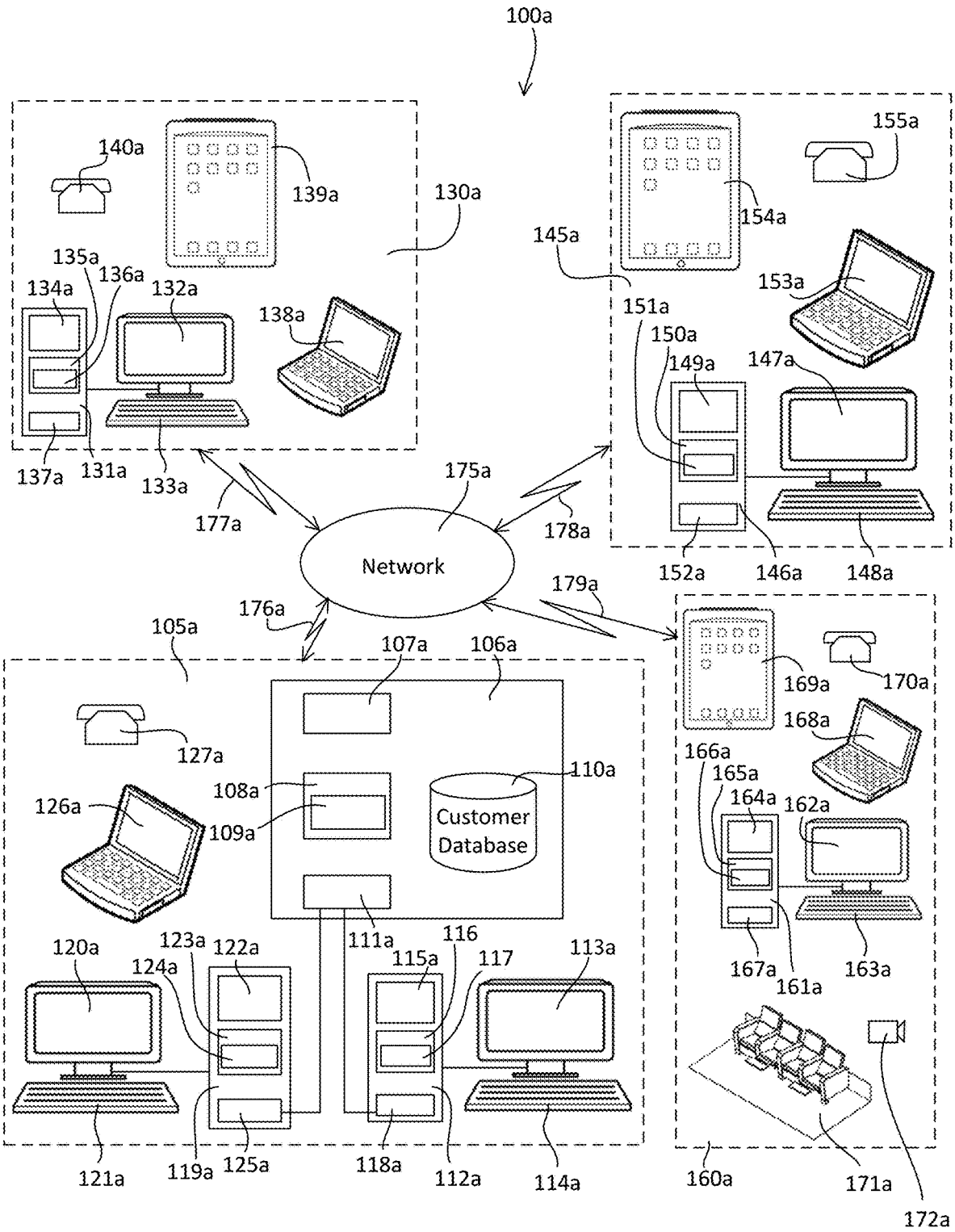
FIG. 1A depicts an example high-level block diagram of a computer system for managing powered chair assemblies, table assemblies, and venues that include powered chair assemblies and/or table assemblies.
Figure 1B:
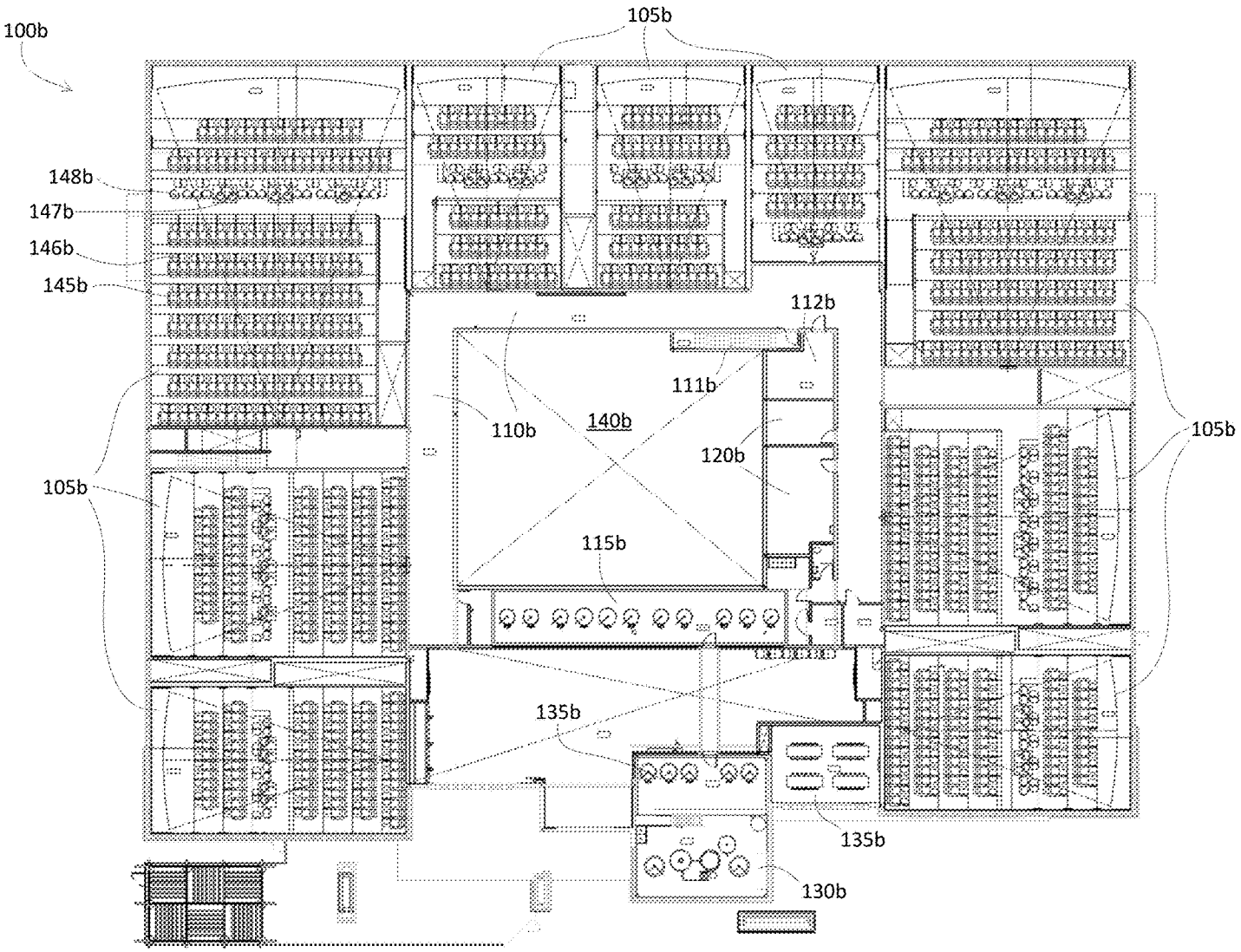
Figure 1C:
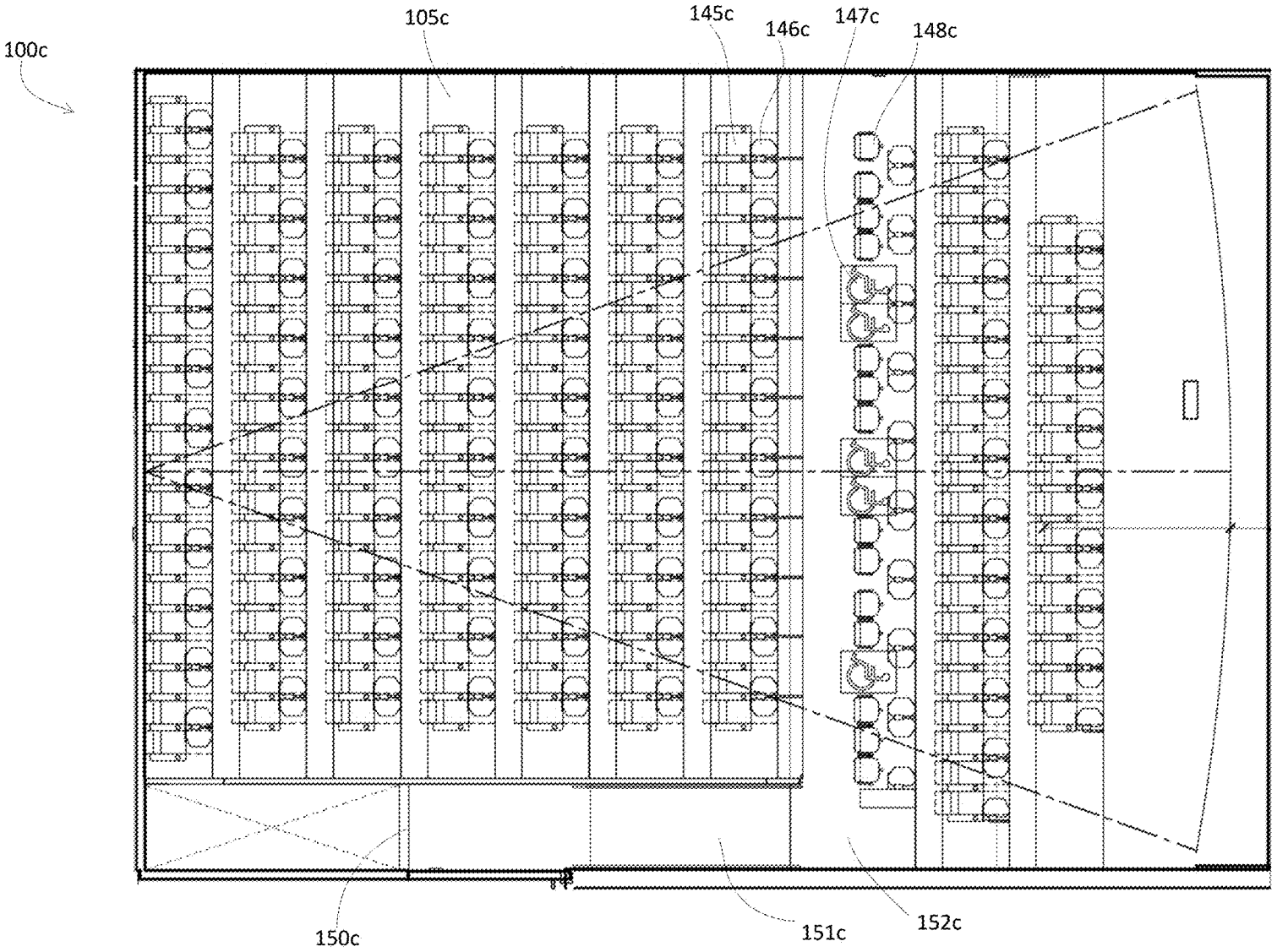
Figure 1D:
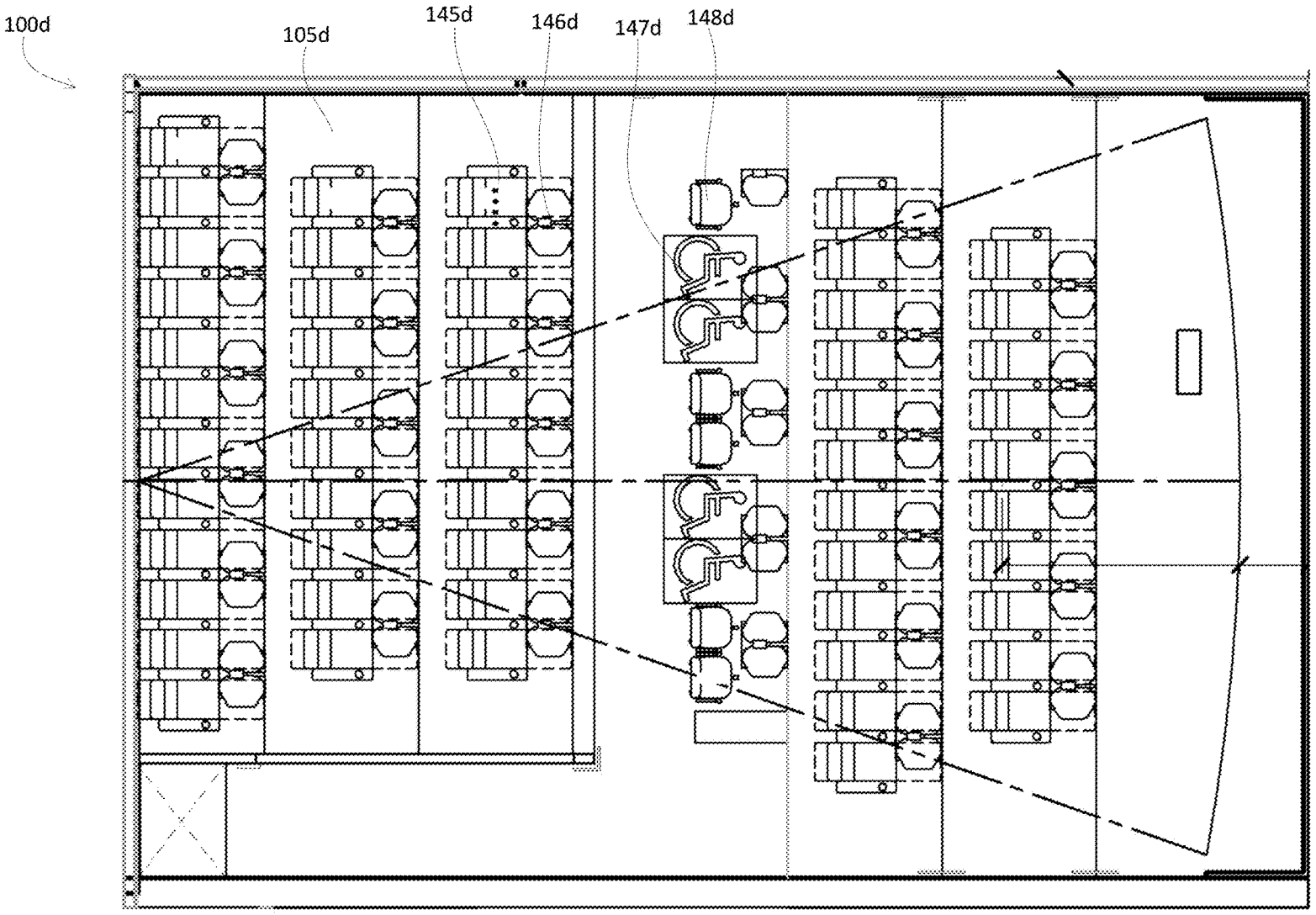

Turning to FIG. 1A, a high-level block diagram of an example computer system 100*a* for managing powered chairs and/or powered tables, and venues that include powered chairs and/or powered tables, is depicted. The computer system 100*a* may include a central venue operations center 105*a* and a powered chair and/or powered table site 160*a* (e.g., a movie theater, a sports venue, an auditorium, an arena, a theater, a dine-in cinema, or any other venue) communicatively couple via a communications network 175*a*.

The computer system 100*a* may, for example, include a venue ticket system 112*a*, a venue concessions system 119*a*, associated inventory management106*a*, associated data collection 110*a*, etc. Accordingly, the computer system 100*a* may include ticket sales data (e.g., ticket sales for a plurality of movies, correlated with each movie showing, that have been shown at a venue, ticket sales for a plurality of pay-per-view sporting events, correlated with each event showing, that have been shown at a venue, etc.) The computer system 100*a* may also include an employee payroll management and/or time clock system and/or a customer loyalty system.

The computer system 100*a* may also include a remote powered chair technician, a remote powered table technician, and/or a remote concessions operation site 145*a* and a remote powered chair supplier, a remote powered table supplier, and/or a remote concessions supplier site 130*a*. While, for convenience of illustration, only a single central venue operations center 105*a* is depicted within the computer system 100*a* of FIG. 1A, any number of central venue operations centers 105*a* may be included within the computer system 100*a* (e.g., a first central venue operations center for venue ticketing, a second central venue operations center for venue concessions, a third central venue operations center for venue operations, etc.). While, for convenience of illustration, only a single powered chair and/or powered table site 160*a* is depicted within the computer system 100*a* of FIG. 1A, any number of powered chair and/or powered table sites 160*a* may be included within the computer system 100*a*. Indeed, the computer system 100*a* may accommodate thousands of powered chair and/or powered table sites 160*a*. While, for convenience of illustration, only a single powered chair and/or powered table technician site 145*a* is depicted within the computer system 100*a* of FIG. 1A, any number powered chair and/or powered tables of technician sites 145*a* may be included within the computer system 100*a*. Any given powered chair and/or powered table technician site 145*a* may be a mobile site. While, for convenience of illustration, only a single powered chair and/or powered table supplier site 130*a* is depicted within the computer system 100*a* of FIG. 1A, any number of powered chair and/or powered table supplier sites 130*a* may be included within the computer system 100*a*.

The communications network 175*a*, any one of the network adapters 111*a*, 118*a*, 125*a*, 137*a*, 152*a*, 167*a* and any one of the network connections 176*a*, 177*a*, 178*a*, 179*a* may include a hardwired section, a fiber-optic section, a coaxial section, a wireless section, any sub-combination thereof or any combination thereof, including for example a wireless LAN, MAN or WAN, WiFi, WiMax, the Internet, a Bluetooth connection, an Ethernet connection, a Zigbee internet connection, a Global Cache' internet connection, or any combination thereof. Moreover, a central venue operations center 105*a*, a powered chair and/or powered table site 160*a*, a powered chair and/or powered table technician site 145*a* and/or a powered chair and/or powered table supplier 130*a* site may be communicatively connected via any suitable communication system, such as via any publicly available or privately owned communication network, including those that use wireless communication structures, such as wireless communication networks, including for example, wireless LANs and WANs, satellite and cellular telephone communication systems, etc. The network 175*a* may include, for example, a dynamic host configuration protocol (DHCP) on a UDP/IP network server that may dynamically assign an IP address and other network configuration parameters to each device 106*a*, 112*a*, 119*a*, 126*a*, 127*a*, 131*a*, 138*a*, 139*a*, 140*a*, 146*a*, 153*a*, 154*a*, 155*a*, 161*a*, 168*a*, 169*a*, 170*a*.

Any given central venue operations center 105*a* may include a mainframe, or central server, system 106*a*, a server terminal 112*a*, a desktop computer 119*a*, a laptop computer 126*a* and a telephone 127*a*. While the central venue operations center 105*a* of FIG. 1A is shown to include only one mainframe, or central server, system 106*a*, only one server terminal 112*a*, only one desktop computer 119*a*, only one laptop computer 126*a* and only one telephone 127*a*, any given central venue operations center 105*a* may include any number of mainframe, or central server, systems 106*a*, server terminals 112*a*, desktop terminals 119*a*, laptop computers 126*a* and telephones 127*a*. Any given telephone 127*a* may be, for example, a land-line connected telephone, a computer configured with voice over internet protocol (VOIP), or a mobile telephone (e.g., a smartphone). Any given server terminal 112*a* may include a processor 115*a*, a memory 116*a* having at least on set of computer-readable instructions stored thereon and associated with managing powered chair and/or powered tables and venue operations 117*a*, a network adapter 118*a* a display 113*a* and a keyboard 114*a*. Any given desktop computer 119*a* may include a processor 122*a*, a memory 123*a* having at least on set of computer-readable instructions stored thereon and associated with managing powered chair and/or powered tables and venue operations 124*a*, a network adapter 125*a* a display 120*a* and a keyboard 121*a*. Any given mainframe, or central server, system 106*a* may include a processor 107*a*, a memory 108*a* having at least on set of computer-readable instructions stored thereon and associated with managing powered chair and/or powered tables and venue operations 109*a*, a network adapter 111*a* and a customer (or client) database 110*a*. The customer (or client) database 110*a* may store, for example, chair operation data and/or associated venue data, related to operation of the chair (or a group of chairs) within an associated venue. Any given lap top computer 126*a* may include a processor, a memory having at least on set of computer-readable instructions stored thereon and associated with managing powered chair and/or powered tables and venue operations, a network adapter, a display and a keyboard. Any given telephone 127*a* may include a processor, a memory having at least on set of computer-readable instructions stored thereon and associated with managing powered chair and/or powered tables and venue operations, a network adapter, a display and a keyboard.

Any given powered chair and/or powered table supplier 130*a* may include a desktop computer 131*a*, a lap top computer 138*a*, a tablet computer 139*a* and a telephone 140*a*. While only one desktop computer 131*a*, only one lap top computer 138*a*, only one tablet computer 139*a* and only one telephone 140*a* is depicted in FIG. 1A, any number of desktop computers 131*a*, lap top computers 138*a*, tablet computers 139*a* and/or telephones 140*a* may be included at any given powered chair and/or powered table supplier 130*a*. Any given telephone 140*a* may be a land-line connected telephone or a mobile telephone (e.g., smartphone). Any given desktop computer 131*a* may include a processor 134*a*, a memory 135*a* having at least on set of computer-readable instructions stored thereon and associated with managing powered chair and/or powered tables and venue operations 136*a*, a network adapter 137*a* a display 132*a* and a keyboard 133*a*. Any given lap top computer 138*a* may include a processor, a memory having at least on set of computer-readable instructions stored thereon and associated with managing powered chair and/or powered tables and venue operations, a network adapter, a display and a keyboard. Any given tablet computer 139*a* may include a processor, a memory having at least on set of computer-readable instructions stored thereon and associated with managing powered chair and/or powered tables and venue operations, a network adapter, a display and a keyboard. Any given telephone 140*a* may include a processor, a memory having at least on set of computer-readable instructions stored thereon and associated with managing powered chair and/or powered tables and venue operations, a network adapter, a display and a keyboard.

Any given powered chair and/or powered table technician site 145*a* may include a desktop computer 146*a*, a lap top computer 153*a*, a tablet computer 154*a* and a telephone 155*a*. While only one desktop computer 146*a*, only one lap top computer 153*a*, only one tablet computer 154*a* and only one telephone 155*a* is depicted in FIG. 1A, any number of desktop computers 146*a*, lap top computers 153*a*, tablet computers 154*a* and/or telephones 155*a* may be included at any given powered chair and/or powered table technician site 145*a*. Any given telephone 155*a* may be a land-line connected telephone or a mobile telephone (e.g., smartphone). Any given desktop computer 146*a* may include a processor 149*a*, a memory 150*a* having at least on set of computer-readable instructions stored thereon and associated with managing powered chair and/or powered tables and venue operations 151*a*, a network adapter 152*a* a display 147*a* and a keyboard 148*a*. Any given lap top computer 153*a* may include a processor, a memory having at least on set of computer-readable instructions stored thereon and associated with managing powered chair and/or powered tables and venue operations, a network adapter, a display and a keyboard. Any given tablet computer 154*a* may include a processor, a memory having at least on set of computer-readable instructions stored thereon and associated with managing powered chair and/or powered tables and venue operations, a network adapter, a display and a keyboard. Any given telephone 155*a* may include a processor, a memory having at least on set of computer-readable instructions stored thereon and associated with managing powered chair and/or powered tables and venue operations, a network adapter, a display and a keyboard.

Any given powered chair and/or powered table site 160*a* may include a desktop computer 161*a*, a lap top computer 168*a*, a tablet computer 169*a* and a telephone 170*a*. While only one desktop computer 161*a*, only one lap top computer 168*a*, only one tablet computer 169*a* and only one telephone 170*a* is depicted in FIG. 1A, any number of desktop computers 161*a*, lap top computers 168*a*, tablet computers 169*a* and/or telephones 170*a* may be included at any given powered chair and/or powered table site 160*a*. Any given telephone 170*a* may be a land-line connected telephone or a mobile telephone (e.g., smartphone). Any given desktop computer 161*a* may include a processor 164*a*, a memory 165*a* having at least on set of computer-readable instructions stored thereon and associated with managing powered chair and/or powered tables and venue operations 166*a*, a network adapter 167*a* a display 162*a* and a keyboard 163*a*. Any given lap top computer 168*a* may include a processor, a memory having at least on set of computer-readable instructions stored thereon and associated with managing powered chair and/or powered tables and venue operations, a network adapter, a display and a keyboard. Any given tablet computer 169*a* may include a processor, a memory having at least on set of computer-readable instructions stored thereon and associated with managing powered chair and/or powered tables and venue operations, a network adapter, a display and a keyboard. Any given telephone 170*a* may include a processor, a memory having at least on set of computer-readable instructions stored thereon and associated with managing powered chair and/or powered tables and venue operations, a network adapter, a display and a keyboard. While not shown in FIG. 1A, any given set of powered chair and/or powered tables 171*a*, or individual powered chair and/or powered table, may include a programmable controller (e.g., controller 301 of FIG. 3), a powered chair and/or powered table local control (e.g., 309-316 of FIG. 3), and/or any number of linear and/or rotary actuators (e.g., actuator 511 of FIG. 3). Furthermore, while not shown in FIG. 1A, any given set of powered chairs and/or powered tables 171*a*, or individual powered chair and/or powered table, may include a plurality of sensors (e.g., temperature sensor, pressure sensor, limit switch, motion sensor, strain gauge, position sensor, occupancy sensor, load sensor, etc.).

Any given venue site 160*a*, 105*a* and/or remote site 130*a*, 145*a* may include a ticket point of sale system, a food/beverage point of sale system, an employee payroll management and/or time clock system, a smart chair system, and/or a customer loyalty system. The ticket point of sale system may be, for example, an optional module that may provide ticket information which is available through, for example, integration with a supported ticketing point of sale system. The food/beverage system may be, for example, an optional module that may provide food sales information which may be, for example, available through integration with a supported food/beverage point of sale system. The employee payroll management and/or time clock system may be, for example, an optional module that may provide employee payroll management and/or time clock information which may be, for example, available through integration with a supported employee payroll management and/or time clock system. The smart chair system may include, for example, an optional module that may provide smart chair information which may be, for example, available through integration with a supported chair control system. The customer loyalty system may be, for example, an optional module that may provide customer loyalty information which may be, for example, available through integration with a supported customer loyalty system.

Any given venue may, for example, include a plurality of powered recliner chair assemblies, a plurality of rocker style chair assemblies with pivoting seats, roller style chair assemblies, and/or repositionable tray/table assemblies. Each chair assembly and/or tray/table assembly, and/or a group of chair assemblies and/or table assemblies, may include at least one powered control (e.g., electric powered actuator(s), pneumatic powered actuator(s), push buttons, etc.) configured to allow a chair occupant to reposition, for example, a chair, a headrest, a chair back, a chair lumbar support, a chair seat, an ottoman, a tray, a table, etc. as disclosed in, for example, commonly assigned U.S. patent application Ser. No. 62/816,707 and Ser. No. 15/640,938, the disclosures of which are incorporated in its entirety herein by reference. When a powered control is included, a chair, a headrest, a chair back, a chair lumbar support, a chair seat, an ottoman, a tray, a table, etc. may automatically retract in response to a remote control (e.g., a venue emergency system, a venue cleaning system, a venue ticketing system). Similarly, a chair, a headrest, a chair back, a chair lumbar support, a chair seat, an ottoman, a tray, a table, etc. may automatically extend in response to a remote control (e.g., a venue cleaning system). A first a chair, a headrest, a chair back, a chair lumbar support, a chair seat, an ottoman, a tray, a table, etc. may be inhibited from starting to move when a second a chair, a headrest, a chair back, a chair lumbar support, a chair seat, an ottoman, a tray, a table, etc. of another chair is starting to move, thereby, reducing electric power demand.

Alternatively, or additionally, any one of the chair assemblies of the present disclosure may be similar to, for example, the chair assemblies as described within U.S. patent application Ser. No. 15/919,172, filed Mar. 12, 2018; Ser. No. 15/919,176, filed Mar. 12, 2018; Ser. No. 15/800,182, filed Nov. 1, 2017; Ser. No. 15/675,865, filed Aug. 14, 2017; and Ser. No. 15/710,768, filed Sep. 20, 2017, the entire disclosures of which are incorporated herein by reference thereto. Alternatively, or additionally, any one of the chair assemblies of the present disclosure may be similar to, for example, the chair assemblies as described within U.S. Provisional Patent Application Ser. No. 62/816,707, filed Mar. 11, 2019, 62/631,457, filed Feb. 15, 2018, and 62/689,237, filed Jun. 24, 2018 the entire disclosures of which are incorporated herein by reference thereto. Alternatively, or additionally, any one of the chair assemblies of the present disclosure may be similar to, for example, the chair assemblies as described within patent application Ser. No. 61/287,418, filed Jan. 26, 2016; 62/366,006, filed Jul. 23, 2016; 62/394,281, filed Sep. 14, 2016; and 62/432,600, filed Dec. 11, 2016, the entire disclosures of which are incorporated herein by references thereto. Alternatively, or additionally, any one of the chair assemblies of the present disclosure may be similar to, for example, the chair assemblies as described within U.S. patent application Ser. No. 14/331,404, filed Jul. 15, 2014; Ser. No. 14/636,045, filed Mar. 2, 2015; Ser. No. 14/728,401, filed Jun. 2, 2015; Ser. No. 14/788,767, filed Jun. 30, 2015; PCT/US16/25803, filed Apr. 3, 2016, PCT/US18/46569, filed Aug. 13, 2018, the entire disclosures of which are incorporated herein by references thereto.

A rocker style chair with pivoting seat may, for example, include any of the electrical power and/or data systems as disclosed in, for example, commonly assigned U.S. patent application Ser. No. 15/640,938, which is incorporated in its entirety herein by reference. Similarly, the rocker style chairs without pivoting seats may include any of the electrical power and/or data systems as disclosed in, for example, commonly assigned U.S. patent application Ser. No. 15/640,938.

With reference to FIGS. 1B-G, any given venue 100*b-g* may include at least one venue 105*b-g,* a projection platform 110*b* with access stairs 111*b*, a projection control room 112*b*, a beer tank display 115*b*, at least one storage area 120*b*, at least one event room 125*b*, a brewery 130*b*, a brewery mezzanine 135*b*, and a lobby 140*b*. Any given venue 105*b-g* may include a plurality of powered chairs 145*b-g,* a plurality of powered tables 146*b-g,* 149*g,* a plurality of adults with disability act (ADA) compliant areas 147*b-g,* a plurality of relocatable chairs 148*b,f,g,* and a plurality of handrails 170*e-g,* 175*e-g*. At least one of the ADA compliant areas 147*b-g* may include a table assembly 146*b-g,* 149*g* that may, for example, include a mechanism for raising and/or lower a respective table. Thereby, an associated ADA compliant area may accommodate a range of occupants (e.g., an occupant in a wheel chair, an occupant in a stroller, an occupant on a scooter, etc.).

Any given venue 105*b-g* may further include an entrance 150*c,e,g,h,* an entrance ramp 151*c,h,* an ADA accessible level 152*c,h,* a sound system 155*e,* a display screen system 160*e,* a display projection system 165*e,* and an auditorium lighting system 180*e*. As described in more detail below, any given venue and/or auditorium may include a computer system 100*a*, 300 as illustrated and described, for example, with regard to FIG. 1A and/or FIG. 3, respectively.

An imaging device 172*a* (e.g., a digital camera, a stereoscopic imaging device, a 3D sonar sensor, a 3D laser scanner, a Lidar sensor, etc.) may be provided within a particular venue, for example, positioned in front of a group of chair assemblies and aimed toward the chair assemblies. A processor may acquire at least one image from the imaging device and the processor may generate occupancy data based upon image data that is representative of the at least one image. The processor may generate time stamped image data that is, for example, representative of a status (e.g., occupied, unoccupied, at least partially reclined, a light source energized, etc.) of a chair assembly, or a group of chair assemblies, at any given point in time/day. The processor may store the time stamped image data within a computer-readable medium (e.g., a memory 165 of FIG. 1).

Any given device 106*a*, 112*a*, 119*a*, 126*a*, 127*a*, 131*a*, 138*a*, 139*a*, 140*a*, 146*a*, 153*a*, 154*a*, 155*a*, 161*a*, 168*a*, 169*a*, 170*a* may include chair assembly/table assembly location data that may, for example, identify a physical location (e.g., venue location, row location, position location within the row, etc.) of a plurality of chair assemblies/table assemblies. Thereby, any given display device (e.g., display device 113*a*, 120*a*, 132*a*, 147*a*, 162*a*, etc.) may include a venue graphic (e.g., a venue 100*b-g* of FIGS. 1B-G) that may enable a user to select any given chair assembly and/or table assembly within any given venue. Once a user selects a given chair assembly and/or table assembly, the user may, for example, control an orientation of the given chair assembly and/or table assembly, monitor a status (e.g., an orientation, an occupation, a health, etc.) of the given chair assembly and/or table assembly, and/or obtain data from the given chair assembly and/or table assembly. Additionally, or alternatively, once a physical location of a given chair assembly and/or table assembly is correlated with a given location (e.g., a chair icon or a table icon) within a venue display 100*b-g,* the venue display 100*b-g* may automatically include chair assembly/table assembly information, for example, proximate the respective chair icon or table icon within the venue display 100*b-g*.

Figure 1F:
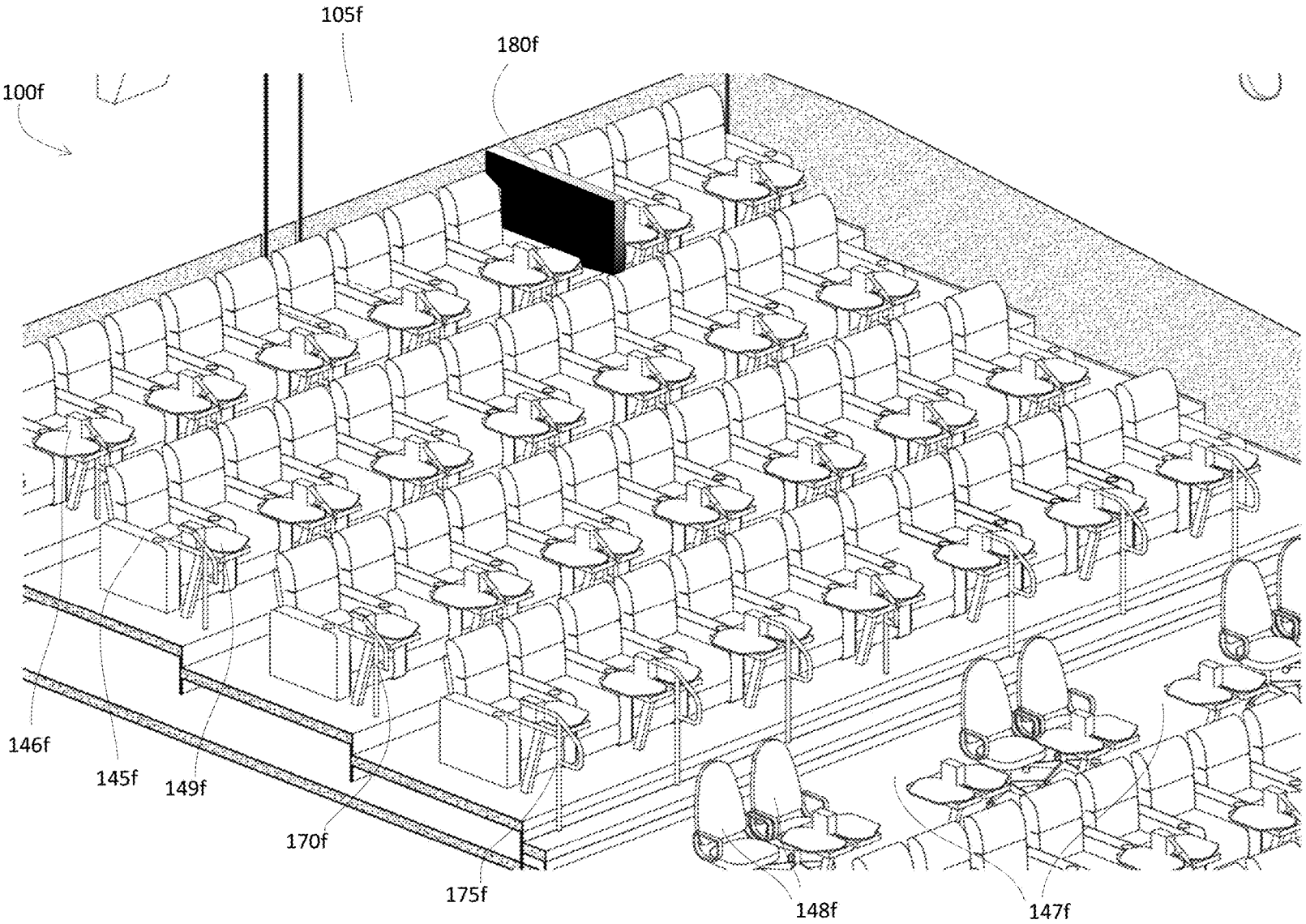
Figure 1G:
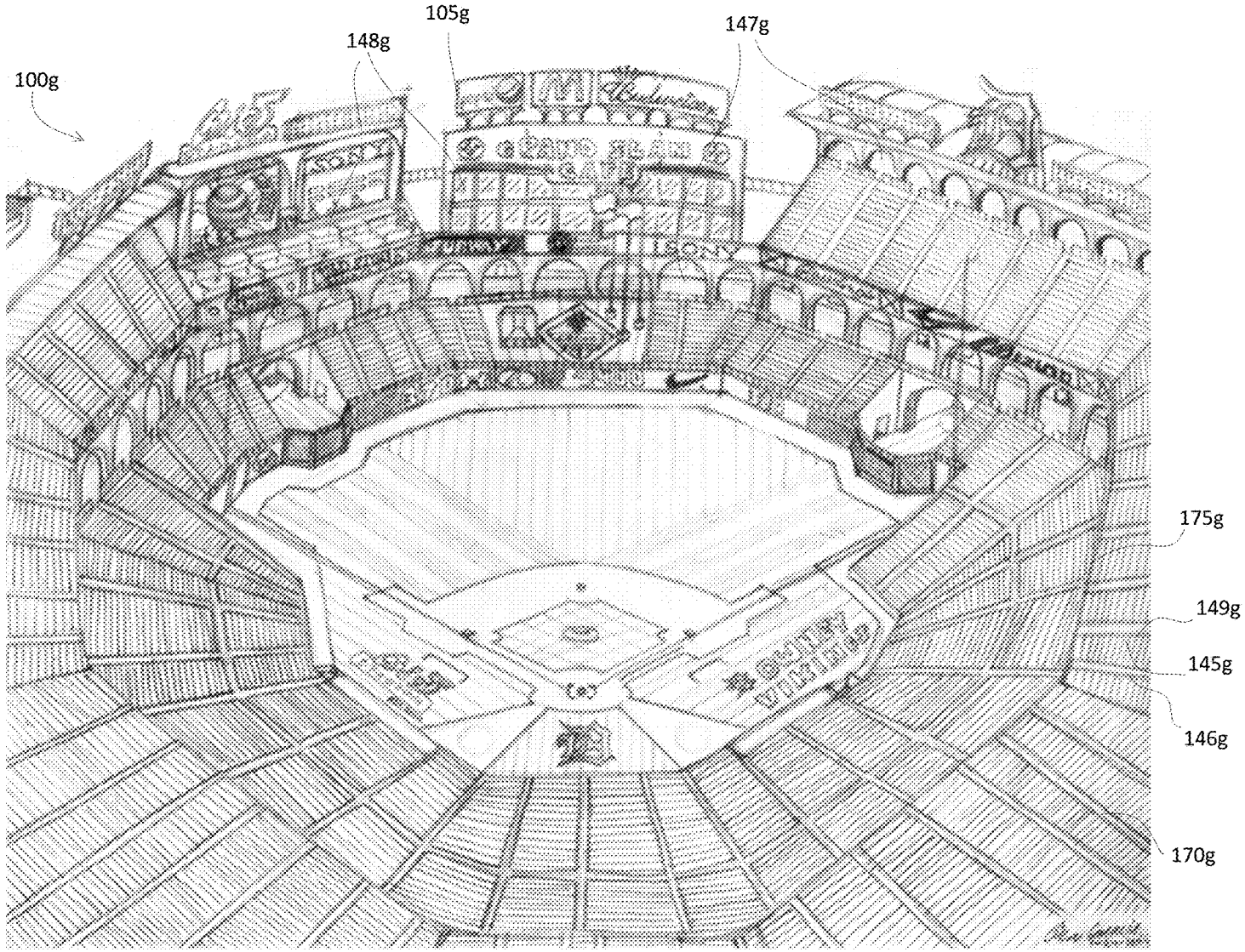
Figures 15A, 15B, 15C:
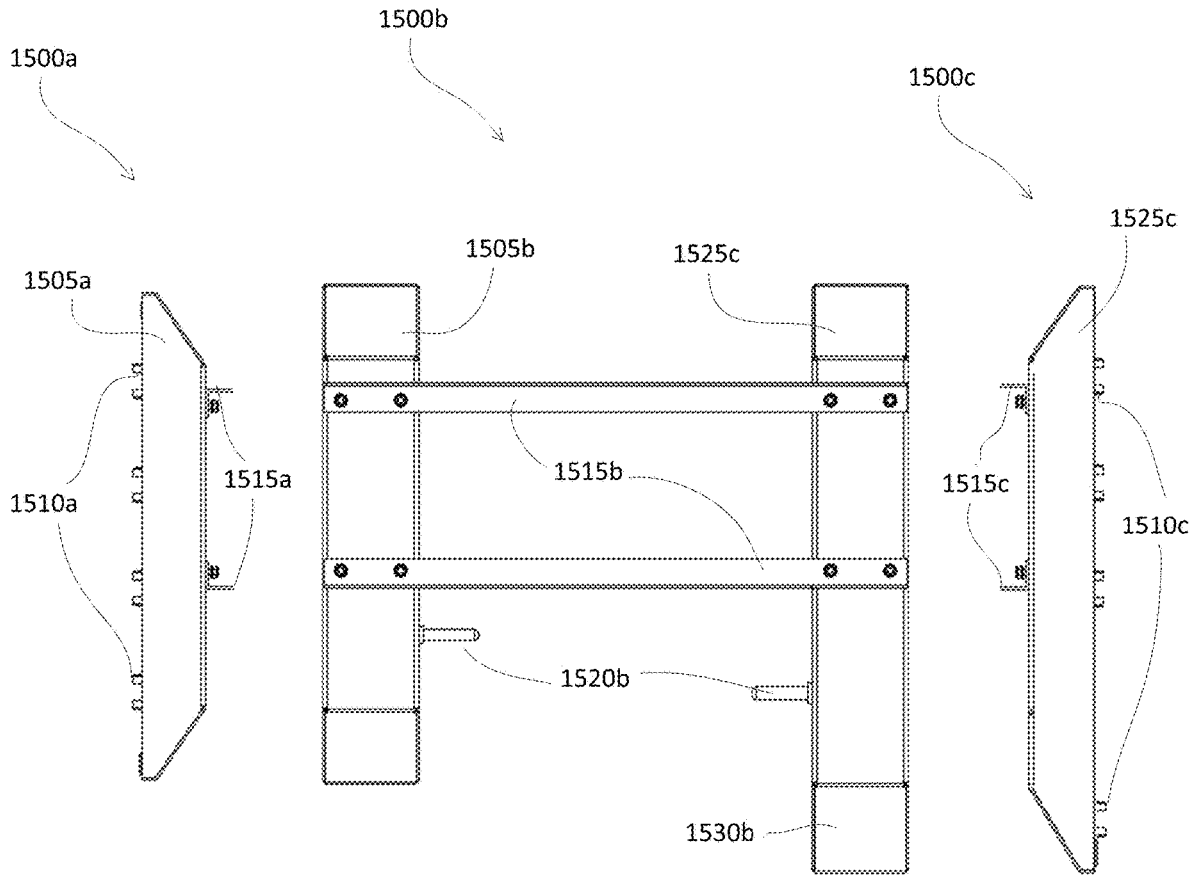
FIGS. 15A-D depict an example dolly and mobile chair and table assembly.
Figure 15D:
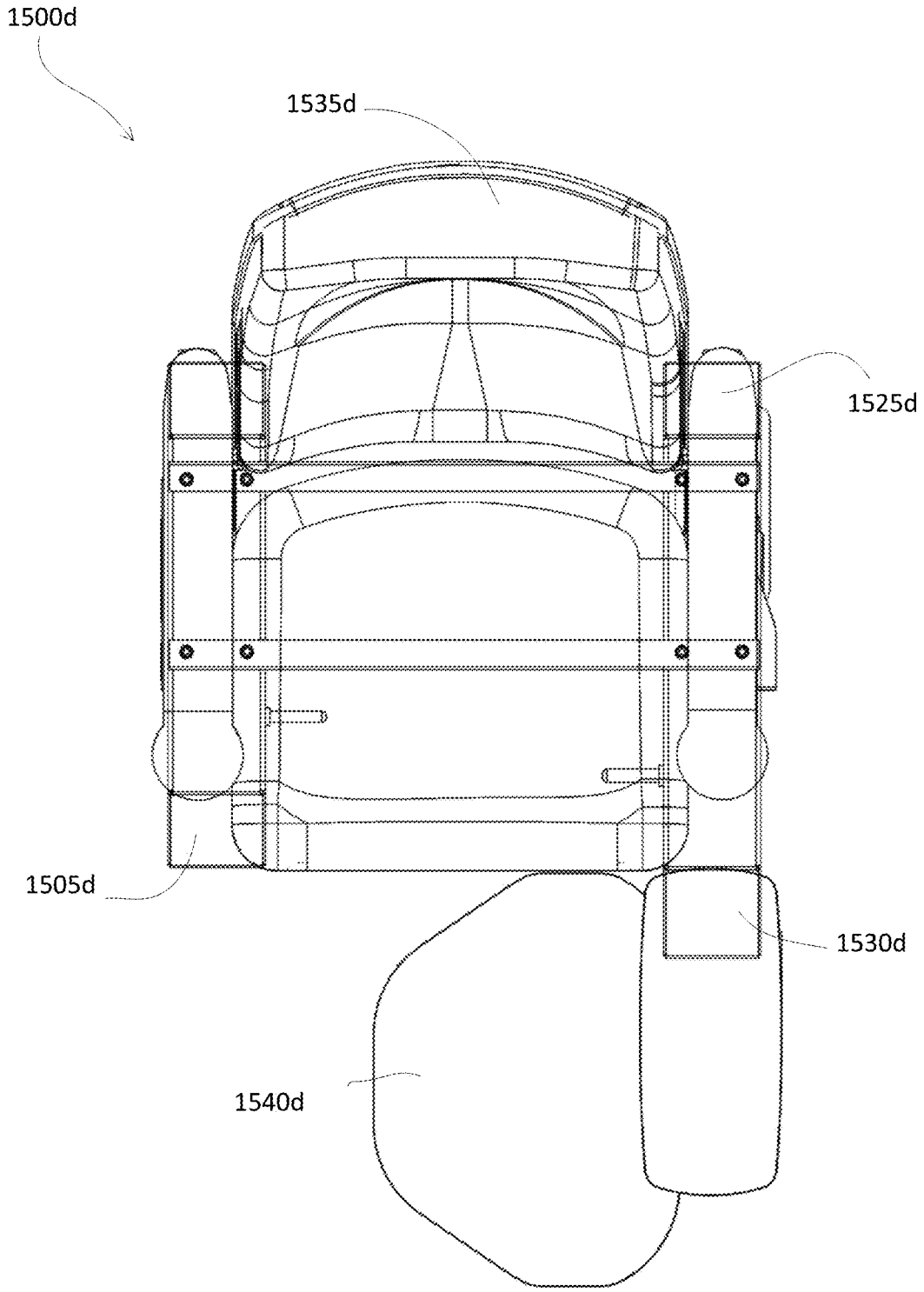
Figures 16A, 16B, 16C:
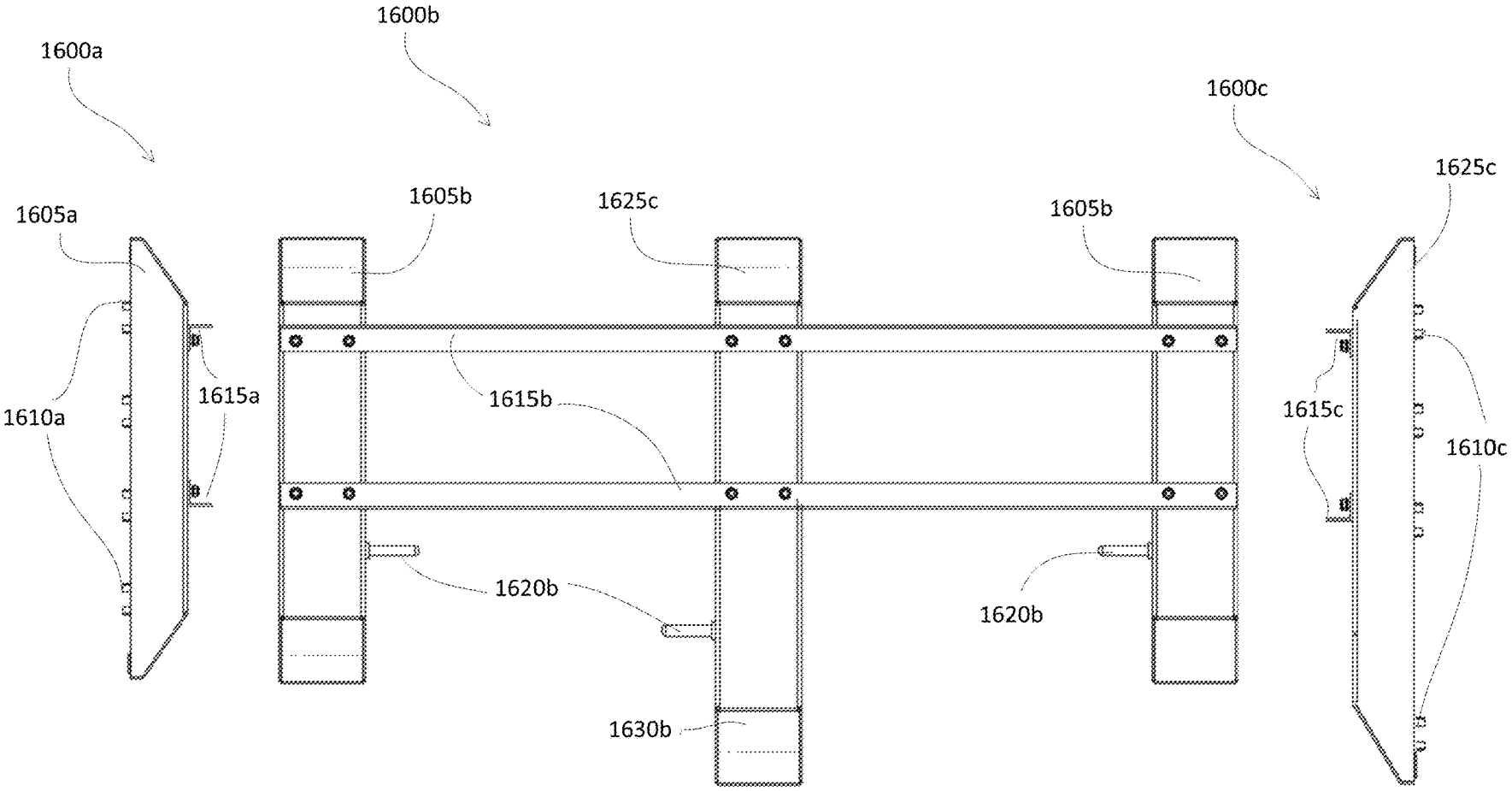
FIGS. 16A-D depict an example dolly and mobile multi-chair and multi-table assembly.
Figure 16D:
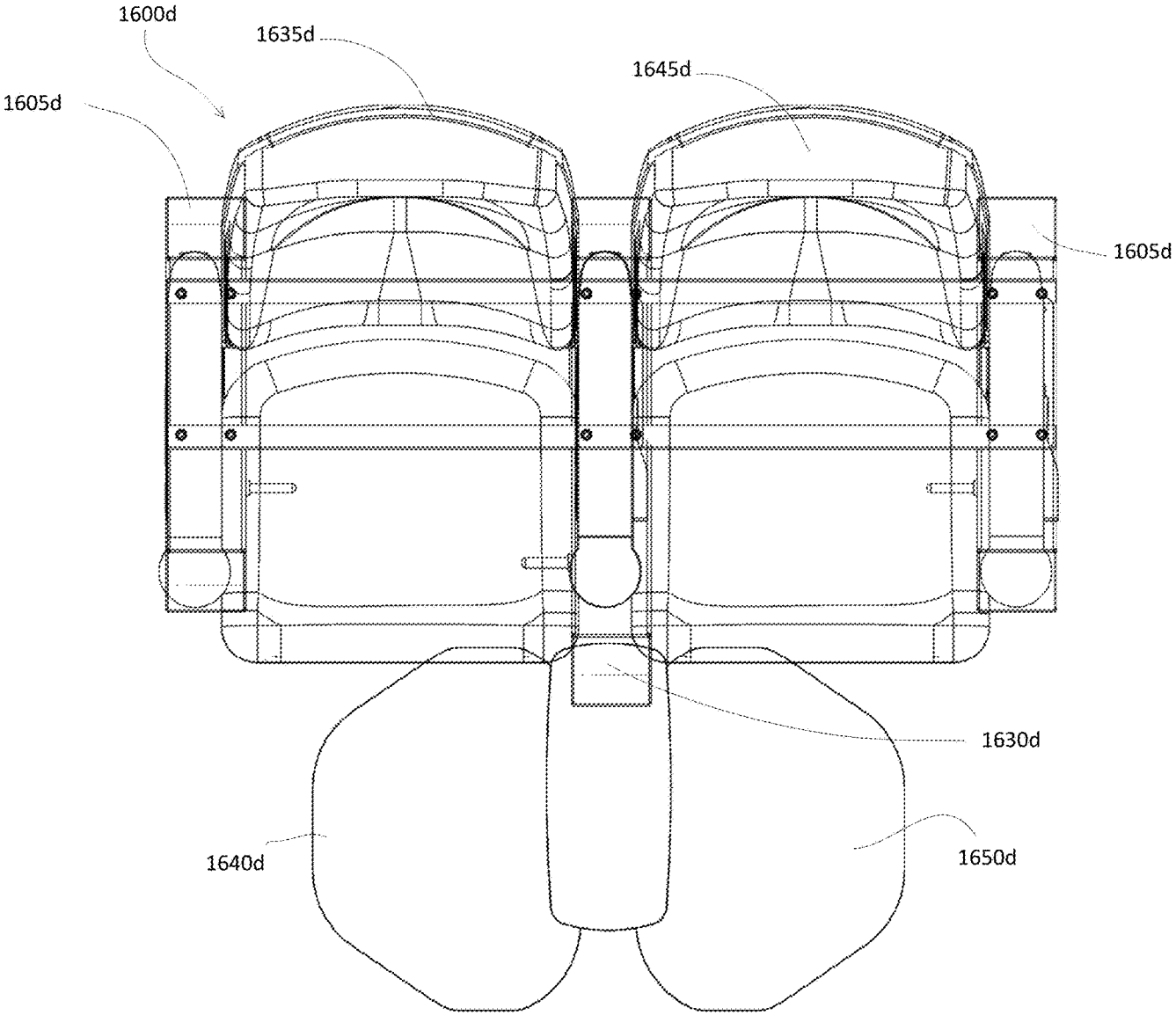

As shown in FIG. 1F, a venue 100*f* may include at least one privacy screen 180*f* located between one chair and another chair. Thereby, a particular chair (or group of chairs) may define a section of a venue 100*b-g* that may be at least partially separated from other sections of the venue 100*b-g*. As an example, a venue 100*f* may include at least one privacy screen 180*f* proximate a group of chair assemblies (e.g., chair assemblies 145*f,* 148*f,* 1010 of FIG. 10, 1535*d* of FIG. 15D, 1635*d* of FIG. 16D) and/or table assemblies (e.g., table assemblies 146*f,* 149*f,* 1005 of FIG. 10, 1540*d* of FIG. 15D, 1640*d* of FIG. 16D) may define a separate area of a venue 100*b-g*. A plurality of privacy screens 180*f* may be included within, for example, a given box seating area of a venue 100*b-g* to separate the respective box into a plurality of boxes. Similarly, a deck area and/or a loge area of a venue 100*b-g* may be subdivided. A privacy screen 180*f* may be as, for example, any of the similar devices as described in commonly assigned U.S. Provisional Patent Application Ser. Nos. 62/911,052, 63/012,65, 63/012,653 and 63/035,924, the entire disclosures of which are incorporated herein by reference.

Alternatively, or additionally, a privacy screen 180*f* may include table surfaces attached. For example, a table may slide underneath a privacy screen 180*f*, or a table may be foldably attached to the privacy screen 180*f*. A privacy screen 180*f* may fill any gap(s) between proximate chair arms, and may avoid hand rails on taller risers. As an alternative to the privacy screen 180*f* shown in FIG. 1F, a privacy screen 180*f* may extend along a chair assembly and table assembly, and end at a respective isle. Therefore, the privacy screen 180*f* may not interfere with ingress to the respective seating and/or egress from the respective seating.

As another alternative, a table assembly may be located proximate a rear of a chair assembly that is in front of a chair assembly from which an occupant may utilize the table assembly. In this type installation, a privacy screen 180*f* may be separated; one portion of the privacy screen 180*f* may extend along a side of the respective chair assembly and a second portion of the privacy screen 180*f* may extend along a side of the respective table assembly.

Location data for a plurality of chair assemblies and/or table assemblies may be, for example, automatically acquired by a processor (e.g., processor 167*a* or 305 of FIG. 3) in response to the processor 167*a* executing a set of computer-readable instructions (e.g., a module 166*a* or 303). The processor 167*a* may, for example, cause a first chair assembly within a given row to at least partially reorient (or may energize a light source on a given chair/table assembly) and a user may manually correlate the first chair/table assembly with a physical location within a respective venue (e.g., a given row/seat location, a three-dimensional spatial location, a two-dimensional location, etc.) based on visually detecting the chair/table assembly reorientation and/or light source. Subsequently, the processor 167*a* may cause each processor 305 within the row to send a signal via a first communication channel (e.g., communication channel 346 of FIG. 3) to a second communication channel of an adjacent processor 305, and so on down the row of processors, until the processor 305 of the chair assembly/table assembly that was manually identified by the user receives the communication. The processors 305 may then automatically assign location data to each processor 305 based upon the location data that was manually assigned. Additionally, or alternatively, a chair/table device 301 may include a position sensor, and the processor 305 may automatically correlate a physical location of a respective chair/table assembly within a venue based on position sensor data acquired by the processor 305 from the position sensor.

Alternatively, or additionally, the processor 167*a* may receive image data from, for example, an imaging device 172*a* (e.g., a digital camera, a stereoscopic imaging device, a 3D sonar sensor, a 3D laser scanner, a Lidar sensor, etc.) positioned within the associated venue such that when the processor 167*a* causes a given chair assembly/table assembly to at least partially reorient, the processor 167*a* may automatically determine respective chair assembly/table assembly location data based on the image data. Alternatively, or additionally, the processor 167*a* may energize a light source on a given chair/table assembly and may correlate a chair/table physical location within an image based upon detection of the light source within the image data.

Alternatively, a physical location may be manually assigned to a plurality of chairs in a venue. For example, physical location data may be entered into each chair assembly/table assembly device 301. Even though physical location data may be initially manually entered into, for example, a chair assembly/table assembly device 301, when an associated chair assembly/table assembly device 301 is replaced, the replacement chair assembly/table assembly device 301 may automatically receive physical location data as, for example, described above.

As another alternative, a plurality of chair assemblies/table assemblies may include a respective identifying tag (e.g., a bar code label, a QR code label, a magnetic identification label, a radio frequency identification tag, etc.). A user may scan the identifying tag via, for example, a personal electronic device (e.g., a smart telephone, a laptop computer, a dedicated tag reader, etc.) having a user interface that includes a venue map displayed on an associated display. When the user scans a particular identifying tag, the user may correlate a given chair assembly/table assembly by, for example, selecting the chair assembly/table assembly via the user interface/venue map display. Alternatively, or additionally, any given chair assembly/table assembly, or a group of chair assemblies/tables assemblies, may include a respective geo-positioning device (e.g., a global positioning device, a venue geo-spatial system, etc.) which may, for example, automatically provide physical location data for a respective chair and/or a group of chairs.

The system 100*a* of FIG. 1A may be configured as a dine-in theater call button and operations management system. A dine-in call button system may include both hardware and software components that may provide tools and information to enhance employee performance and increasing profitability. A server 106*a* may continuously monitoring call buttons and seat sensors, providing data to monitor and manage, for example, a venue. Regardless of a form factor of a call button (e.g. a switch, a three-way switch, a touch screen, a LED illuminated switch, a toggle-switch, etc.), activation of a call button may provide numerous levels of functionality such as "I need service", "I need a refill", "I need a fork", etc.

The server 106*a* may also ties directly into a ticketing and food ordering system to provide up to date information to service staff. A display 113*a*, 120*a* may provide a real time monitoring system that may be, for example, displayed in a food service prep area, kitchen, and/or may be accessed anywhere using, for example, a web-browser. A system may include, for example, LED illuminated call buttons, mounted directly to venue chair assemblies/table assemblies, and may be, for example, hard wired (or wirelessly connected) to the system 100*a*. The system 100*a* may include, for example, occupancy sensors (e.g., pressure activated seat sensors) that may alert when a respective seat is occupied. A system 100*a* may integrate with a ticket point of sale, food/beverage point of sale, payroll management systems and others to bring data together in one convenient location to allow any and all venue employees to make decisions, act quickly and appropriately and provide the best possible service to guests while minimizing effort and cost.

Figure 3:
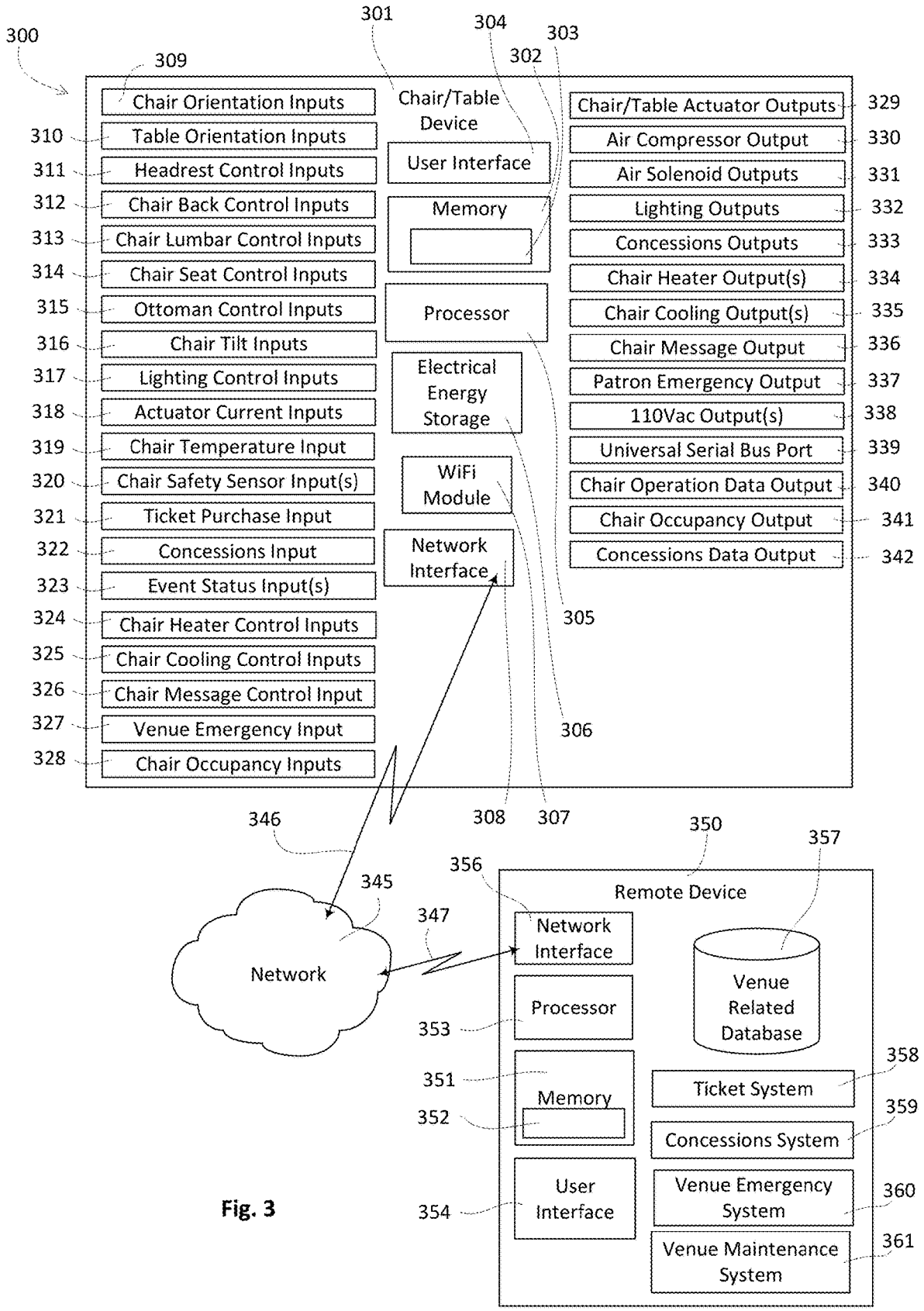
FIG. 3 depicts a block diagram of a control and management system for use with powered chairs and/or powered tables.

A dine-in theater call button and operations management system may provide additional value to customers and guests through an integration with chair assembly/table assembly control systems (e.g., controller 301 of FIG. 3). Dashboards and screens may be utilized throughout a venue utilizing existing data available through the system 100*a* to enhance smart seat data even further. A system 100*a* may include software that may gather information from, for example, a seating manufacturer's smart seat system 301*a* and may make associated chair assembly/table assembly data available in combination with other venue data to help reduce cost, create a better experience within a venue, extend life of chair assemblies/table assemblies and create new revenue streams. A system 100*a* may include a seat sensor feature that allows the system 100*a* to recognize when a seat is occupied. The seat occupancy information may be used in numerous ways to help with operations, service, security and statistical analysis. Smart seats may include a seat sensor, for example, built into a seat at a factory, to reduce the cost and improve accuracy. The system 100*a* may include a call button feature that may, for example, allows the system 100*a* to detect when a customer requires service at their seat. Call buttons may be as simple as a switch or as sophisticated as a small touch screen. Regardless of the call button switch form factor, call buttons may provide numerous levels of functionality such as "I need service", "I need a refill", "I need a fork", etc. Smart seats may include call buttons, built into, for example, a chair assembly/table assembly at a factory. The system 100*a* may be able to take a status from smart seats and may process the information and share the information through the system 100*a* dashboard screens throughout the venue, emails, text message, etc. A status of a smart seat may include, for example, information such as whether an ottoman is open or closed, whether a seat has power and is online, whether a seat is occupied or not, whether a call button is activated or not, and/or whether a seat is in good operating condition. All of these pieces of data may provide value when processed by the system 100*a*, and shared and recorded appropriately.

The system 100*a* may be able to send an "all close" or "all open" command to a single chair, an entire row of chairs, an entire room of chairs, or an entire building full of chairs to, for example, assist in emergency evacuation situations. Alternatively, or additionally, the system 100*a* may integrate with appropriate systems to know which seats have been occupied for a giving event as during a given day and can therefor send an "open" command to a smart seat when the event has completed and the chair was, but is no longer, occupied to, for example, signal to cleaning personnel that the seat should be inspected and thoroughly cleaned. Similar logic may apply at an end of a day when several separate events have been hosted such that, for example, a deep cleaning crew knows which rows to focus their valuable and expensive time on in order to be most efficient. The system 100*a* may be able to accept information from smart seats to, for example, help identify seat motor (actuator) issues before the issues are critical, or cause permanent failure or damage. For example, motors may report voltage, usage statistics, resistance or other electrical characteristics to the system 100*a* such that, for example, the system 100*a* may process the data to determine an overall health of a chair assembly/table assembly, and may inform an appropriate entity to have the situation addressed. This data can be used to dispatch service requests to seat manufacturers and maintenance companies that offer fee-based service plans or warranty coverage without having to rely on theater personnel to be involved in the process. The system 100*a* may process seat statistical data, as well as, record maintenance history and usage patterns to, for example, allow preventative maintenance and rotation of appropriate seat parts to extend the life of the seats. Data may be, for example, utilized by seat manufacturers and maintenance companies to offer fee-based maintenance plans to theaters.

A system 100*a* may be integrated with third party systems via, for example, an application programming interface (API). For example, the system 100*a* may provide reliable communication with, for example, seven-hundred chair assemblies/table assemblies such that, for example, features may be communicated over reliable communication. For example, an API may be used over any number of network protocols and the system 100*a* may be flexible and may support any number of possible protocol standards and networking architectures. For example, a system 100*a* may provide a chair assembly/table assembly manufacturer a TCP/IP networking protocol where XML based data may be passed back and forth between the system and the smart seat system 100*a* hardware provided by the chair assembly/table assembly manufacturer.

The system 100*a* may provide a regular status or heartbeat of, for example, a smart seat to such that, for example, the system 100*a* may keep track and report overall status of each chair assembly/table assembly in a venue. This function may be sent from, for example, a smart chair assembly/table assembly control 301 to the system 100*a* on a pre-determined periodic basis, such as, once per minute. This function may include status of many chair assemblies/table assemblies in one call, such as for example, an entire row or an entire room. The function may include a simple status such as "alive" and if the message is not received in a given timeframe it can be assumed that the chair assembly/table assembly, or group of chair assemblies/table assemblies, is not "alive," and needs attention. Additional functionality can be added to this function such as: whether an occupancy sensor is on or off; whether a call button is on or off; whether a recliner chair is open or closed; what a last operating voltage was of an actuator motor. As data is received by the system 100*a*, the data may be processed, recorded for reporting purposes, and notifications may be sent as necessary. The system 100*a* may respond with an acknowledgement that a ping was received if a smart chair/table assembly controller 301 may receive and process the ping. An occupancy sensor may provide a notification to the system 100*a* that the occupancy sensor has been activated or deactivated. This function may be sensitive to the fact that an occupancy sensor can activate and deactivate for multiple reasons and may consider only sending the notification, for example, once per every 30 seconds in the case the sensor is being turned on/off because of movement in the seat by the person, the weight of the person, etc. As data is received by the system 100*a*, the data may be processed appropriately, recorded for reporting purposes and notifications sent as necessary. For example, a system 100*a*, may respond with an acknowledgement that an occupancy sensor information was received if the smart chair/table control 301 may receive and process it. A system 100*a* may provide a notification that a call button, or other service indicator, such as a three-way switch, has been activated, deactivated or changed position. As the data is received by the system 100*a*, the data may be processed appropriately, recorded for reporting purposes, and notifications may be sent as necessary. The system 100*a* may respond with an acknowledgement that call button information was received when, for example, a smart chair/table control 300 receives and process a request.

The system 100*a* may request, for example, that a smart chair controller 300 open or close recliners. For example, this function may include a request for many chairs in one call, such as an entire row or an entire room. A smart seat control 300 may respond with an acknowledgement that the open/close request information was received and processed. When a ping and status update does not include a recliner open/close status, the smart seat control 300 may include: a notification to the system 100*a* that an associated recliner was opened or closed. The system 100*a* may respond with an acknowledgement that the open/close information was received when, for example, the smart chair/table control 300 receives and process the request. As data is sent/received by the system 100*a*, the data may be processed appropriately, recorded for reporting purposes, and notifications may be sent as necessary. For example, the system may provide the ability to request that a smart chair/table control 300 respond with every possible attribute about status including, but not limited to: motor health (voltage, amps, cycles, etc.); recliner open/close status; call button on/off status; occupancy sensor on/off status, etc. As the data is received by the system 100*a*, the data may be processed appropriately, recorded for reporting purposes, and notifications may be sent as necessary.

As shown in for example, FIGS. 1A and 3, the system 100*a*, 300, may include monitors, handhelds, cell phones, etc. Requests for data may be communicated, for example, over an HTTP using, for example, a preinstalled application, or a standard browser. A system 100*a* may include a Zigbee-based protocol coordinator to an antenna for call of the Zigbee network communication. The system 100*a* may assist venue managers in many different aspects of associated business and operations in real time, as well as, may provide historical reporting across multiple systems of data records that may, for example, help venue operators make decisions, proactively address issues, and/or improve end customer experience.

Figure 2:
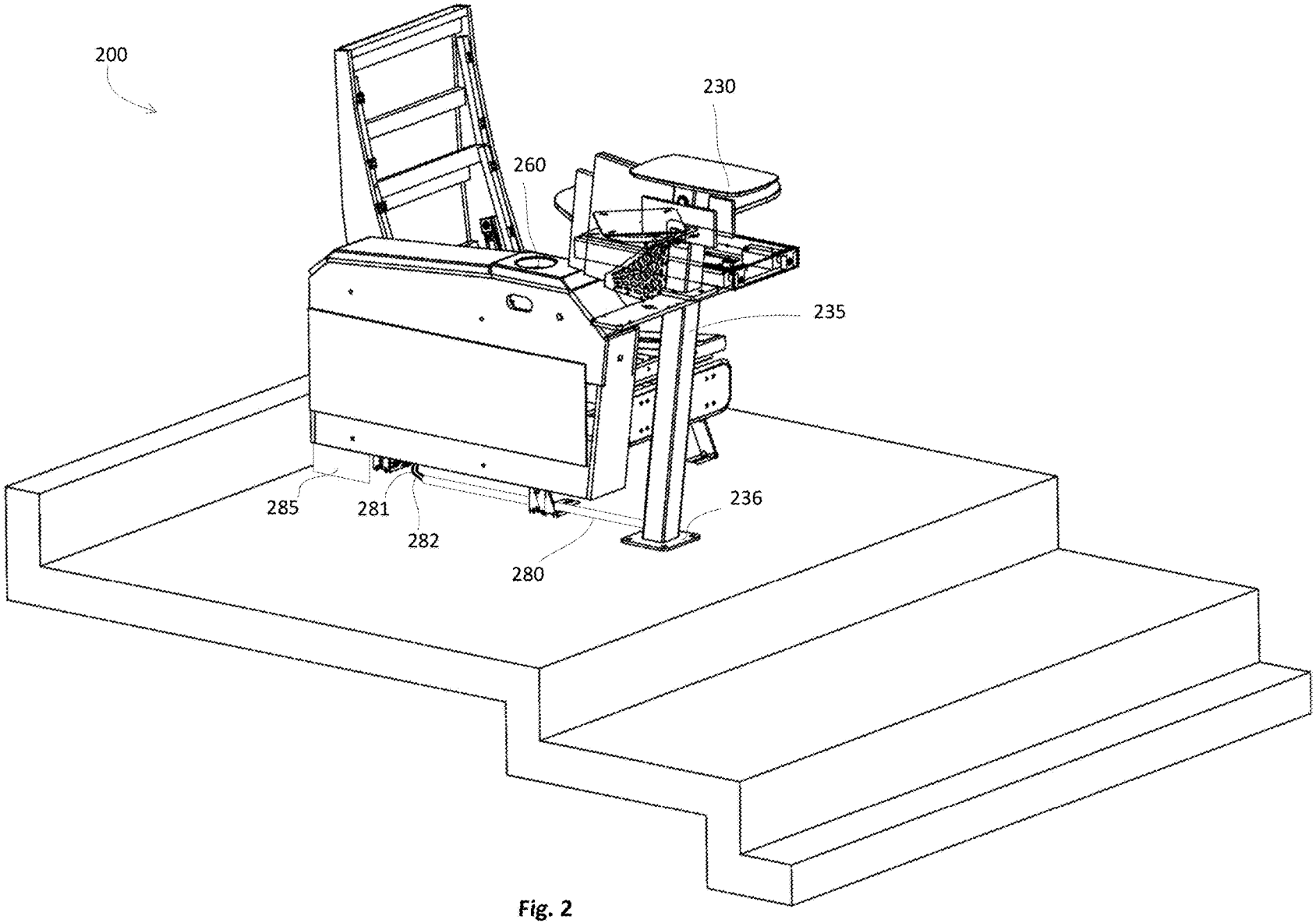
FIG. 2 depicts a perspective view of an example powered chair and an example powered table assembly

Turning to FIG. 2, a chair and table assembly 200 may include a chair assembly 245 (e.g., a power recliner chair, a rocker style chair, a fixed position chair, a chair on casters, a beam mount chair, etc.) proximate a table assembly. The chair and table assembly 200 may be similar to, for example, a chair assembly 145*c*, 147*c*, 148*c* of FIG. 1C and table assembly 146*c* of FIG. 1C, 600*a-e* of FIGS. 6A-E. The table assembly may include an upper support surface 230, a support structure 235, and a mounting foot 236 configured, for example, as any one of the table assemblies 146*c* of FIG. 1C, 600*a-e* of FIGS. 6A-E.

In any event, the chair and table assembly 200 may include a conduit 280 that may, for example, extend from the support structure 235 to a location under the chair assembly 245. The conduit 280 may be above a venue floor or at least partially under a surface of the venue floor. The conduit 280 may include electric power conductors 281 and/or electric control conductors 282 configured to, for example, facilitate electrical connections to associated 110 Vac outlets, concessions buttons, reading lights, table actuators, inputs 309-328 of FIG. 3, and/or outputs 329-342 of FIG. 3, etc.

The chair and table assembly 200 may include an air compressor 285 configured to, for example, provide compressed air to an inflatable chair headrest, an inflatable lower lumbar support, an inflatable seat cushion, a pneumatic actuator, etc. While the air compressor 285 is shown in FIG. 2 to be proximate the chair assembly 245, the air compressor 285 may be located remote from the chair assembly 245 and may include hoses that extend from the air compressor 285 to the chair assembly 245.

As an alternative, or addition, to the assembly 200 of FIG. 2, a table assembly may be mounted behind a respective chair assembly. Thereby, an occupant in a chair assembly behind the chair assembly with the table assembly mounted behind, may use the table assembly.

With reference to FIG. 3, a computer system 300 may include a chair/table device 301 communicatively coupled to a remote device 350 via, for example, a communication network 345. The computer system 300 may be similar to portions of the computer system 100*a* of FIG. 1A (e.g., a chair/table device 301 may be similar to, for example, computing device 161*a* and/or a remote device 350 may be similar to, for example, server 106*a*). In any event, the chair/table device 301 may include a computer-readable memory 302 having computer-readable instructions 303 stored thereon. A chair/table device 301 may be incorporated within any one of the chair assemblies and/or table assemblies as described herein and/or as described in the commonly assigned patents and patent applications incorporated herein by reference. The computer-readable instructions 303, when executed by a processor 305, may cause the processor to receive any one of, any combination of, or all of the inputs 309-328 and generate any one of, any combination of, or all of the outputs 329-342. Additionally, the processor 305 may further execute the computer-readable instructions 303 to communicate any one of, a combination of, or all of the inputs 309-328 and generate any one of, any combination of, or all of the outputs 329-342 to the remote device 350.

The chair/table device 301 may include a user interface 304, an electrical energy storage device 306 (e.g., a battery, a capacitor, etc.), a WiFi module 307, a network interface 308, chair orientation inputs 309 (e.g., a chair upright orientation pushbutton, a chair recline orientation pushbutton, etc.), table orientation inputs 310 (e.g., a table in-use orientation pushbutton, a table egress orientation pushbutton, etc.), chair headrest control inputs 311, chair back control inputs 312, chair lumbar control inputs 313, chair seat control inputs 314, ottoman control inputs 315, chair assembly tilt inputs 316, lighting control inputs 317, actuator current inputs 318, a chair temperature input 319, chair safety sensor inputs 320, a ticket purchase input 321, a concessions input 322, event status inputs 323 (e.g., QSC movie system inputs), chair heater control inputs 324, chair cooling control inputs 325, chair message control inputs 326, venue emergency inputs 327, and chair occupancy inputs 328.

The chair/table device 301 may also include chair/table actuator outputs 329, an air compressor output 330, air solenoid outputs 331 (e.g., a chair headrest inflator solenoid output, a chair lower lumbar inflator solenoid output, a chair seat inflator solenoid output, etc.), lighting outputs 5332, concessions outputs 333, chair heater output(s) 334, chair cooling outputs(s) 335, a chair message output 336, a patron emergency output 337, 110 Vac outputs 338, a universal serial bus (USB) port 339, a chair operation data output 340, a chair occupancy output 341, and a concessions data output 342.

The processor 305 may execute the computer-readable instructions 303 to cause the processor 305 to transmit any one of, a combination of, or all of the inputs 309-328 and/or any one of, any combination of, or all of the outputs 329-342 to the processor 353 of the remote device 350 via the network interface 308, the network connection 346, the network 345, the network connection 347, and the network interface 356. Alternatively, or additionally, the processor 353 may execute the computer readable-instructions 352 stored on the memory 351 to receive any one of, a combination of, or all of the inputs 309-328 and/or any one of, any combination of, or all of the outputs 329-342 from the processor 305.

The remote device 350 may also include a user interface 354, a venue related data base 357, a ticketing system 358, a concessions system 359, a venue emergency system 360, and a venue maintenance system 361. The processor 353 may execute the computer-readable instructions 352 to cause the processor 353 to implement any one of the ticket system 358, the concessions system 359, the venue emergency system 360 and/or the venue maintenance system 361 based on, for example, any one of, a combination of, or all of the inputs 309-328 and/or any one of, any combination of, or all of the outputs 329-342 received from the processor 305.

A first chair assembly 145*d* and/or first table assembly 146*d* in a row of chair assemblies and/or table assemblies may include a chair/table device 301 having a network interface 308 configured to communication to a broker device (e.g., network 345) via message queuing telemetry transport (MQTT) publish-subscribe-based messaging protocol. The broker device 345 may include a computing device (e.g., a raspberry pi computing device) connected to a wireless router. The broker device 345 may execute an Eclipse Musquitto MQTT protocol versions 5.0, 3.1.1 and 3.1. In any event, the chair/table device 301 may be configured to publish data related to any one of the inputs 309-328 on a predetermined periodic basis and/or any time a status of an input changes state. Similarly, the chair/table device 301 may be configured to subscribe to communications transmitted by the broker 345.

Additionally, or alternatively, a first chair/table device 301 may include a hardwired output communications port 308 configured to, for example, transmit data to a second chair/table device 301. The second chair/table device 301 may include a hardwired input communications port 308 configured to, for example, receive data from the first chair/table device 301. The second chair/table device 301 may include a hardwired output communications port 308 configured to, for example, transmit data to a third chair/table device 301. The first chair/table device 301 (e.g., device 508*a*) may be located in a first chair assembly/table assembly (e.g., chair assembly/table assembly 515*a* of FIG. 5*a*), the second chair/table device 301 (e.g., device 509*a*) may be located in a second chair assembly/table assembly (e.g., chair assembly/table assembly 516*a* of FIG. 5*a*), and the third chair/table device 301 (e.g., device 509*a*) may be located in a third chair assembly/table assembly (e.g., chair assembly/table assembly 517*a* of FIG. 5*a*). The individual chair/table devices 301 may, thereby, communicate chair/table location (e.g., row/chair number information) between device 301, as described above, and to the remote device 350. The remote device 350 may utilize the data to, for example, provide a real time display (e.g., venue 100*b-g*) with status data and/or icons proximate respective chair assemblies/table assemblies.

Turning to FIGS. 4A-H, J-N and P-T, a chair controller 400*a-h,j-n,p-t* may include a processor 405*a* with a programming port 406*a*, an H-bridge 420*a* connected to an actuator motor output 440*b*, a chair control switch input 435*c*, a low-power single operational amplifier 450*a*, a battery 460*b*, a light output 455*c*, an auxiliary communication connector 460*c*, a communication input connector 465*c*, a communication output connector 470*c*, a wireless interface module connector 475*c*, an emergency stop (e.g., safety switch) connector 480*c*, an auxiliary board connector 485*d*, a linear voltage regulator 490*f*, a buck regulator 495*g*, and an auxiliary board power connector 486*l*. The chair controller 400*a-h,j-n,p-t*, or any portion(s) thereof, may be, for example, incorporated into a user control 270*a-c*, a controller 490*a,b*, 590*a,b*, 790*a,b*, a power supply 796*a,b*, a wireless data receiver 485*b*, a user interface 169*a*, a display 162*a*, or an actuator 511*a*. Thereby, the chair controller 400*a-h,j-n,p-t* may, or appropriate portion(s) thereof, may perform any associated function as described herein.

Figure 4A:
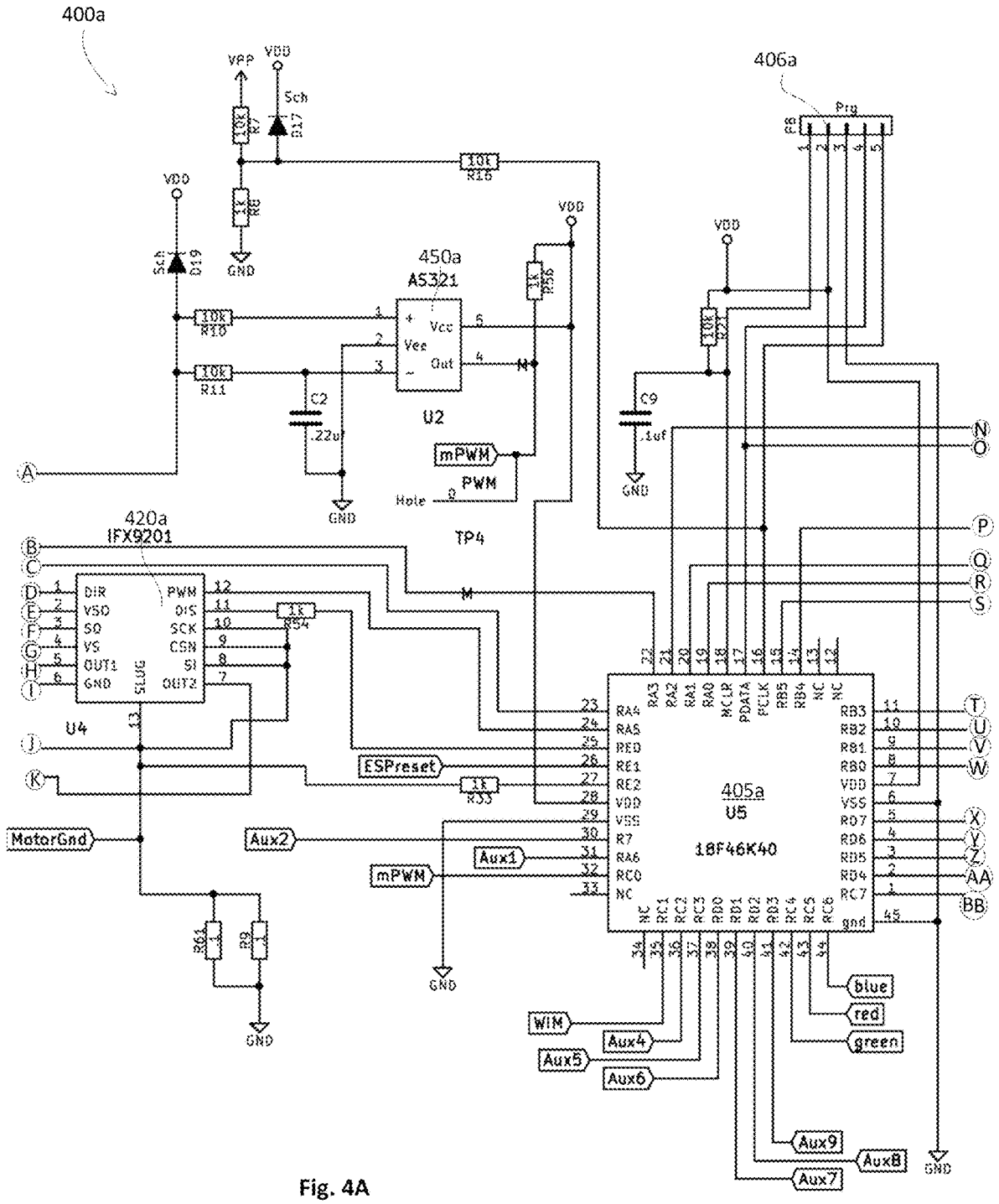
FIGS. 4A-H, 4J-N and 4P-T depict example electrical control circuits for use within powered chairs.
Figure 4B:
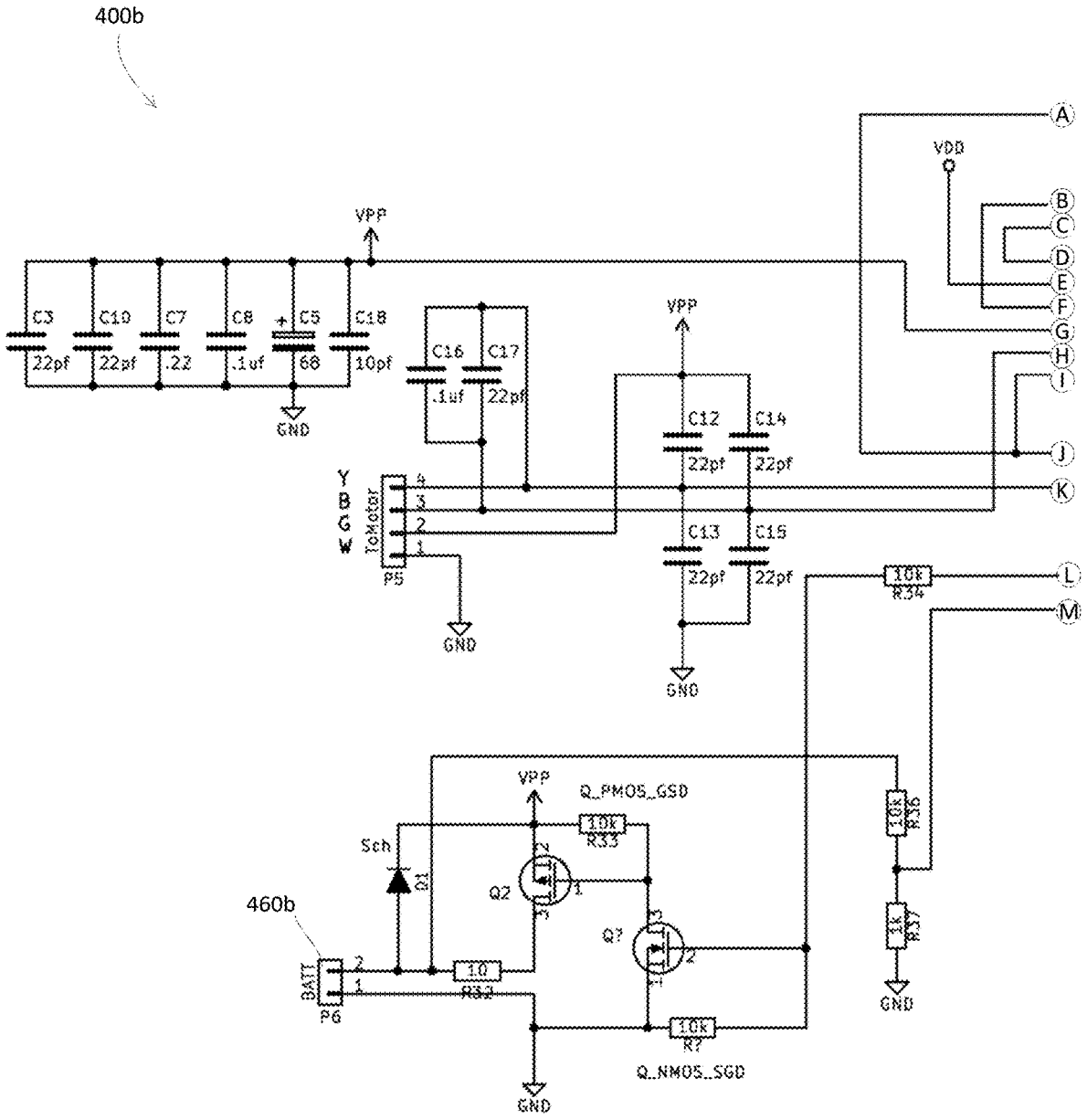
Figure 4C:
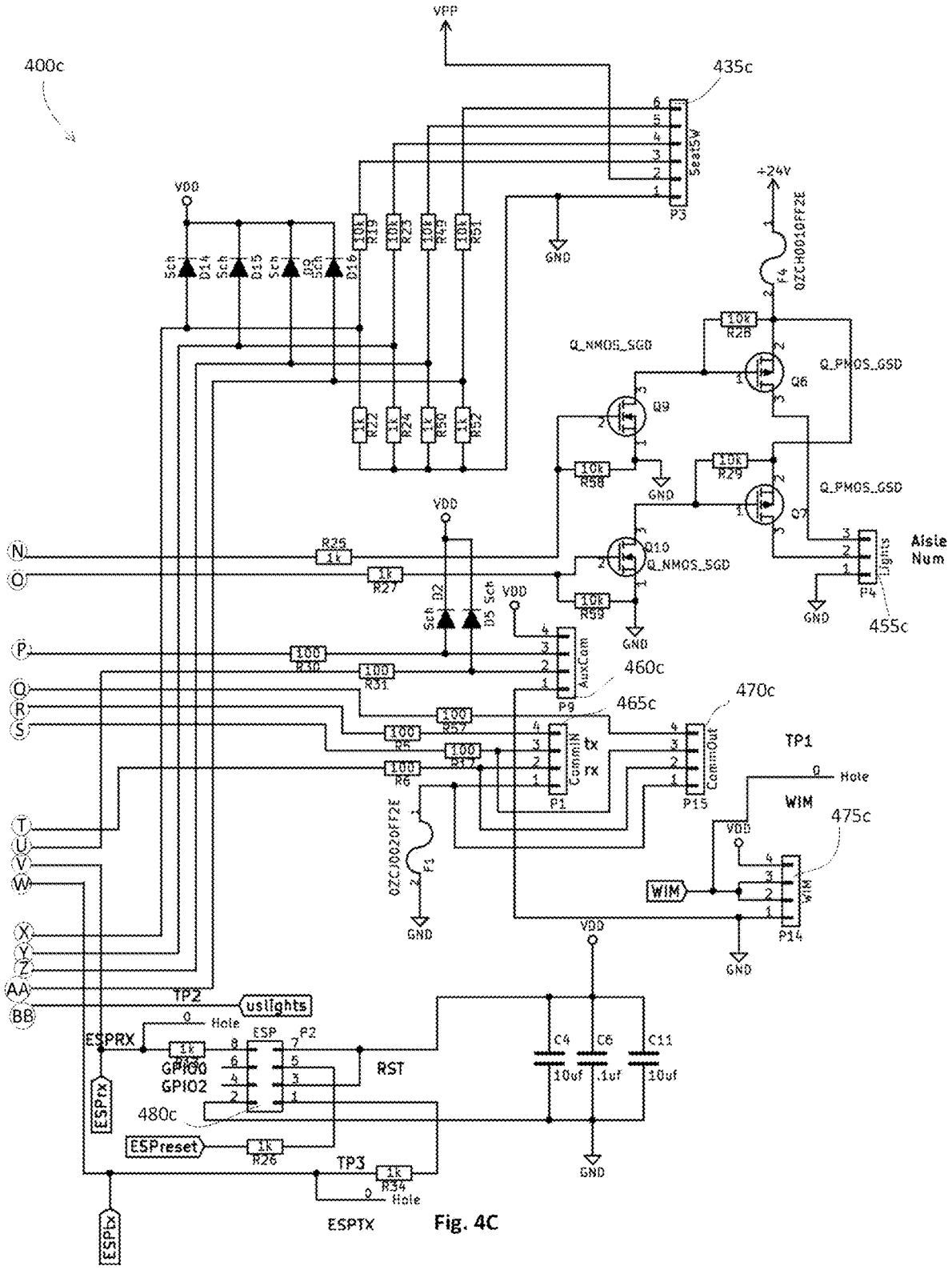
Figure 4D:
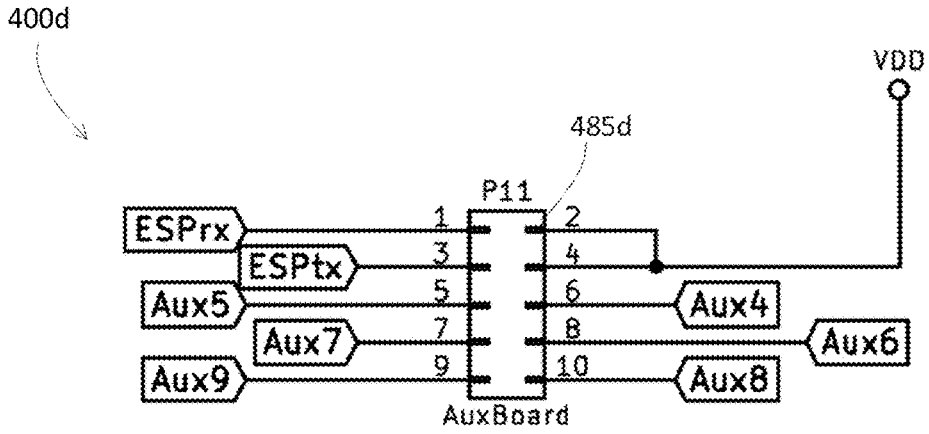
Figure 4E:
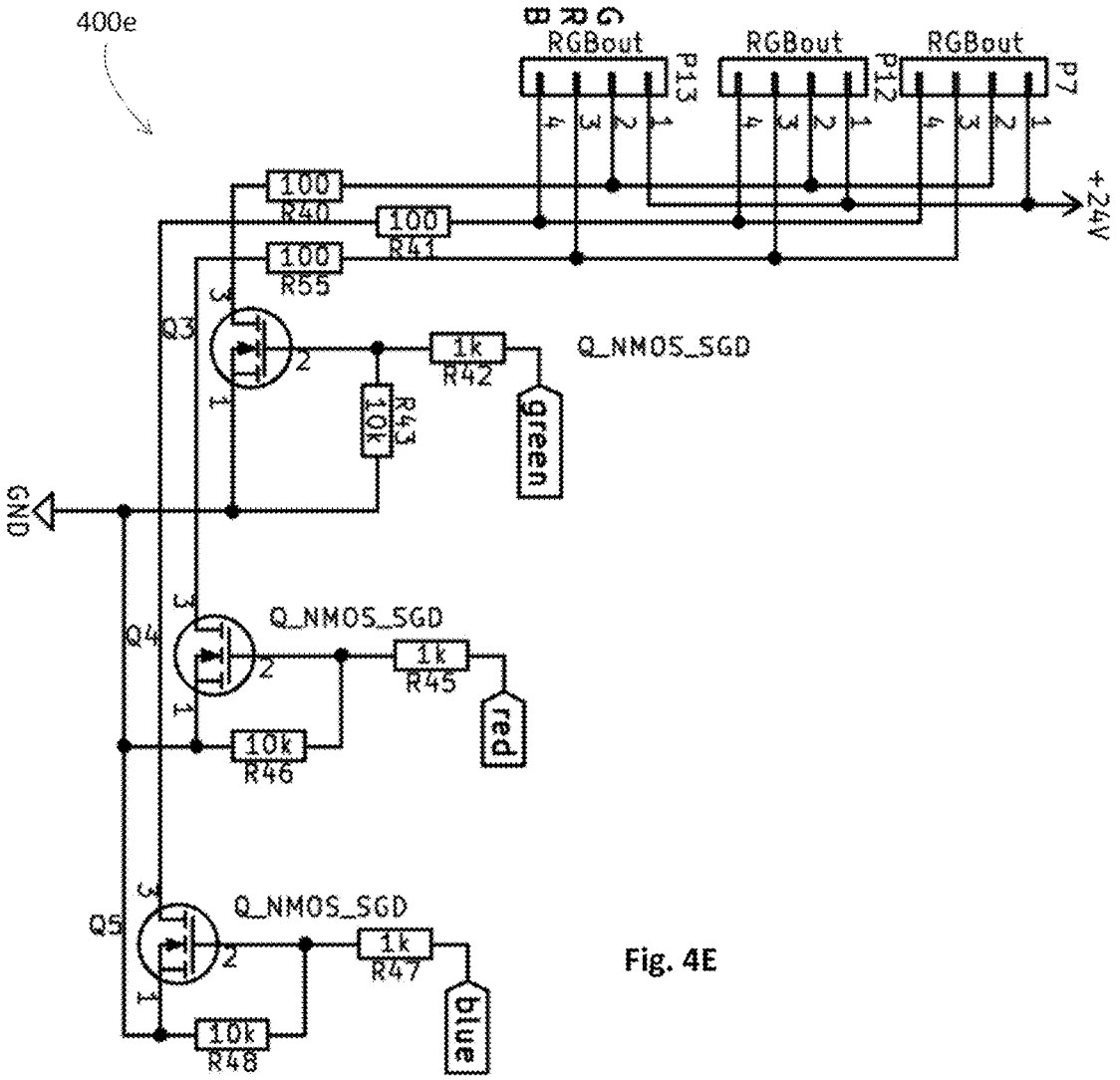
Figure 4F:
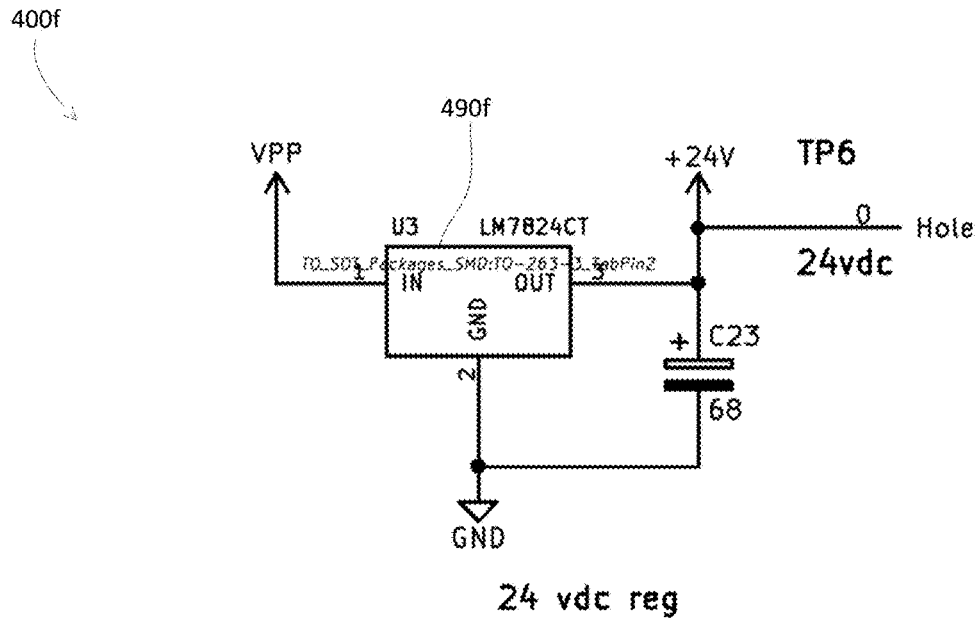
Figure 4G:
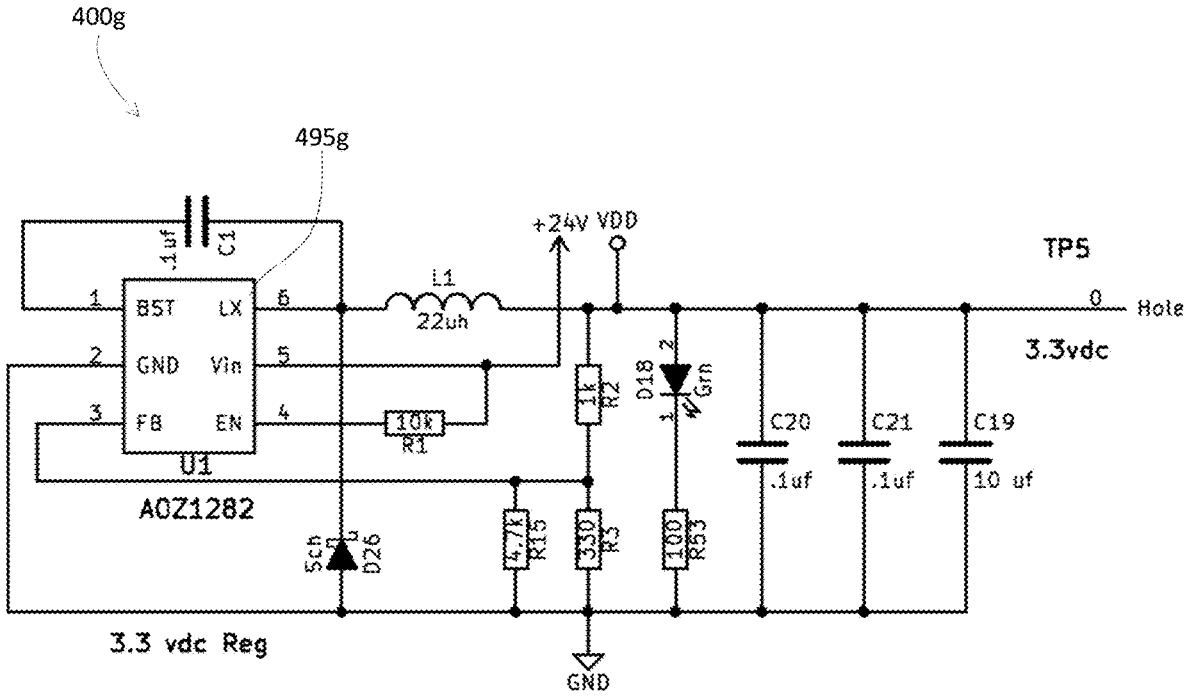
Figure 4H:
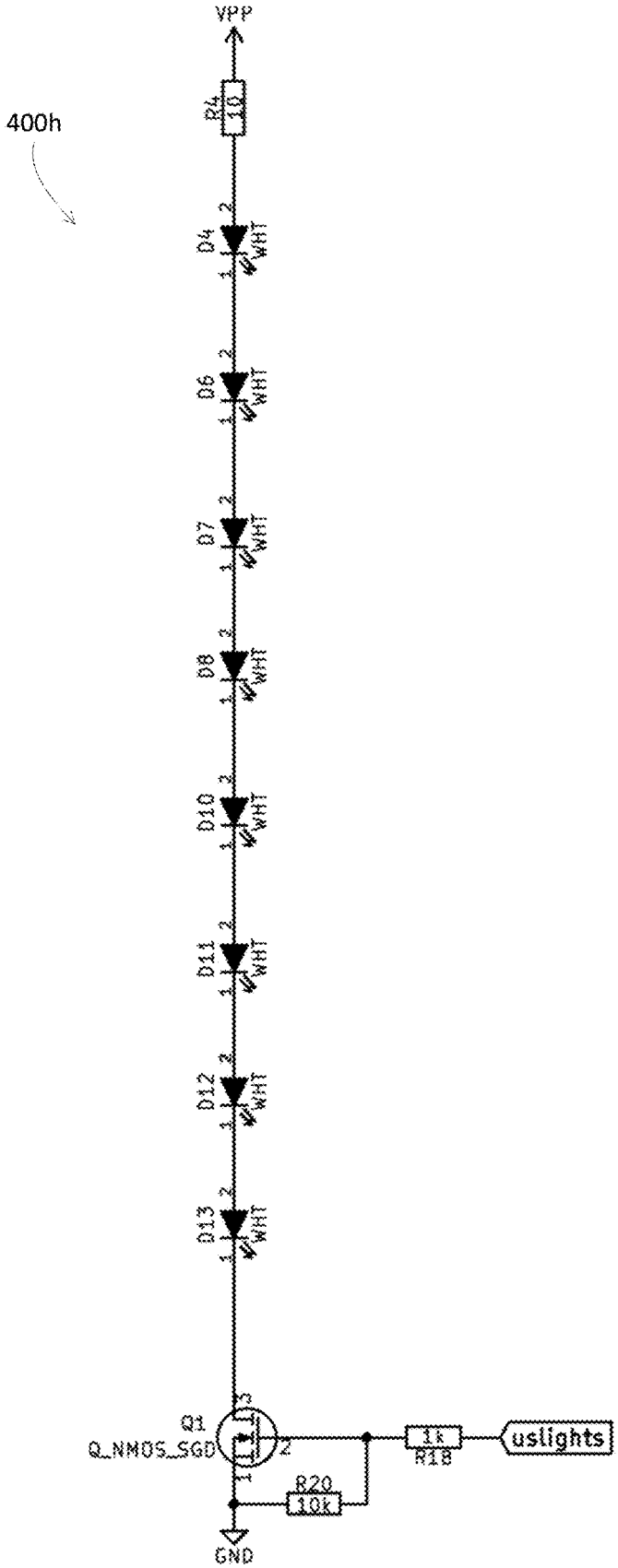
Figure 4J:
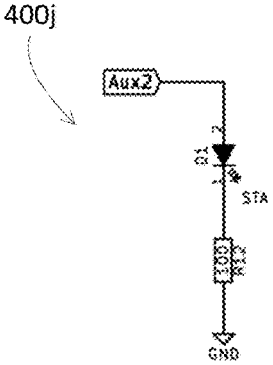
Figure 4K:
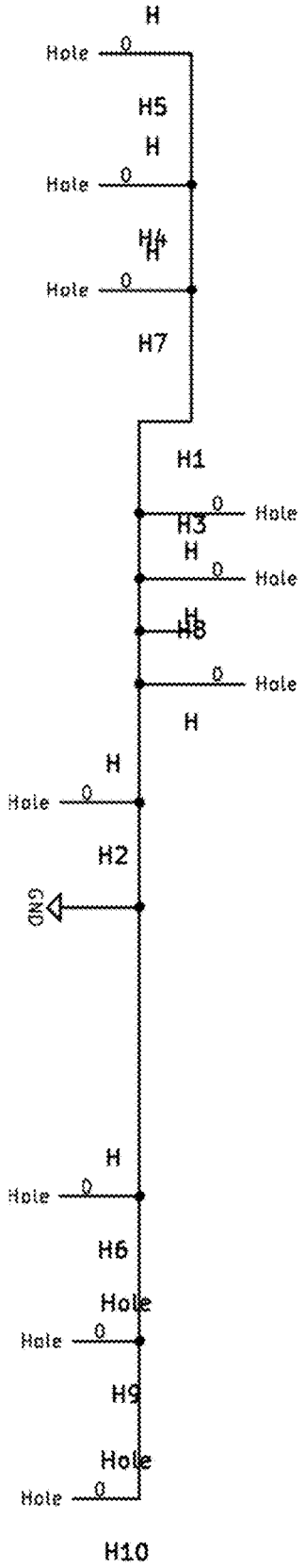
Figure 4N:
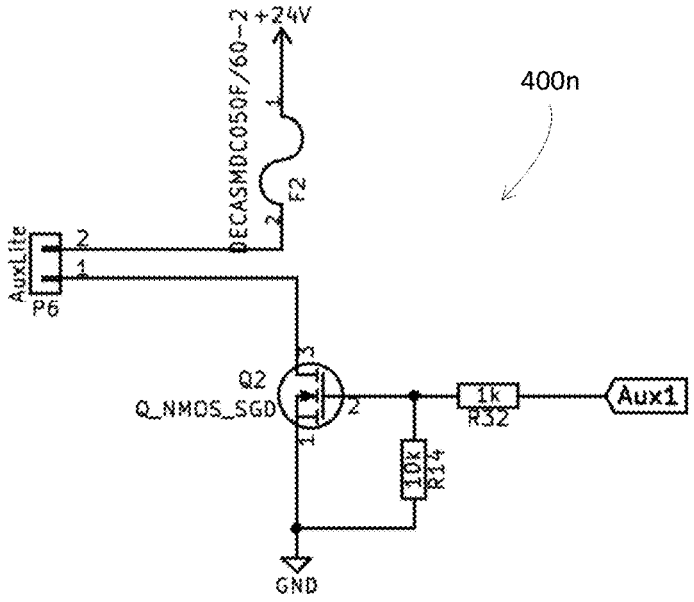
Figure 4L:
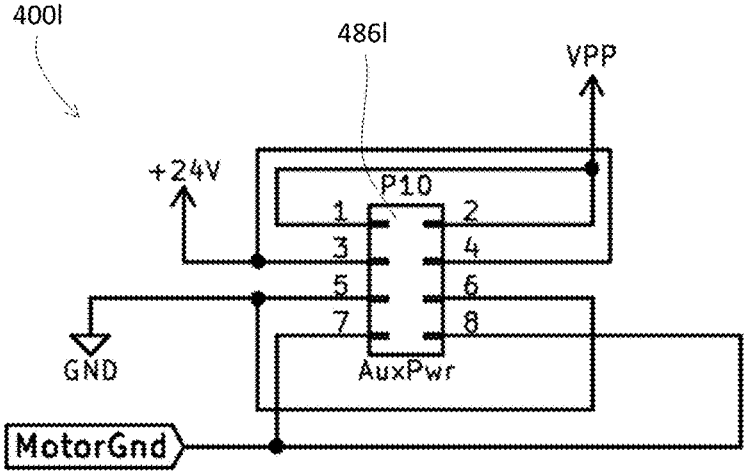
Figure 4M:
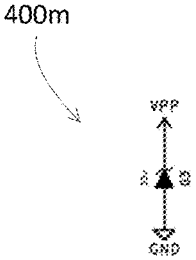
Figure 4P:
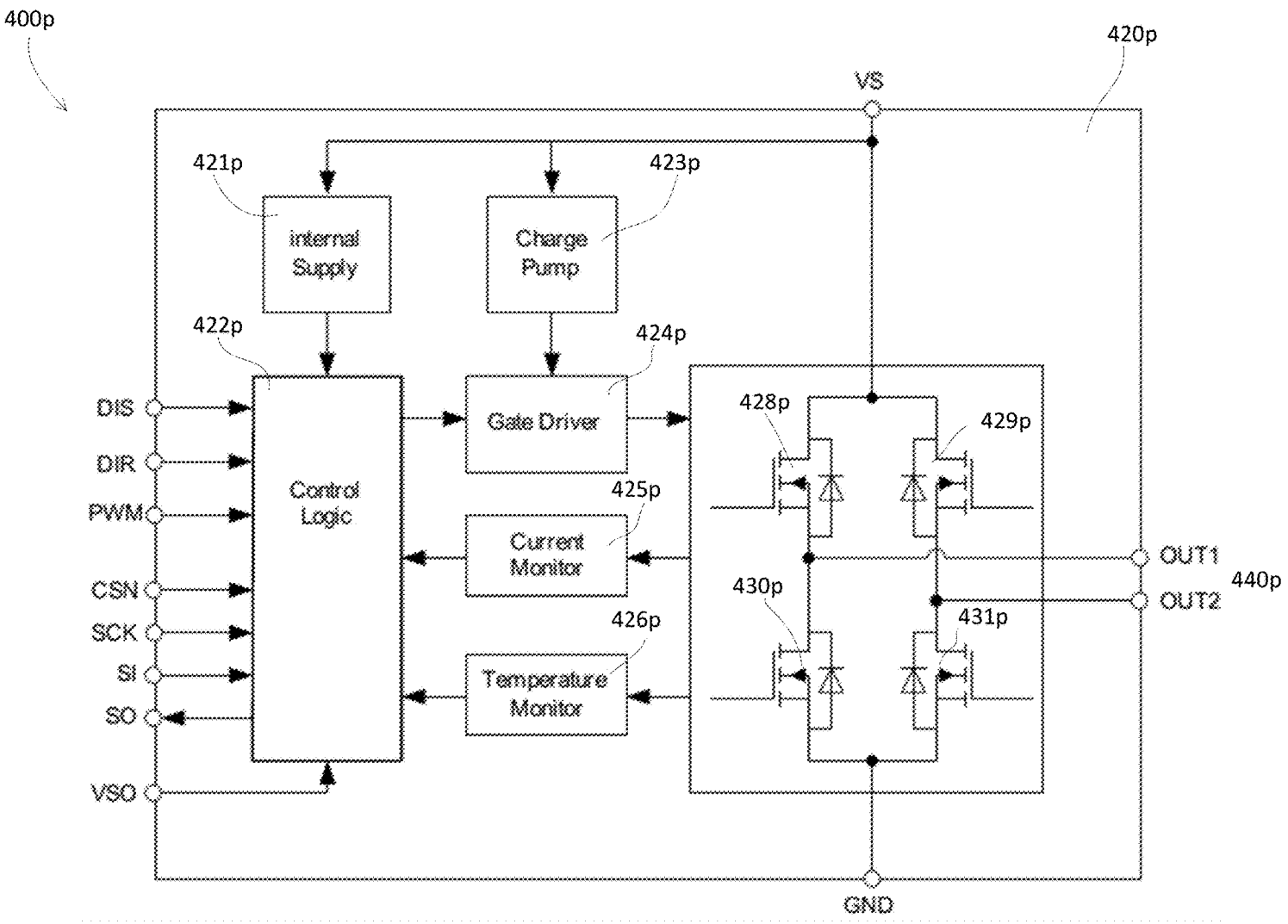

The letters A-M within circles shown on FIG. 4A denote connections to similarly labeled connections on FIG. 4B. The letters N-BB within circles shown on FIG. 4A denote connections to similarly labeled connections on FIG. 4C. The letters CC within a circle shown on FIG. 4A denotes a connection to a similarly labeled connection on FIG. 4D.

An auxiliary board (not shown in FIGS. 4A-H, J-N and P-T) may be added to facilitate additional actuator motor connections 440*b*, additional lighting connections 455*c*, additional user interface selectors 435*c*, etc. In any event, a chair controller 400*a-h,j-n,p-t* may be configured to control a single chair, a portion of a single chair, a group of chairs, or a portion of a group of chairs.

The processor 405*a* may be, for example, a part number PIC18F46K40 as available from Microchip Technology Incorporated, Chandler, Ariz., the entire content of the associated technical specifications is incorporated in its entirety herein by reference. While only one processor 405*a* is shown, any number and type of processor(s) may be incorporated. As shown with reference to FIGS. 4A and 4B, the processor 405*a* may monitor and/or control a battery via battery connection 460*b*. The processor 405*a* may turn on a thyrister (or transistor) Q2 to charge a battery. The processor 405*a* may turn on a thyrister (or transistor) Q? to power a chair from a battery when, for example, the processor 405*a* detects that electric power to an associated venue has been interrupted.

The H-bridge 420*a* may be, for example, a part number IFX9201 as available from Infineon Technologies A.G., Munich, Germany, the entire content of the associated technical specifications is incorporated in its entirety herein by reference. While only H-bridge 420*a* is shown, any number and type of H-bridge(s) may be incorporated depending on, for example, how may actuators are being controlled. Any given chair controller 400*p* may include an H-bridge 420*p* having an internal power supply 421*p*, control logic 422*p*, an electrical charge pump 423*p*, a thyrister (or transistor) gate driver 424*p*, a current monitor 425*p*, a temperature monitor 426*p*, a thyrister bridge 427*p* having four thyristers 428*p*-431*p*, and a motor output 440*p* (e.g., a chair actuator motor output). The H-bridge 420*p* may be similar to, for example, H-bridge 420*a*.

Figure 4Q:
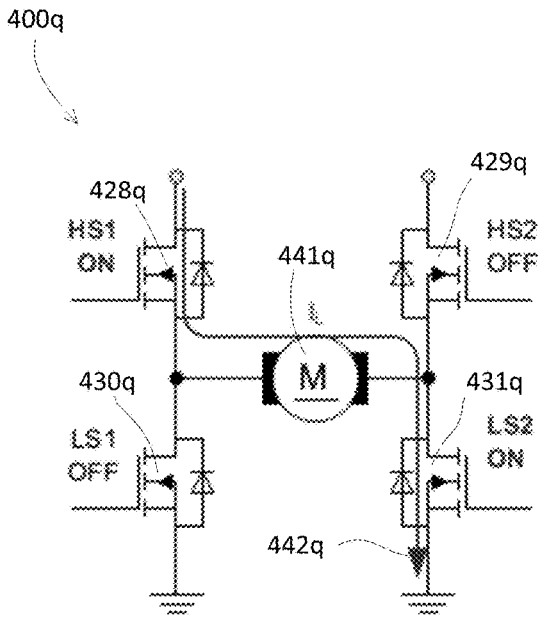
Figure 4R:
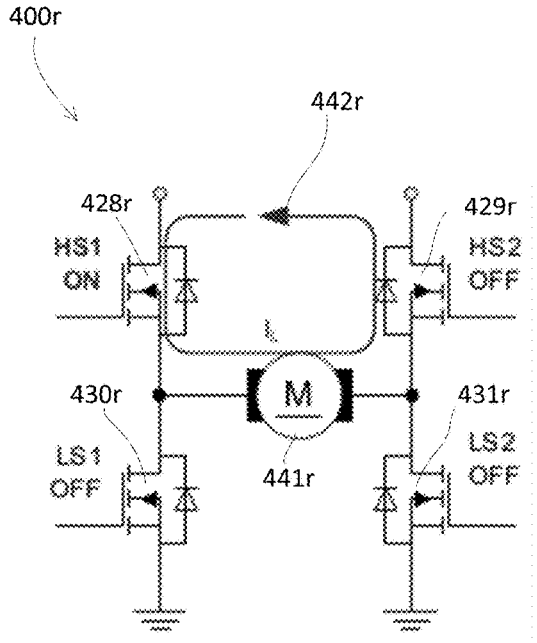
Figure 4S:
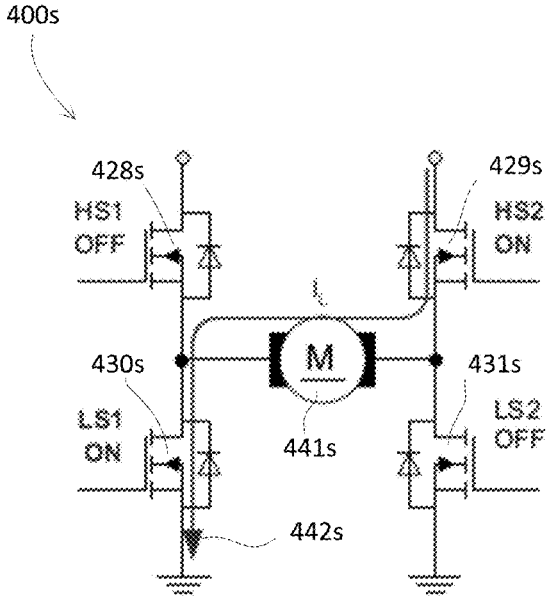

With reference to FIGS. 4Q-T, a chair controller 400*q-t* may include a H-bridge having a first thyrister 428*q-t*, a second thyrister 429*q-t*, a third thyrister 430*q-t*, a fourth thyrister 431*q-t*, interconnected with a motor 441*q-t*. As illustrated in FIG. 4Q, when the first thyrister 428*q* is gated on, the second thyrister 429*q* is off, the third thyrister 430*q* is off, and the fourth thyrister 431*q* is gated on, electrical current 442*q* flows through the first thyrister 428*q*, through the motor 441*q*, and through the fourth thyrister 431*q*, causing the motor 441*q* to rotate in a first direction. As illustrated in FIG. 4R, when the first thyrister 428*r* is gated on, the second thyrister 429*r* is off, the third thyrister 430*r* is off, and the fourth thyrister 431*r* is off, electrical current 442*r* circulates through the first thyrister 428*r*, through the motor 441*r*, and through a diode in parallel with the second thyrister 429*r*, to dissipate electrical energy. As illustrated in FIG. 4S, when the first thyrister 428*s* is off, the second thyrister 429*s* is gated on, the third thyrister 430*s* is gated on, and the fourth thyrister 431*s* is off, electrical current 442*s* flows through the second thyrister 429*s*, through the motor

Figure 4T:
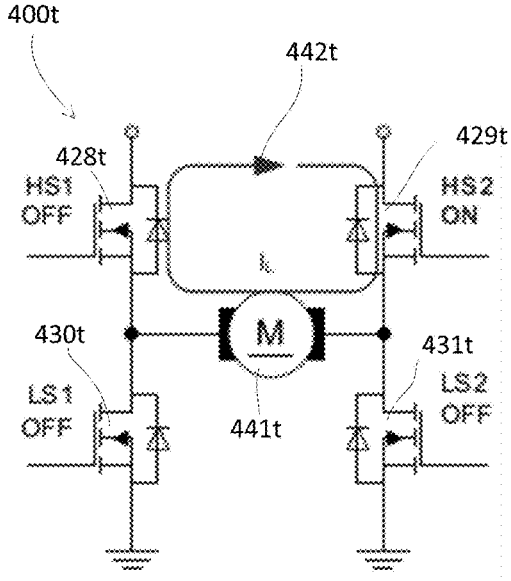

441*s*, and through the third thyrister 430*s*, causing the motor 441*s* to rotate in a second direction opposite the first direction. As illustrated in FIG. 4T, when the first thyrister 428*t* is off, the second thyrister 429*t* is gated on, the third thyrister 430*t* is off, and the fourth thyrister 431*t* is off, electrical current 442*t* circulates through the second thyrister 429*t*, through the motor 441*t*, and through a diode in parallel with the first thyrister 428*t*, to dissipate electrical energy.

The low-power single operational amplifier 450*a* may be, for example, a part number AS321 as available from Diodes Incorporated, Plano, Tex., the entire content of the associated technical specifications is incorporated in its entirety herein by reference. While only one low-power single operational amplifier 450*a* is shown, any number and type of low-power single operational amplifier(s) may be incorporated.

The linear voltage regulator 490*g* may be, for example, a part number LM7824CT as available from Fairchild Semiconductor Corporation, Sunnyvale, Calif., the entire content of the associated technical specifications is incorporated in its entirety herein by reference. While only one linear voltage regulator 490*g* is shown, any number and type of linear voltage regulator(s) may be incorporated.

The buck regulator 495*g* may be, for example, a part number AOZ1282D1 as available from Alpha & Omega Semiconductor, Sunnyvale, Calif., the entire content of the associated technical specifications is incorporated in its entirety herein by reference. While only one buck regulator 495*g* is shown, any number and type of buck regulator(s) may be incorporated.

As illustrate in FIGS. 4A, 4C, 4E and 4H, a chair controller 400*a,c,e,h* may include various light controls (e.g., isle lights, user lights, under-chair lights, user interface lights, etc.). As specifically shown in FIG. 4E, a chair controller 400*e* may include, for example, a red light (e.g., a red LED) output, a green light (e.g., a green LED) output, and a blue light (e.g., a blue LED) output. The chair controller 400*e* may be configured to independently control, for example, an intensity of each of the red, green and blue to produce any color of light (i.e., a mixture of RGB).

An electric powered chair assembly control system may include a controller having at least one chair actuator output and at least one chair light output. The system may also include a user interface connected to the controller. The user interface may include at least one chair actuator user control and at least one chair light user control. The system may further include an electric power supply having an electric power supply input and an electric power supply output. The electric power supply may be mounted within a first electric powered chair assembly. A first set of electric wiring may extend from the electric power supply output to a first electric actuator mounted within the first electric powered chair assembly. A second set of electric wiring may extend from the electric power supply output to a first electric chair light mounted within the first electric powered chair assembly. The controller may be configured to control the first electric actuator, via the at least one chair actuator output, based on the at least one chair actuator user control. The controller may be configured to control the electric chair light, via the at least one chair light output, based on the at least one chair light user control and further based on at least one of: a venue event, a predetermined time, or a motion sensor. The controller may be configure to de-energize the chair light when the first electric actuator is energized.

An electric powered chair assembly control system may include an electric power supply having an input and an output. The electric power supply may be mounted within a first electric powered chair assembly. An input voltage rating of the input may be different than an output voltage rating of the output. A first set of electric wiring may be plugged into the output of the electric power supply and may extend from the output of the electric power supply to a first receptacle having a first electric actuator mounted within the first electric powered chair assembly plugged into the first receptacle. A second set of electric wiring may extend from the output of the electric power supply to a second receptacle having a second electric actuator mounted within a second electric powered chair assembly plugged into the second receptacle. A third set of electric wiring may extend from the second electric powered chair assembly to the first electric powered chair assembly. The electric power supply may further include at least one of: an electric energy storage device output or a chair light output.

An electric powered chair assembly control system a controller having at least one chair actuator output and at least one chair heater output. The system may also include a user interface connected to the controller. The user interface may include at least one chair actuator user control and at least one chair heater user control. The controller may be configured to control the first electric actuator, via the at least one chair actuator output, based on the at least one chair actuator user control. The controller may be configured to control the electric chair heater, via the at least one chair heater output, based on the at least one chair heater user control. The controller may be configure to de-energize the first electric chair heater when the first electric actuator is energized.

An electric powered chair assembly control system may include a controller having at least one chair actuator output and at least one chair electrical energy storage device output. The system may also include a user interface connected to the controller. The user interface may include at least one chair actuator user control and at least one chair light user control. The controller may be configured to control the first electric actuator, via the at least one chair actuator output, based on the at least one chair actuator user control. The controller may be configured to control the at least one electrical energy storage device output based on a status of the at least one chair actuator output.

Figure 5A:
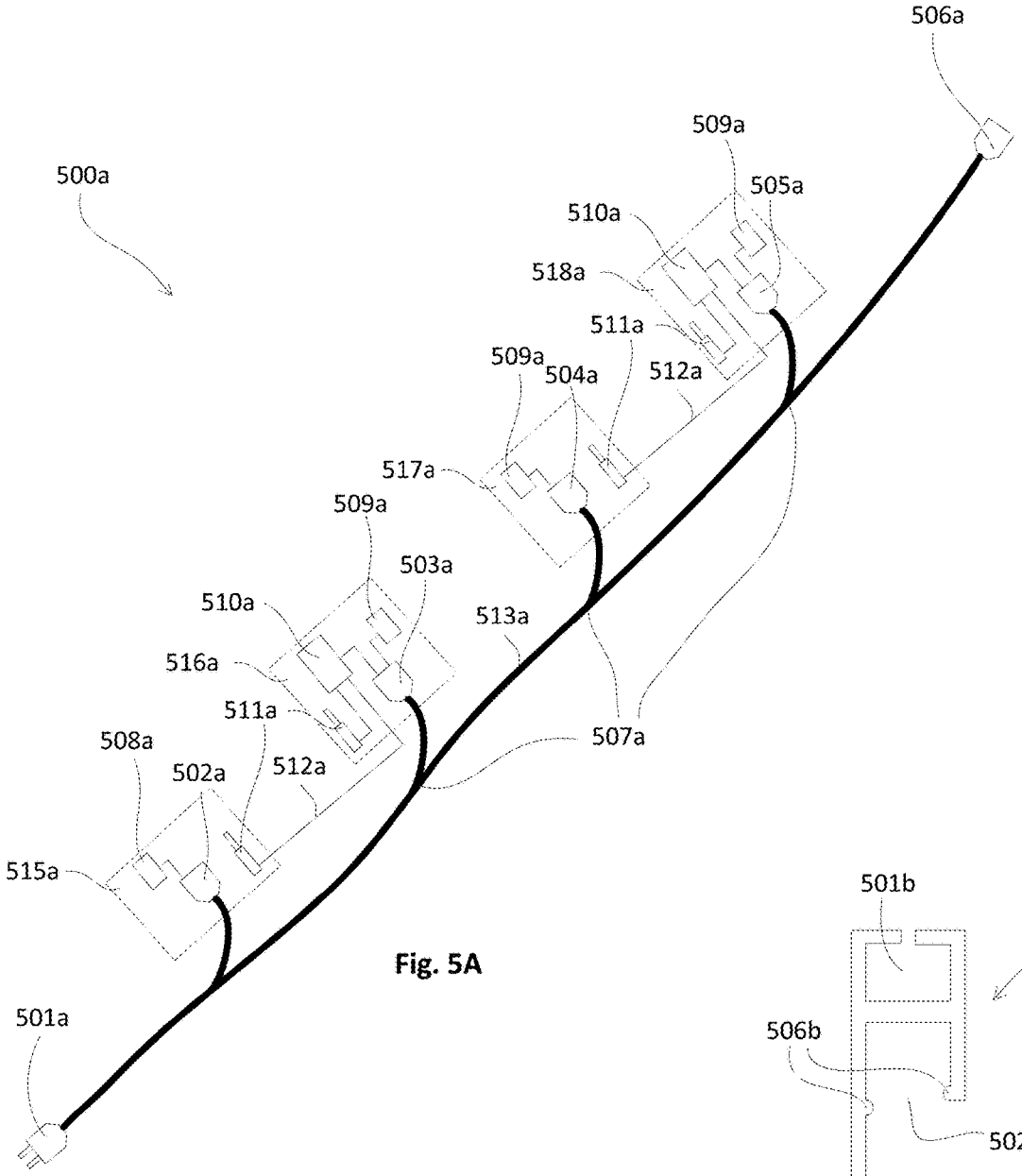
FIG. 5A depicts an example electrical interconnection cable for use with electrically interconnecting a plurality of powered chairs.
Figure 5B:
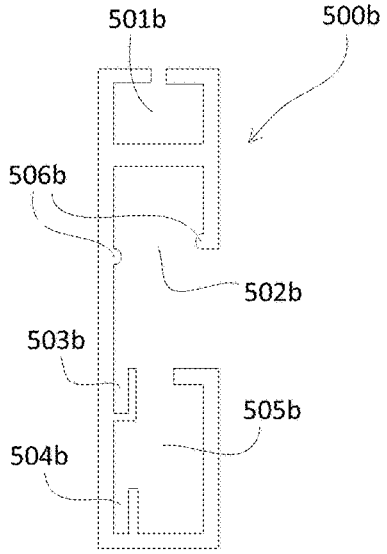
FIG. 5B depicts an example wire support.

With reference to FIG. 5A, an associated electrical supply cord 500*a* may be configured to provide daisy chained high voltage power, low voltage power, and/or control between recliner chairs to facilitate ease of installation. For example, a first chair may be plugged into the high voltage power 502*a* and then extended to proximate chairs 503*a*-506*a*. A chair may have multiple powered outlets, such as an extension cord or power strip that other chairs may be plugged into. This may allow a chair to feed power/control to other chairs, for example, in a row of chairs, thereby, eliminating multiple and expensive power/control outlets for each individual chair. An electrical power/control outlet 502*a*-506*a* may be incorporated into any given chair, for example, in a top of an arm box, on a front vertical surface of the chair or arm box, on an inside surface of an arm box adjacent to a local chair control switch, etc. An associated electrical power circuit may be routed down a row of chairs and/or tables (e.g., row of chair assemblies 145*a-f*/table assemblies 146*a-f* of FIGS. 1B-G) and may be T'ed 507*a* into chair/table power outlets/control/isle lights/heaters/etc.

A first electrical supply cord 500*a* may be configured, for example, such that a male plug 501*a* is connectable to an electric power outlet (e.g., 110 Vac, 120 Vac, 220 Vac, 240 Vac, etc.), a first female socket 502*a* may be located proximate a first chair 515*a* in a row of chairs, a second female socket 503*a* may be located proximate a second chair 516*a*, and so on with female sockets 504*a*-506*a* down the row of chairs 515*a*-518*a*. The first chair 515*a* may, for example, be next the second chair 516*a* in a row, or there may be a chair, or group of chairs, between the first chair 515*a* and second chair 516*a*. A second electrical supply cord 500*a* may be configured, for example, such that a male plug 501*a* is connectable to an outlet of a power supply 510*a* (e.g., 12 Vdc, 24 Vdc, 27 Vdc, 48 Vdc, etc.), and may have a first female socket 502*a* located proximate a first chair 515*a* in a row of chairs to provide electricity to a first actuator 511*a*, or first actuators 511*a* in the first chair 515*a*, a second female socket 503*a* may be located proximate a second chair, and so on with female sockets 504*a*-506*a* down the row of chairs to provide electricity from the power supply to an actuator 511*a*, or actuators 511*a*, in each chair 515*a*-518*a*. A third electrical supply cord 500*a* may be configured, for example, such that a plug 501*a* is connectable to a data outlet (e.g., an Ethernet outlet, a USB outlet, a RS-232 outlet, a RS-422 outlet, etc.), and may extend alongside the first and/or second electrical supply cord. The first, second, and/or third electrical supply cords may be combined into a single cable having multiple outlets (e.g., a 110 Vac outlet, a 24 Vdc outlet, and a data outlet) proximate at least some chairs in a row of chairs. As illustrated in FIG. 5A, a row of chairs 515*a*-518*a* may be configured with a power supply 510*a* in every-other chair assembly with a low-voltage connection extending to an actuator 511*a* of an adjacent chair. Alternatively, a row of chairs 515*a*-518*a* may include a power supply 510*a* that may be connected to actuators 511*a* of several chair assemblies/table assemblies (e.g., three chair assemblies/table assemblies, four chair assemblies/table assemblies, . . . ). A controller 508*a* may be included in a first chair 515*a* within a row and other chairs 516*l*-518*a* within the row may include a controller 509*a*. The controllers 508*a*, 509*a* may be similar to, for example, the chair/table device 301 of FIG. 3.

At least one wire rack 500*b* may be included within each chair assembly/table assembly 515*a*-518*a* to, for example, support the various electrical supply cords 500*a* extending between chairs 515*a*-518*a*. A wire rack 500*b* may include a chair/table clip 502*b* with retainers 506*b* configured to, for example, clip the wire rack 500*b* to a respective chair/table assembly. The wire rack 500*b* may further include a first wire way 501*b*, a second wire way 503*b*, a third wire way 504*b*, and a fourth wire way 505*b*. The first wire way 501*b*, the second wire way 503*b*, the third wire way 504*b*, and/or the fourth wire way 505*b* may be configured to support a respective electrical supply cord 500*a* and/or an air-line extending from, for example, an air compressor to a pneumatic actuator (e.g., an air actuated headrest, an air actuated lower lumbar support, etc.).

A mechanical mechanism may be provided in addition to, or in lieu of, the automatic mechanisms (e.g., controller/actuator) to reclining any given chair or a group of chairs via an interlocked mechanical mechanism. For example, a "C" clamp may be include that may be positioned over an arm of a chair and may activate a switch (extend or retract based on clamp position). Thus, a system for applying a force to activate the switch may be provided, such that a reactive force may be contained within the arm that contains the switch. Alternatively, a rod may be provided that may extend between chair arms to activate a switch (extend or retract based on rod position). Thus, a system may be provided for applying a force to activate the switch such that a reactive force is contained within the chair. Such a system may make it unnecessary for the operator to wait while each chair extends/retracts.

A less sophisticated mechanical system may be provided where a person walks down a row of chairs and applies a mechanical device to extend/retract each chair. The less sophisticated mechanical system may be a standalone system or may be integrated along with a powered extend/retract system.

Turning to FIGS. 6A-E, a tray assembly 600*a*-*e* (i.e., a movable surface assembly) may include a support structure having a mounting structure, wherein the mounting structure is configured to be fixed to at least one of: a venue floor, a venue riser, a venue surface, a venue structure, or a chair structure. The tray assembly 600*a*-*e* may also include a movable surface attachment fixed to the support structure, and a first movable surface linear slide mechanism having a first stationary portion 623*a*-*e* fixed to the movable surface attachment and a first linear slide portion 621*a*-*e* slidingly engaged with the first linear stationary portion 623*a*-*e*. The tray assembly 600*a*-*e* may further include a first movable surface rotation mechanism 617*a*-*e* having a first rotate stationary portion fixed to the first linear slide portion and a first rotation portion rotatably engaged with the first rotate stationary portion. The tray assembly 600*a*-*e* may yet further include a first movable surface 620*a*-*e* fixed to the first rotation portion. The tray assembly 600*a*-*e* may also include a second movable surface linear slide mechanism having a second stationary portion 616*a*-*e* fixed to the movable surface attachment and a second linear slide portion 618*a*-*e* slidingly engaged with the second linear stationary portion 616*a*-*e*. The tray assembly 600*a*-*e* may further include a second movable surface rotation mechanism 619*a*-*e* having a second rotate stationary portion fixed to the second linear slide portion 618*a*-*e* and a second rotation portion rotatably engaged with the second rotate stationary portion. The tray assembly 600*a*-*e* may yet further include a second movable surface 622*a*-*e* fixed to the second rotation portion. Alternatively, or additionally, at least one of the first and/or second movable surface linear slide mechanisms may be configured as a telescopic arm. Alternatively, or additionally, the movable surface assembly 600*a*-*e* may rotate with respect to an associated standard (e.g., standard 635*a*-*e*) via, for example, a second rotational mechanism (not shown in FIGS. 6A-E).

A venue assembly as, for example, illustrated in FIG. 2 may be installed within a venue 200 having a venue floor/walkway configuration as, for example, illustrated in FIGS. 1B-G and/or FIG. 2 including a venue floor 202, riser 203 and, an isle width (e.g., width from the venue riser 203 to the next isle 201, 202 forward/down) and/or a height of the venue riser 203 (e.g., a height from the venue floor 202, 203 to the next isle rearward/up 204). Thereby, a position of a venue assembly 200 may, for example, be dependent on venue operator desires (e.g., inclusion of movable surface assemblies, tables, chair seat height, isle width, etc.), as well as, venue building codes (e.g., require building code ingress/egress space, adults with disability act (ADA) requirements, etc.). Any given venue may include a concession staff isle 203, in front of a row of movable surface assemblies 600*a*-*e* and/or behind a row of chairs 205 (e.g., 600*a*-*e*), that includes a walking surface 203 that is lower than a surface on which an associated venue assembly is mounted. Thereby, concession staff may deliver concessions and/or retrieve related debris without being in a line of sight of a chair occupant with respect to the chair occupant viewing a venue event. Also, concession staff may not need to bend over, or stoop to a level of an associated movable surface when, for example, delivering concessions and/or retrieving related debris. Any given isle may include a hand rail and/or barricade to prevent related trips and/or falls. In addition to providing concession staff ingress/egress, a concession staff isle may also provide ingress and/or egress for chair occupants. A movable surface 620*a-e* may be fixed to a standard 635*a-e*. The standard 635*a-e* may be pivotally and/or linearly 639*a-e* reorientable with respect to an associated mounting structure 636*a-e*. For example, the standard 635*a-e* may pivot away from/toward a respective chair 605*a-e* with respect to the mounting structure 636*a-e*, or the standard 635*a-e* may rotate with respect to the mounting structure 636*a-e*. Alternatively, or additionally, the movable surface assembly may rotate with respect to the standard 635*a-e* via, for example, a second rotational mechanism (i.e., a second rotational mechanism in addition the rotational mechanism 619*a-e*).

In a particular embodiment, the surface 203 may be, for example, seventy-eight inches front to back. Alternatively, the surface 203 may be, for example, eighty inches front to back. In other alternatives, the surface 203 may be, for example, between seventy inches and ninety inches front to back depending on, for example, which type chair (e.g., rocker style, beam mount, chair with pivotable seat, powered chair, etc.) is installed in the given row. A given venue may include first area of the venue (e.g., a first row, a first section, etc.) that includes a first type of chair (e.g., rocker style, beam mount, chair with pivotable seat, powered chair, etc.) and/or a first type movable surface assembly, and a second area of the venue (e.g., a second row, a second section, etc.) that includes a second type of chair (e.g., rocker style, beam mount, chair with pivotable seat, powered chair, etc.) and/or a second type movable surface assembly A movable surface assembly may include a movable surface linear slide mechanism that includes a linear biasing mechanism. The linear biasing mechanism may be configured to linearly reorient the movable surface to a predetermined linear orientation. A movable surface assembly may include a movable surface rotation mechanism that includes a rotation biasing mechanism. The rotation biasing mechanism may be configured to rotationally reorient the movable surface to a predetermined rotational orientation. A movable surface assembly may include at least one accessory holder fixed relative to the movable surface attachment. A movable surface assembly may include at least one concessions button. When the at least one concessions button is actuated by a user, an indication may be activated. The indication may be representative of a desire of the user related to concessions. A movable surface assembly may include at least one movable surface illumination source. When the at least one movable surface illumination source is activated, at least a portion of an area proximate the movable surface may be illuminated. A movable surface assembly may include at least one storage area located above the movable surface attachment and below the movable surface linear slide mechanism. The at least one storage area may be configured to receive a venue information brochure, a menu, a concessions order form, a venue event brochure, a venue evaluation card, a tablet, an interactive question/answer sheet, a writing instrument, a recording instrument, a tablet computing device, etc. A movable surface assembly may include a movable surface linear slide mechanism that includes at least one linear detent feature. The at least one linear detent feature may be configured to retain the movable surface in a particular linear orientation. A movable surface assembly may include a movable surface rotation mechanism that includes at least one rotation detent feature. The at least one rotation detent feature may be configured to retain the movable surface in a particular rotational orientation. A movable surface assembly may include at least one accessory holder fixed relative to a movable surface attachment. The at least one accessory holder may include a repositionable portion movingly attached to the at least one accessory holder. A movable surface assembly may include at least one concessions button. When the at least one concessions button is actuated by a venue staff member, an indication, that may be representative of a desire of the user related to concessions, may be deactivated. A movable surface assembly may include at least one movable surface illumination source. The at least one movable surface illumination source is controlled by a venue control.

Figure 6A:
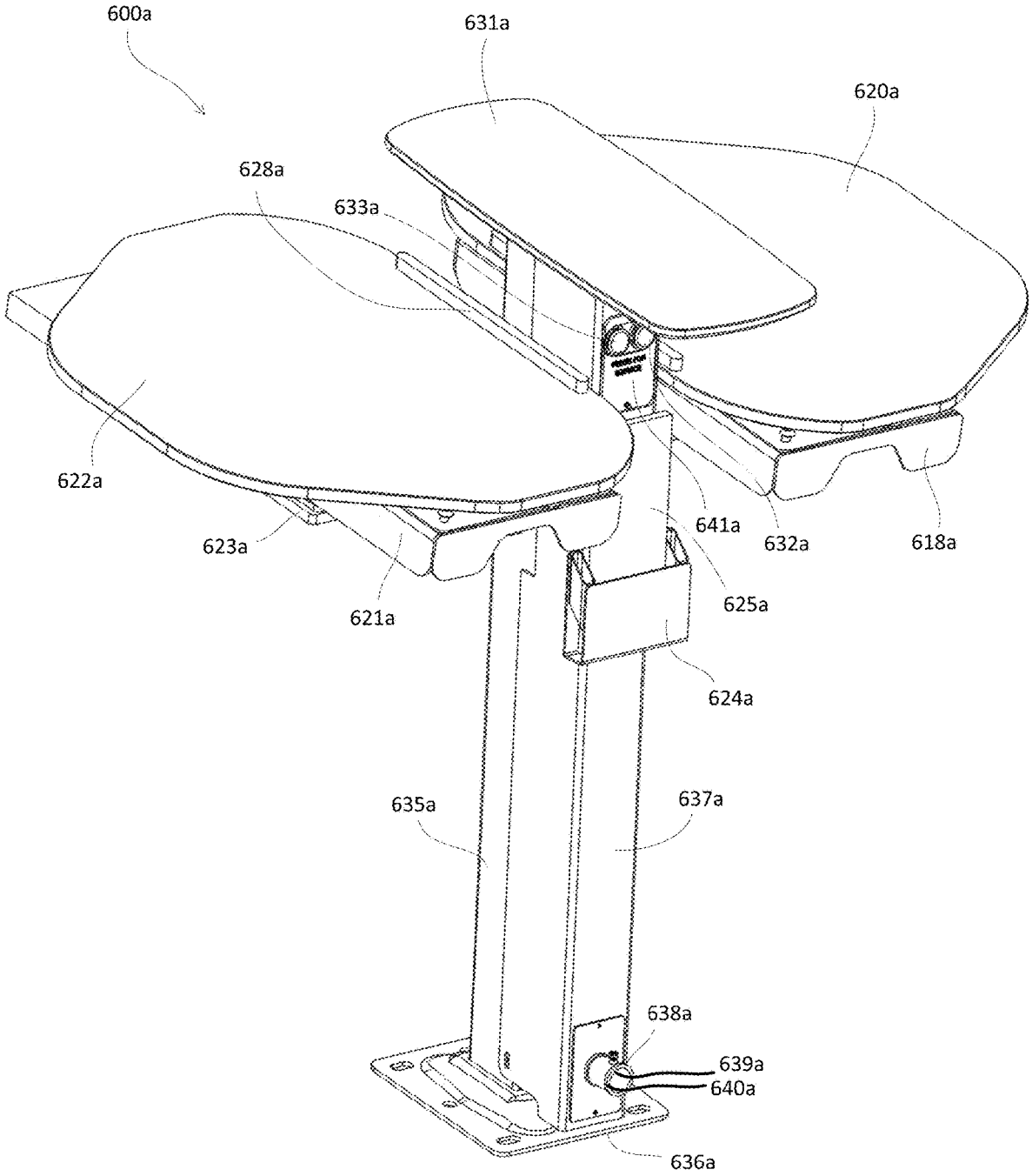
FIGS. 6A-E depict various views of an example table assembly.
Figure 6B:
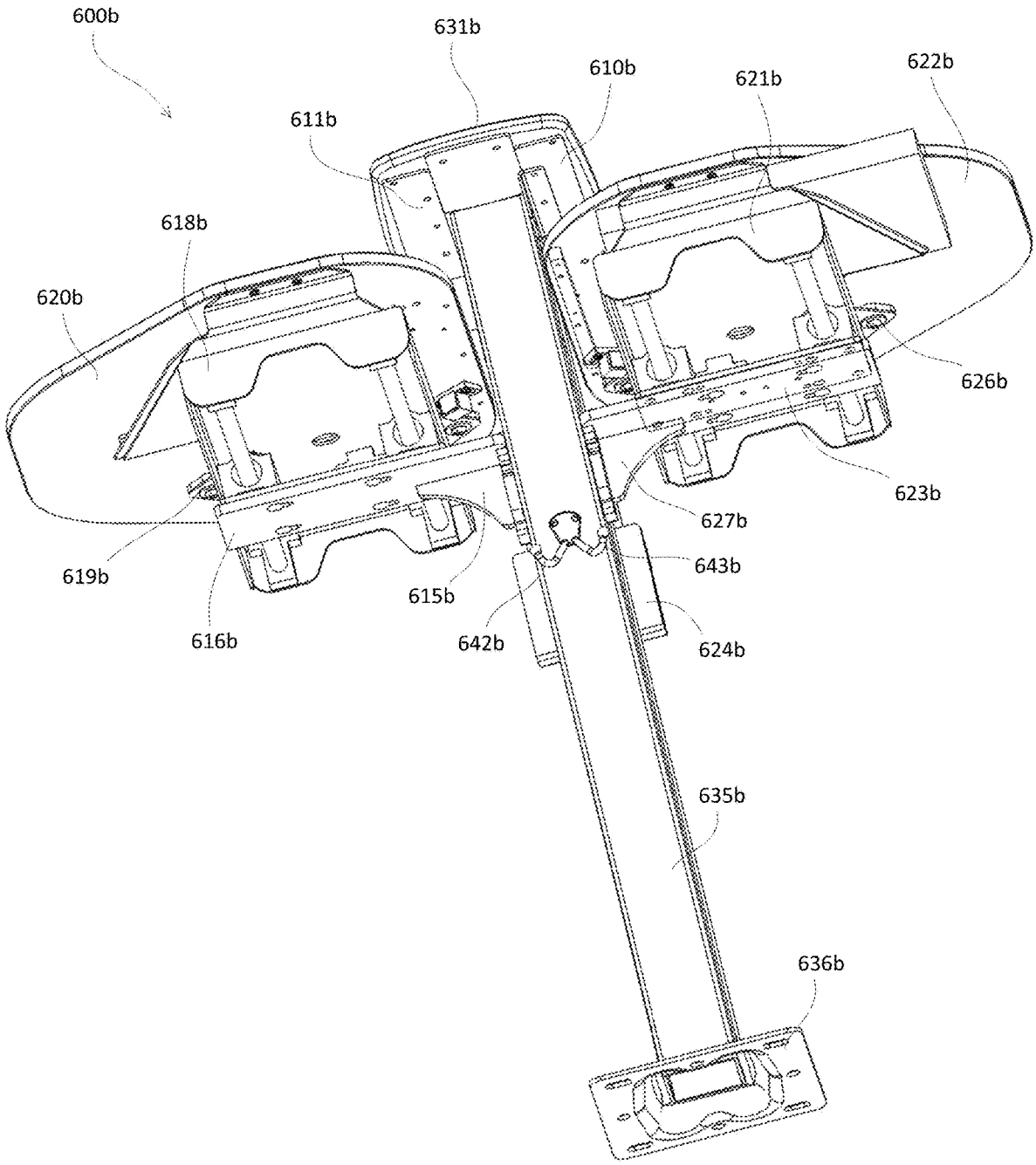
Figure 6C:
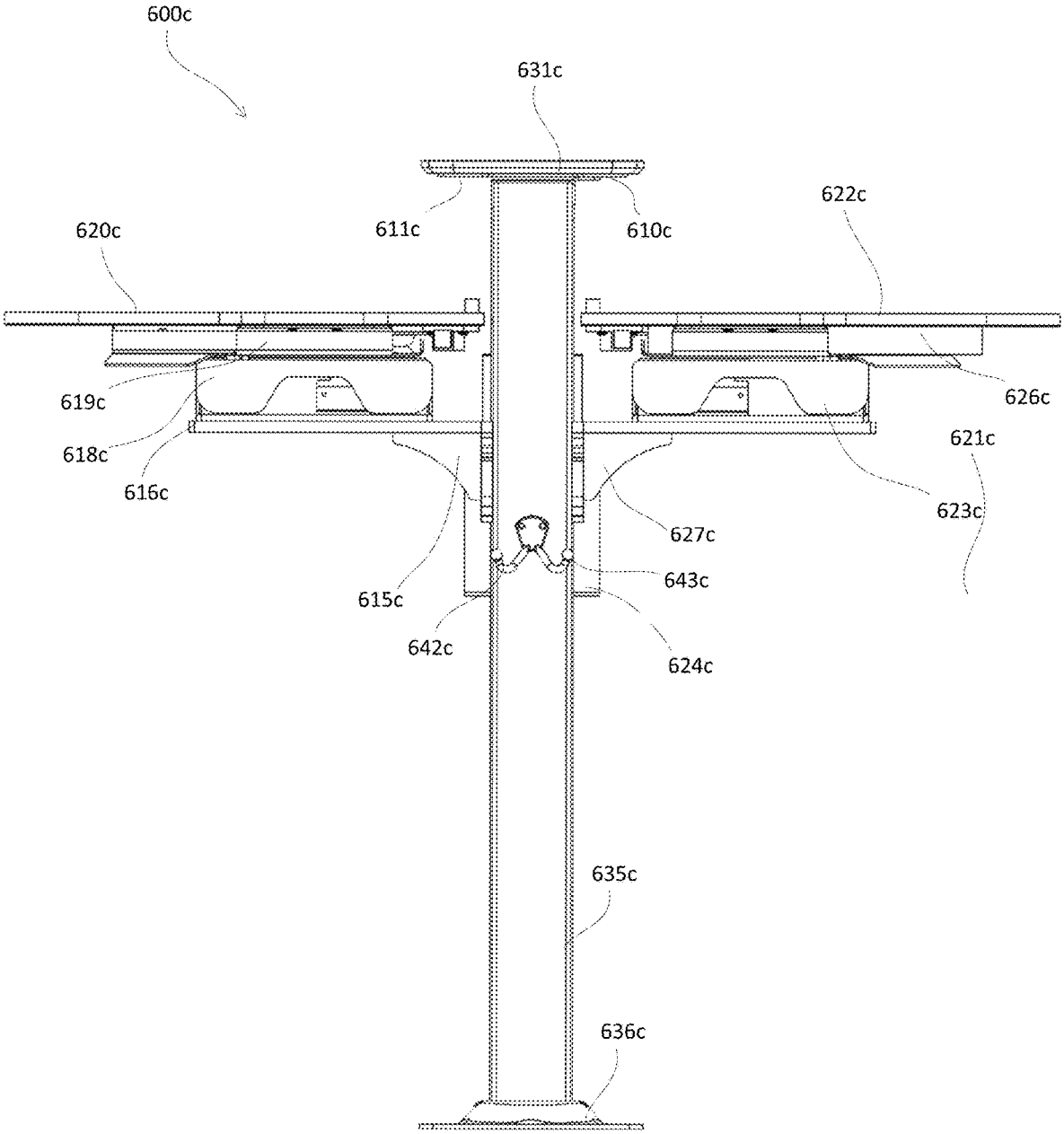
Figure 6D:
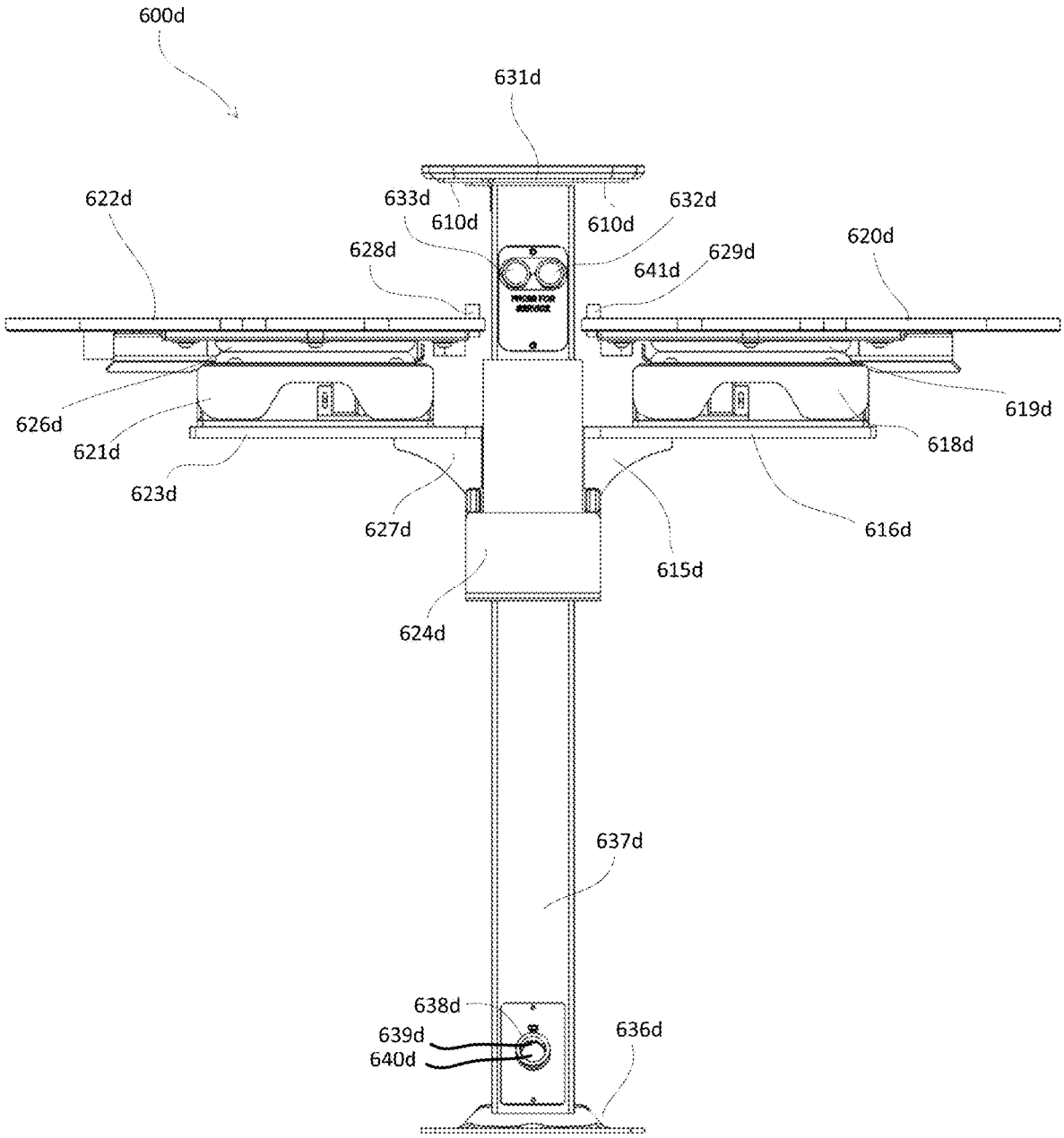
Figure 6E:
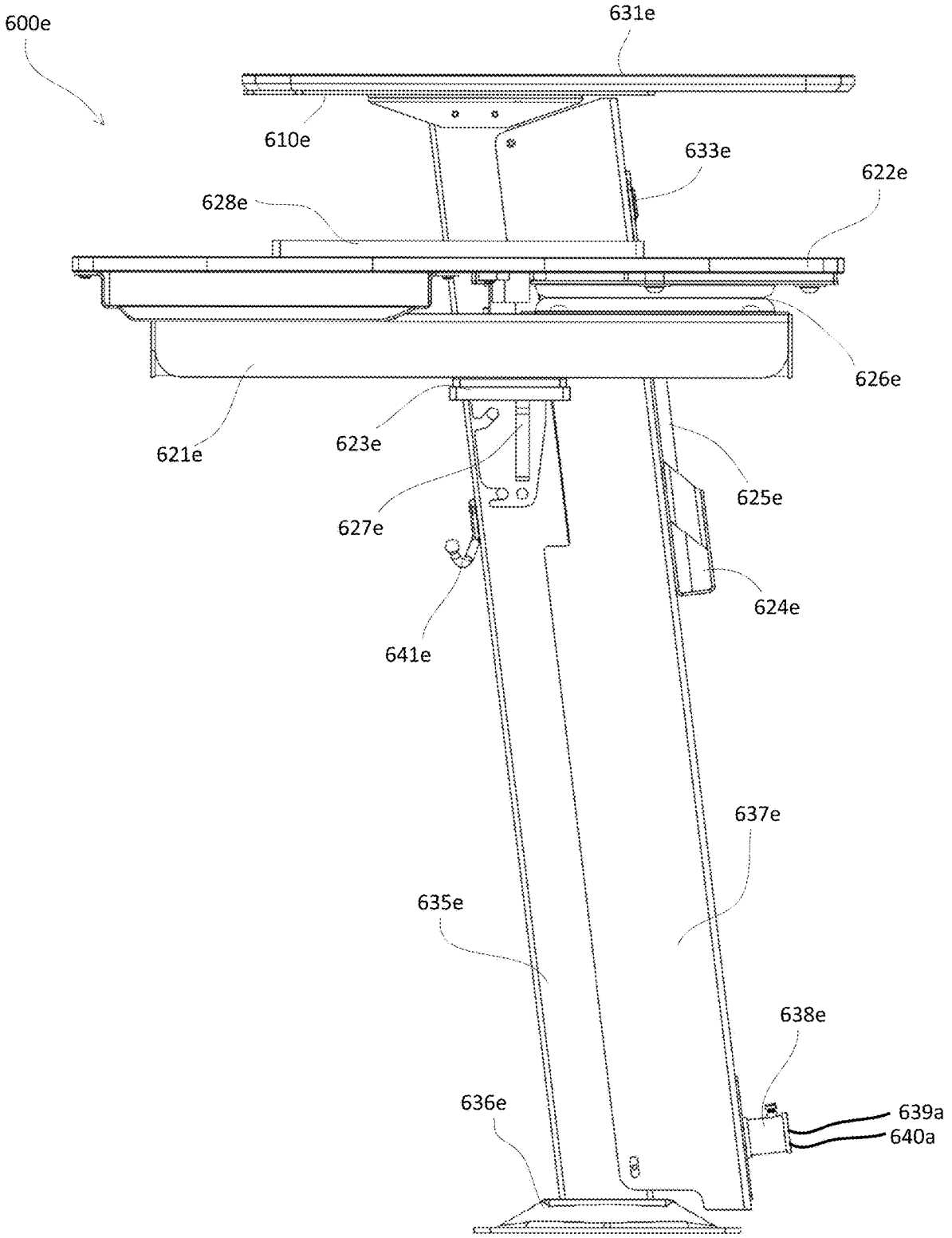

As illustrated in FIG. 6A, a movable surface assembly 600*a* may include a first movable surface 620*a* that may be configured to rotate in a first rotation and a second movable surface 622*a* that may be configured to rotate in a second rotation opposite the first rotation. A movable surface assembly 600*a* may include a first movable surface 620*a* that may be configured to rotate toward a first chair and a second movable surface 622*a* that may be configured to rotate toward a second chair. A movable surface assembly may include at least one accessory holder fixed relative to a movable surface attachment between a first movable surface and a second movable surface. A movable surface assembly may include at least two concessions buttons. When at least one of the at least two concessions buttons is actuated by a user, an indication is activated, and wherein the indication is representative of a desire of the user related to concessions, and at least one information plague. The at least one information plague may contain information related to use of the at least two concessions buttons. A movable surface assembly may include at least two movable surface illumination source. When a first one of the at least two movable surface illumination source is activated, at least a portion of an area proximate the first movable surface may be illuminated. When a second one of the at least two movable surface illumination source is activated, at least a portion of an area proximate the second movable surface may be illuminated.

While not shown in FIGS. 6A-E, any one of the table assemblies 600*a-e* may include an occupancy sensor. The occupancy sensor may be configured to sense when an individual has occupied a respective chair and, for example, provide an indication to a remote venue management system that the respective chair has been occupied. For example, an occupancy sensor may be configured to sense when a respective table has been reoriented to an in use orientation. Alternatively, or additionally, an occupancy sensor may be a proximity sensor (e.g., a capacitance sensor, a limit switch, a heat sensor, a weight sensor, a pressure transducer, etc.).

A movable surface assembly may include adjustment mechanisms to adjust a "levelness" of a movable support surface. A movable surface assembly may include structure containing internal or external wire management features. A movable surface assembly may include at least one segment of motion (e.g., linear motion and/or rotational motion) with different resistance to motion. A movable surface assembly may include features or functions that can be activated or disable based on ticket purchase/activation and or seat occupancy. A movable surface assembly may include illumination sources having output that may be varied based on patron actions or external or internal venue related factors. A movable surface assembly may include an accessory holder and or features that may indicate patron desires, such as, concession order status, meal status, etc. A movable surface assembly may include features which can control chair actions.

Contains WiFi access point or routers. A movable surface assembly may include table position sensors that may be coordinated with chair action (e.g., moving a support surface away from a chair occupant may cause a respective chair to reorient to an upright orientation from a reclined orientation or vise versa, moving a support surface away from a chair occupant may cause an associated chair ottoman to reorient to a retracted orientation from an extended orientation or vise versa, etc.). A movable surface assembly may include a table having: a cup holder, a light sensor, a cell phone charger, power outlets (AC or DC or wireless). A movable surface assembly may include controls in, for example, a cup holder bezel, a lighted cup holder, a heated/cooled cup holder. A movable surface assembly may include a modesty panel and/or light direction management features configured to, for example, inhibit light emitted from a particular illumination source from being visible by an adjacent (e.g., beside, behind, in front, etc.) chair occupant. A movable surface assembly may include a front console, a side console, an under console. A movable surface assembly may include a console that may move with an associated support surface. A movable surface assembly may include at least one surface to facilitate removal of completed meals and or utensils. A movable surface assembly may include table functions that may be powered. A movable surface assembly may include position of a table rotation and linear translation that may be coordinated. A movable surface assembly may include a table that may be height adjustable. A movable surface assembly may include height adjustability that may be as a unit or via individual components. A movable surface assembly may include table that may contain surfaces which may translate to facility serving from a direction other than a front of a chair. A movable surface assembly may include a table surface that may have container features which may facilitate features other than eating (e.g., in a lecture room-PC access features, gaming controls to interact with horse racing, e-Sport controls, table surface that articulates to another plane to facilitate use, etc.). A movable surface assembly may include hand holds to aid chair occupant entry and exit. A movable surface assembly may include hand rail features. A movable surface assembly may include at least one illumination source configured to illuminate adjacent areas of a movable surface, such as, to read a menu or to aid a user while filling out a concessions order form. A movable surface assembly may include at least one concessions button interconnected to a network for data collection. A movable surface assembly may include a unique identifier (e.g., a QR code, an ID chip, etc.) that may be identifiable by location within a venue. A movable surface assembly may be linked to a venue ticket purchaser and/or to an individual occupying a particular chair. A movable surface assembly may include information that may be communicated to, within said network and actions can be initiated based on this information. A movable surface assembly at least one illumination source affixed to a fixed portion of the movable surface assembly. A movable surface assembly may include a concession inventory record entry, recording, and automatic reorder system. A movable surface assembly may include a concession activity record entry, recording, and analysis system that may be, for example, configured to track concession ordering and/or delivery activity (e.g., time of concession order, time of concession delivery, customer satisfaction information, dollar amount of concession orders, etc.).

A table assembly 600*a-e* may include a support structure 635*a-e* having a mounting foot 636*a-e*. The mounting foot 636*a-h,j* may be, for example, configured to fix the table assembly 600*a-h,j* to a venue floor, a venue riser, a venue structure, a chair structure, a beam mount structure, etc. Alternatively, a table assembly 600*a-h,j,* may be configured to be repositionable and/or reorientable as shown and described, for example, with reference to FIGS. 6A-E. In any event, a table assembly 600*a-h,j* may include a first reorientable table attachment 616*b-e* and a second reorientable table attachment 623*b,d,e*. The table assembly 600*a-h,j* may include an upper support surface 630*a-e,* at least one menu holder 670*a-c* configured to receive at least one menu 671*a-c,* at least one concessions order card holder 675*a-e* configured to receive at least one concessions order card 676*a-e,* a first concessions order button 680*c-e,* a second concessions order button 681*d,e,* a first patron reading light 631*b*, and a second patron reading light 632*b*. The first concessions order button 680*c-e* and/or the second concessions order button 681*d,e* may be, for example, configured as a "toggle on/off switch" (e.g., push ones toggles on/push a second time toggles off). Alternatively, the first concessions order button 680*c-e* and/or the second concessions order button 681*d,e* may be, for example, configured as momentary button and may be incorporated within an associated electrical circuit that provides a "latching" circuit. In any event, the first concessions order button 680*c-e* and/or the second concessions order button 681*d,e* may be, for example, configured to turn on and/or off the respective first patron reading light 631*b* or the second patron reading light 632*b*. Alternatively, or additionally, the first concessions order button 680*c-e* and/or the second concessions order button 681*d,e* may be, for example, configured to change a color of light emitted by the respective first patron reading light 631*b* or the second patron reading light 632*b*. The first concessions order button 680*c-e* and/or the second concessions order button 681*d,e* may be, for example, configured to transmit an associated indication to a central venue concessions system indicating that a chair occupant desires concessions related service.

A table assembly 600*a-e* may further include at least one 110 Volt outlet and/or at least one data outlet (e.g., a USB plug). Alternatively, or additionally, a table assembly 600*a-e* may further include at least two 110 Volt outlets and/or at least two data outlets (e.g., a USB plug).

A table assembly 600*a-e* may further include a first linear movement mechanism 650*b* having first and second linear movement mechanism attachments 651*f-e* connected to the first reorientable table attachment 616*b-e*. The first linear movement mechanism 650*b* may further include a linear detent mechanism. The linear detent mechanism may, for example, include an adjustable tension, spring-loaded ball bearing, device, a first linear position detent, and a second linear position detent that may provide two different linear positions (e.g., an in-use position and a chair exit position) that require a greater force to move the first linear movement mechanism 650*b* when compared to other linear positions. The first linear movement mechanism 650*b* may further include a rotational mechanism attachment 621*a-e*. The first linear movement mechanism 650*b* may further include a biased position (e.g., a biasing spring) configured to, for example, bias the first support surface 620*a-e* to a position that provides a desired chair egress and/or isle passage. A bias mechanism may include a movement speed inhibitor configured to, for example, slow a movement of the first support surface 620*a-e* to a biased orientation.

A table assembly 600*a-e* may further include a first rotational movement mechanism 619*b-e* rotationally attaching a first support surface 620*a-e* (e.g., a table, a tray, etc.) to the rotational mechanism attachment 621*a-e*. The first rotational movement mechanism 619*b-e* may further include a rotational detent mechanism 653*d,e*. The rotational detent mechanism 653*d,e* may, for example, include an adjustable tension, spring-loaded ball bearing, device, a first rotational position detent, and a second rotational position detent that may provide two different rotational positions (e.g., an in-use position and a chair exit position) that require a greater force to move the first rotational movement mechanism 619*b-e* when compared to other rotational positions. The first rotational movement mechanism 619*b-e* may further include a biased position (e.g., a biasing spring) configured to, for example, bias the first support surface 620*a-e* to a position that provides a desired chair egress and/or isle passage. A bias mechanism may include a movement speed inhibitor configured to, for example, slow a movement of the first support surface 620*a-e* to a biased orientation.

Movement of the first linear movement mechanism 650*b* and the first rotational movement mechanism 619*b-e* may be, for example, at least partially interlocked (e.g., via mechanical mechanism, gears, etc.) such that movement of either the first linear movement mechanism 650*b* or the first rotational movement mechanism 619*b-e* causes the other to move. While not shown in FIGS. 6A-E, the first linear movement mechanism 650*b* and/or the first rotational movement mechanism 619*b-e* may include a handle configured for a user to grasp the handle to reorient the corresponding support surface 620*a-e*. Alternatively, or additionally, either, or both of, the first linear movement mechanism 650*b* and the first rotational movement mechanism 619*b-e* may include actuators and a corresponding user interface (e.g., a push button). As another alternative, or addition, reorientation of the support surface 620*a-e* may be coordinated with reorientation of a respective chair (e.g., when the chair is reoriented to an upright orientation, the support surface reorients to a chair exit orientation, and when the chair is reoriented to a recline orientation, the support surface reorients to an in-use orientation).

A table assembly 600*a-e* may further include a second linear movement mechanism 660*b* having first and second linear movement mechanism attachments 651*f-e* connected to the second reorientable table attachment 623*b,d,e*. The second linear movement mechanism 660*b* may further include a linear detent mechanism 652*d,e*. The linear detent mechanism 652*d,e* may, for example, include an adjustable tension, spring-loaded ball bearing, device, a first linear position detent, and a second linear position detent that may provide two different linear positions (e.g., an in-use position and a chair exit position) that require a greater force to move the second linear movement mechanism 660*b* when compared to other linear positions. The second linear movement mechanism 660*b* may further include a rotational mechanism attachment 618*b,d*. The second linear movement mechanism 660*b* may further include a biased position (e.g., a biasing spring) configured to, for example, bias the second support surface 622*b,d,e* to a position that provides a desired chair egress and/or isle passage. A bias mechanism may include a movement speed inhibitor configured to, for example, slow a movement of the first support surface 622*b,d,e* to a biased orientation.

A table assembly 600*a-e* may further include a second rotational movement mechanism 617*b,d,e* rotationally attaching a second support surface 622*b,d,e* (e.g., a table, a tray, etc.) to the rotational mechanism attachment 618*b,d*. The second rotational movement mechanism 617*b,d,e* may further include a rotational detent mechanism. The rotational detent mechanism may, for example, include an adjustable tension, spring-loaded ball bearing, device, a first rotational position detent, and a second rotational position detent that may provide two different rotational positions (e.g., an in-use position and a chair exit position) that require a greater force to move the second rotational movement mechanism 617*b,d,e* when compared to other rotational positions. The second rotational movement mechanism 617*b,d,e* may further include a biased position (e.g., a biasing spring) configured to, for example, bias the second support surface 622*b,d,e* to a position that provides a desired chair egress and/or isle passage. A bias mechanism may include a movement speed inhibitor 685*f-h,j* configured to, for example, slow a movement of the first support surface 622*b,d,e* to a biased orientation.

Movement of the second linear movement mechanism 660*b* and the first rotational movement mechanism 617*b,d,e* may be, for example, at least partially interlocked (e.g., via mechanical mechanism, gears, etc.) such that movement of either the first linear movement mechanism 660*b* or the first rotational movement mechanism 617*b,d,e* causes the other to move. While not shown in FIGS. 6A-E, the second linear movement mechanism 660*b* and/or the second rotational movement mechanism 617*b,d,e* may include a handle configured for a user to grasp the handle to reorient the corresponding support surface 622*b,d,e*. Alternatively, or additionally, either, or both of, the second linear movement mechanism 660*b* and the second rotational movement mechanism 617*b,d,e* may include actuators and a corresponding user interface (e.g., a push button). As another alternative, or addition, reorientation of the support surface 622*b,d,e* may be coordinated with reorientation of a respective chair (e.g., when the chair is reoriented to an upright orientation, the support surface reorients to a chair exit orientation, and when the chair is reoriented to a recline orientation, the support surface reorients to an in-use orientation).

A combination of a linear movement mechanisms and a rotational movement mechanisms may be configured to, for example, produce a curve-linear movement of an associated support surface, a linear-curve movement of an associated support surface, an arc-path movement of an associated support surface, or any combination thereof. For example, a combination of a linear movement mechanism and a rotational movement mechanism may be interlocked to produce a curve-linear movement of an associated support surface, a linear-curve movement of an associated support surface, an arc-path movement of an associated support surface, or any combination thereof.

Alternatively, or additionally, with respect to the assembly shown in FIGS. 2 and 6A-E, a linear movement mechanism and/or a rotational movement mechanism may be, for example, located between a venue support surface (e.g., a venue floor, a venue riser, etc.) and a mounting foot 236, 636*a-e* and/or between a mounting foot 236, 636*a-e* and a support structure 235, 635*a-e*. Thereby, an entire table assembly 200, 600*a-e* may be reorientable (e.g., linearly and/or rotationally reorientable) with respect to an associated chair assembly.

A movable surface assembly may include a movable surface linear slide mechanism that includes a linear biasing mechanism. The linear biasing mechanism may be configured to linearly reorient the movable surface to a predetermined linear orientation. A movable surface assembly may include a movable surface rotation mechanism that includes a rotation biasing mechanism. The rotation biasing mechanism may be configured to rotationally reorient the movable surface to a predetermined rotational orientation. A movable surface assembly may include at least one accessory holder fixed relative to the movable surface attachment. A movable surface assembly may include at least one concessions button. When the at least one concessions button is actuated by a user, an indication may be activated. The indication may be representative of a desire of the user related to concessions. A movable surface assembly may include at least one movable surface illumination source. When the at least one movable surface illumination source is activated, at least a portion of an area proximate the movable surface may be illuminated. A movable surface assembly may include at least one storage area located above the movable surface attachment and below the movable surface linear slide mechanism. The at least one storage area may be configured to receive a venue information brochure, a menu, a concessions order form, a venue event brochure, a venue evaluation card, a tablet, an interactive question/answer sheet, a writing instrument, a recording instrument, a tablet computing device, etc. A movable surface assembly may include a movable surface linear slide mechanism that includes at least one linear detent feature. The at least one linear detent feature may be configured to retain the movable surface in a particular linear orientation. A movable surface assembly may include a movable surface rotation mechanism that includes at least one rotation detent feature. The at least one rotation detent feature may be configured to retain the movable surface in a particular rotational orientation. A movable surface assembly may include at least one accessory holder fixed relative to a movable surface attachment. The at least one accessory holder may include a repositionable portion movingly attached to the at least one accessory holder. A movable surface assembly may include at least one concessions button. When the at least one concessions button is actuated by a venue staff member, an indication, that may be representative of a desire of the user related to concessions, may be deactivated. A movable surface assembly may include at least one movable surface illumination source. The at least one movable surface illumination source is controlled by a venue control.

As illustrated in FIGS. 6A-E, a movable surface assembly 600*a-e* may include a first movable surface 620*a-d* that may be configured to rotate in a first rotation and a second movable surface 622*a-e* that may be configured to rotate in a second rotation opposite the first rotation. A movable surface assembly 620*a-d* may include a first movable surface 620*a-d* that may be configured to rotate toward a first chair and a second movable surface 622*a-e* that may be configured to rotate toward a second chair. A movable surface assembly may include at least one accessory holder fixed relative to a movable surface attachment between a first movable surface and a second movable surface. A movable surface assembly may include at least two concessions buttons. When at least one of the at least two concessions buttons is actuated by a user, an indication is activated, and wherein the indication is representative of a desire of the user related to concessions, and at least one information plague. The at least one information plague may contain information related to use of the at least two concessions buttons. A movable surface assembly may include at least two movable surface illumination source. When a first one of the at least two movable surface illumination source is activated, at least a portion of an area proximate the first movable surface may be illuminated. When a second one of the at least two movable surface illumination source is activated, at least a portion of an area proximate the second movable surface may be illuminated.

Figure 7A:
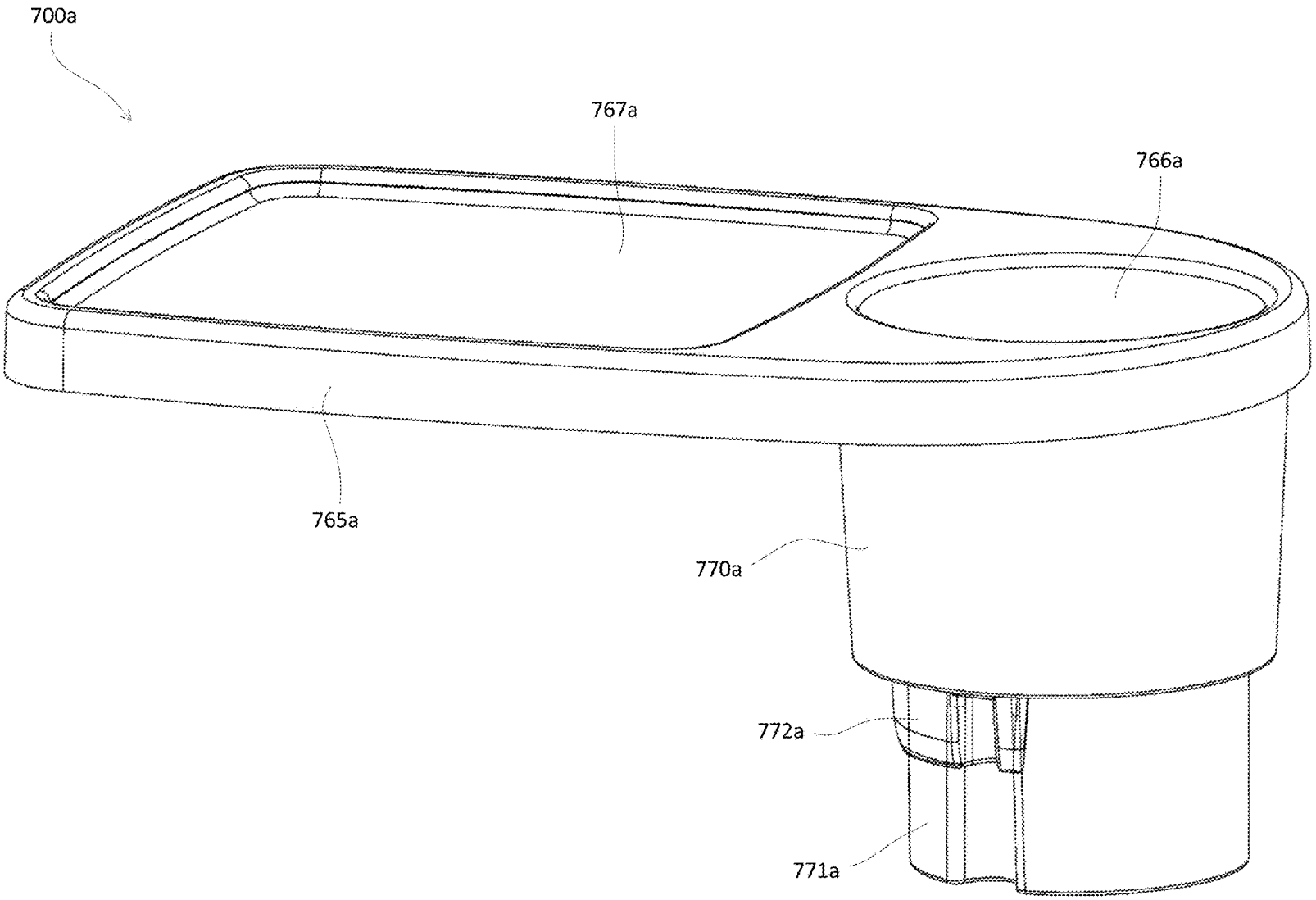
FIGS. 7A-H, J-N, P and Q depict various view of an example removable tray assembly.
Figure 7B:
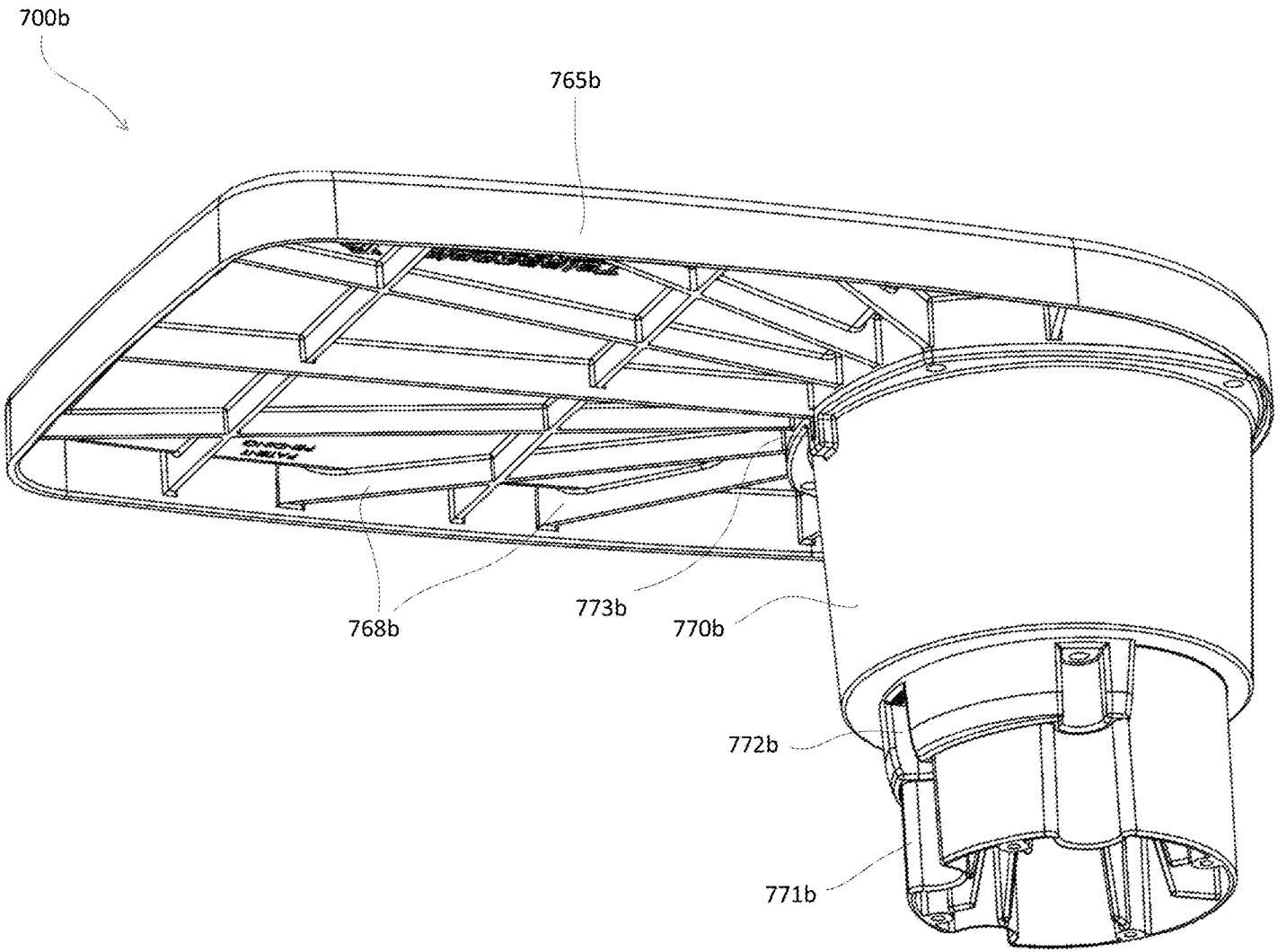
Figure 7C:
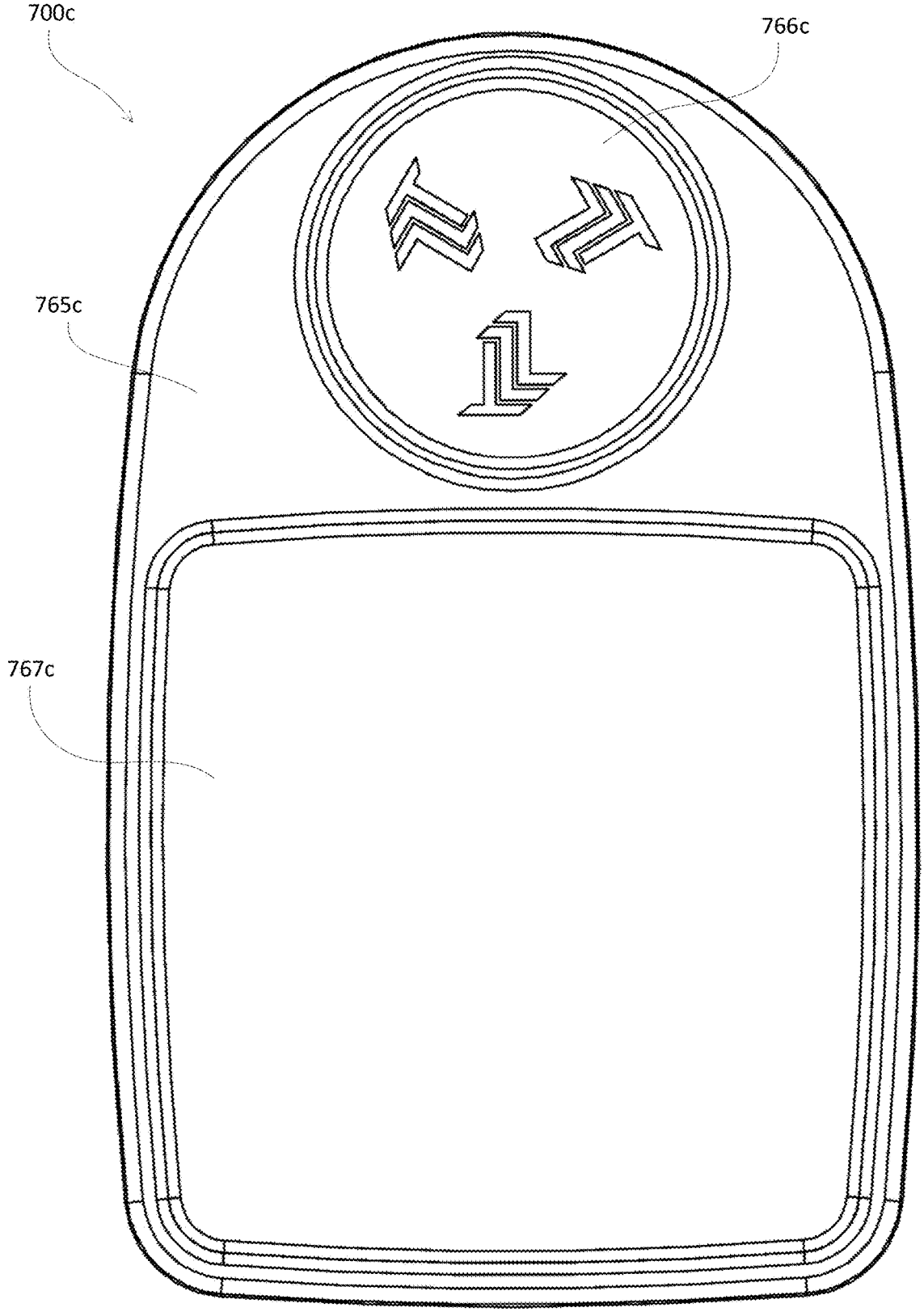
Figure 7D:
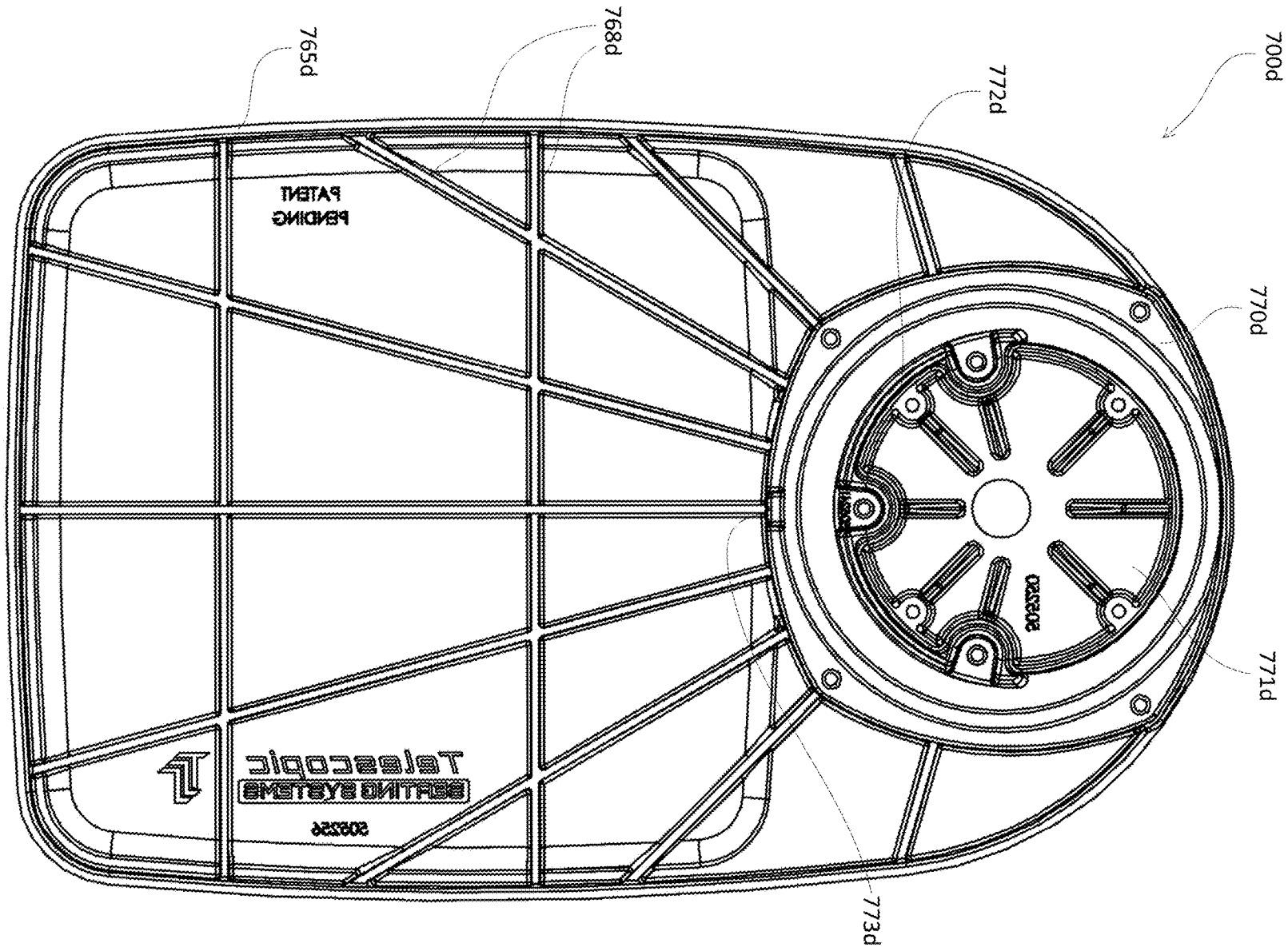
Figure 7E:
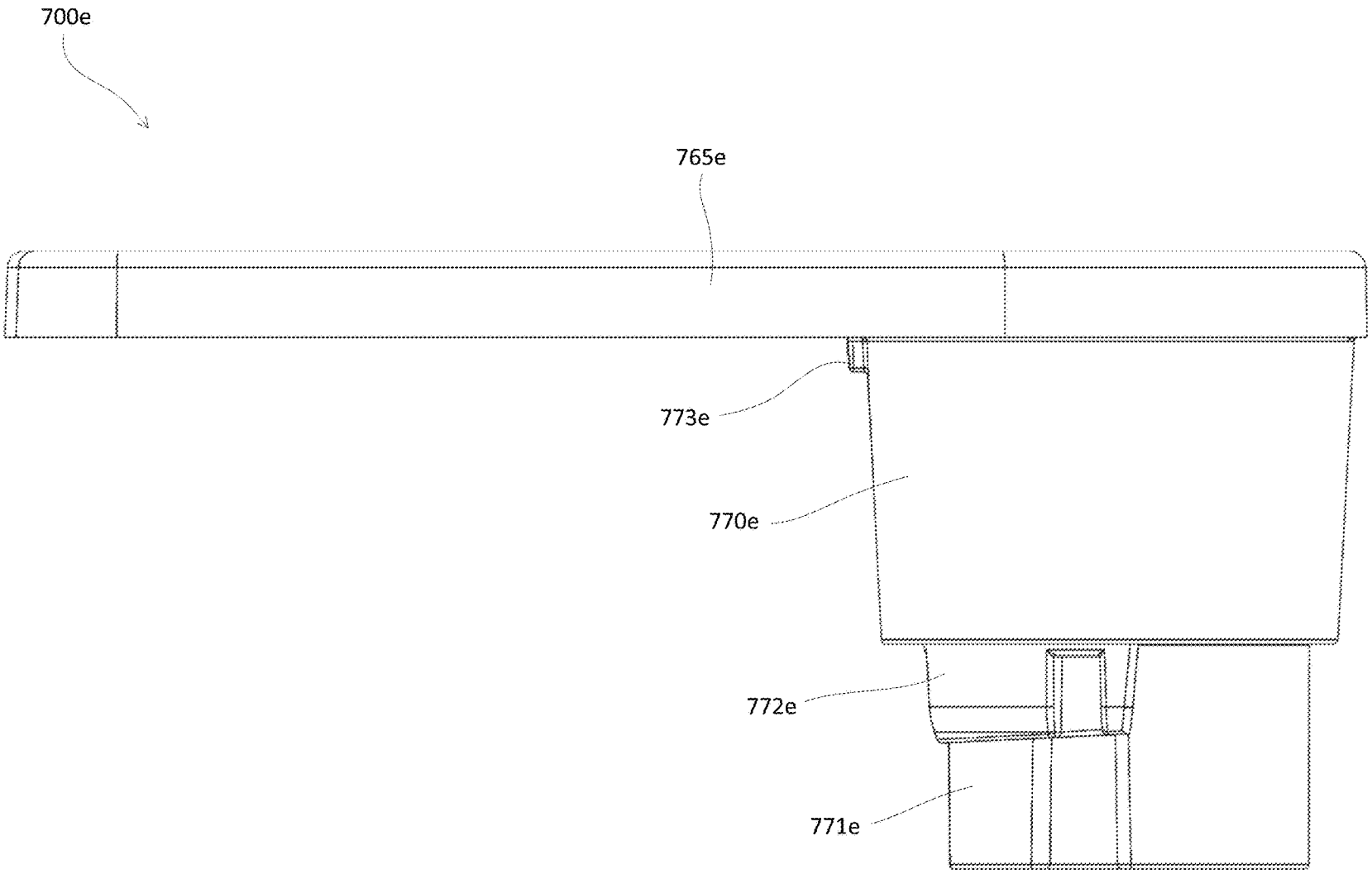
Figure 7F:
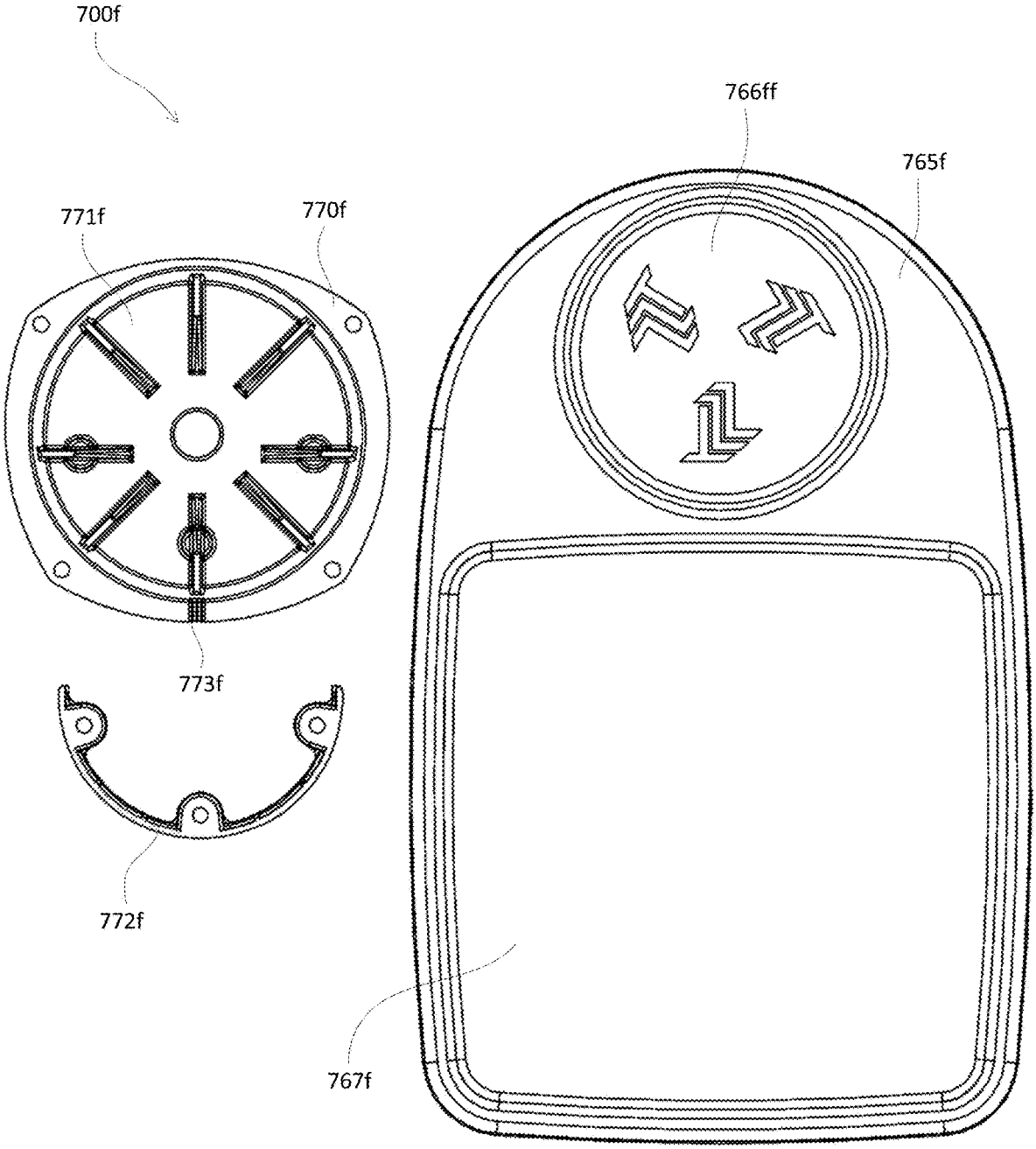
Figure 7G:
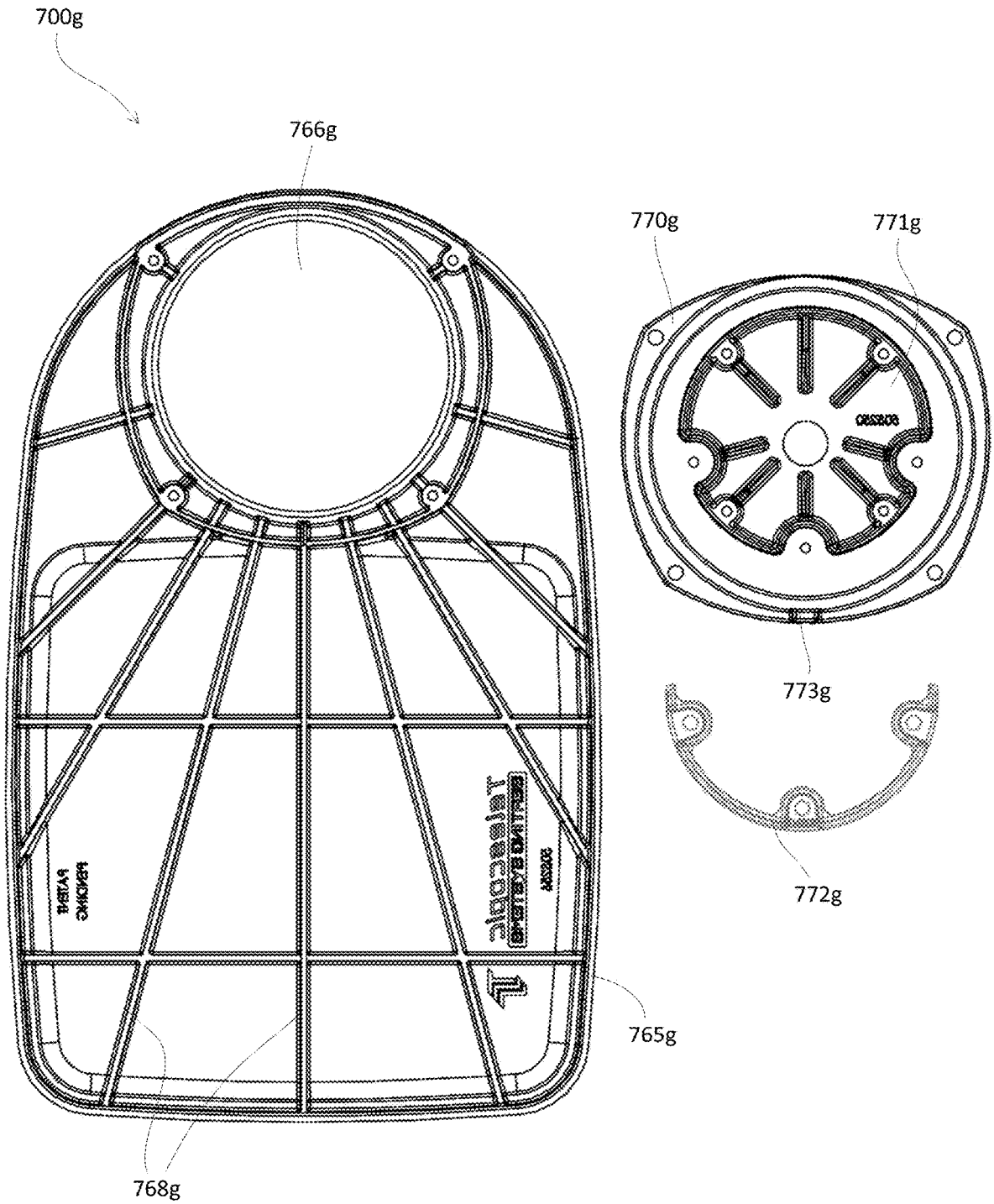
Figure 7H:
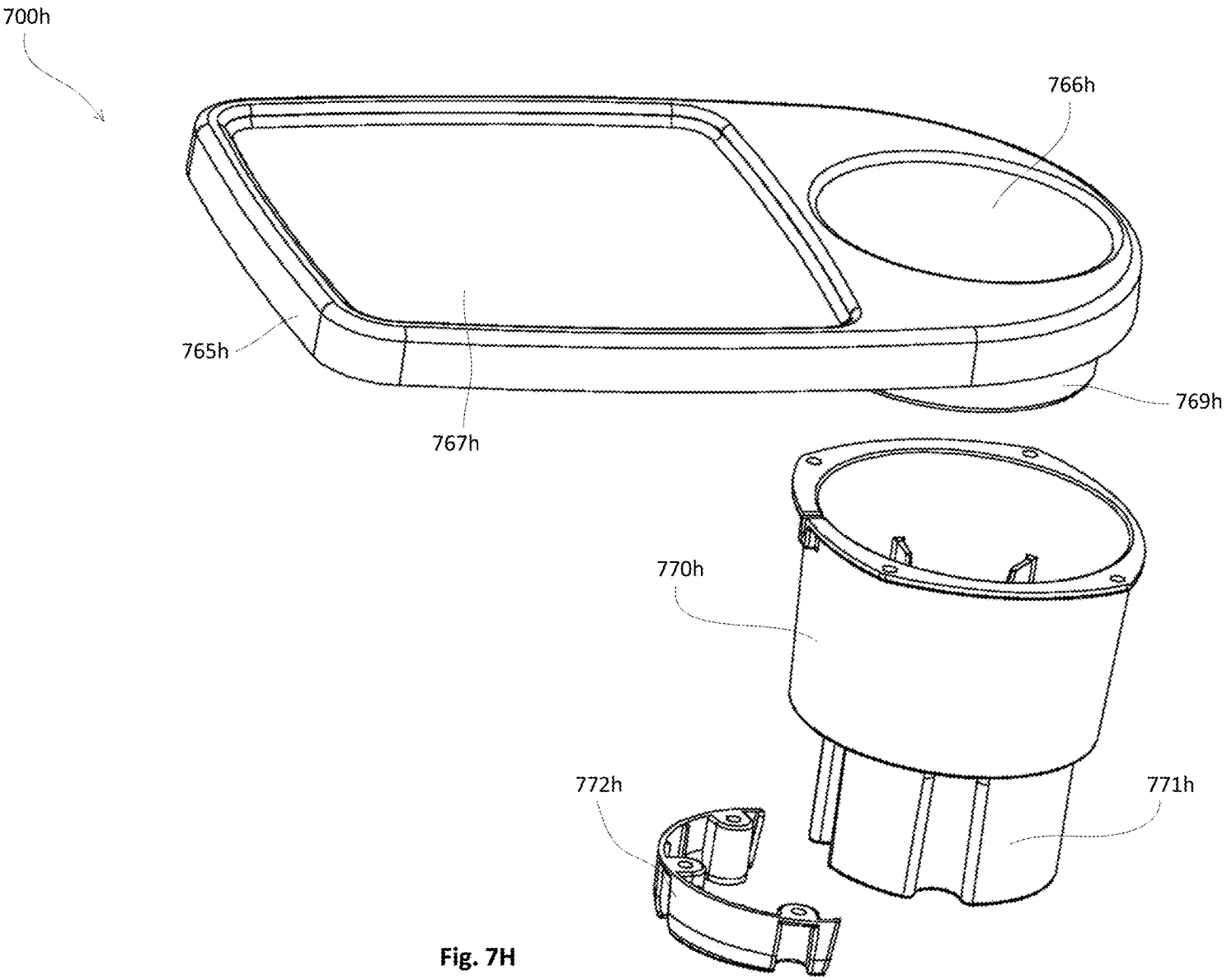
Figure 7J:
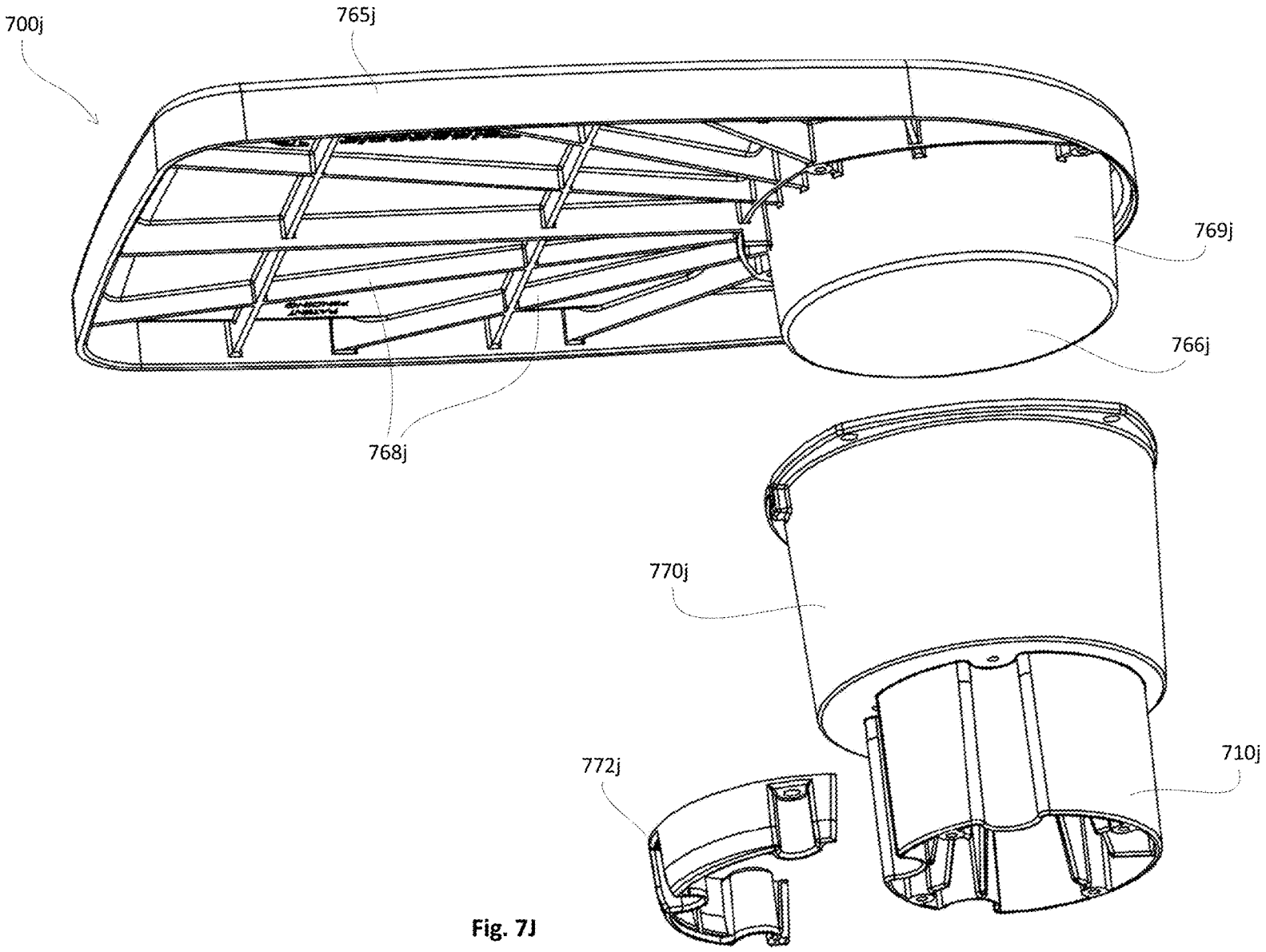
Figure 7K:
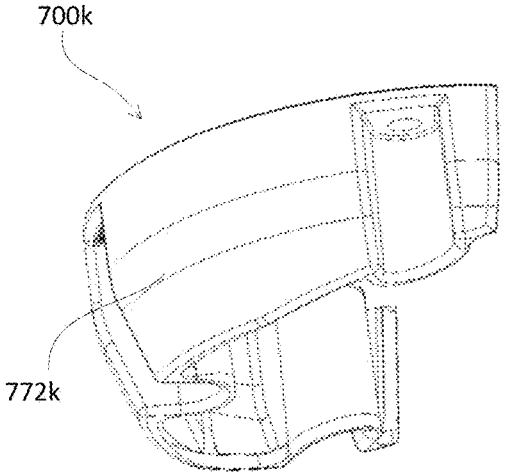
Figure 7L:
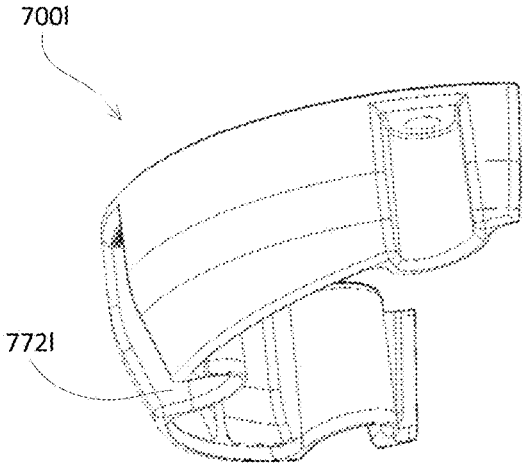
Figure 7M:
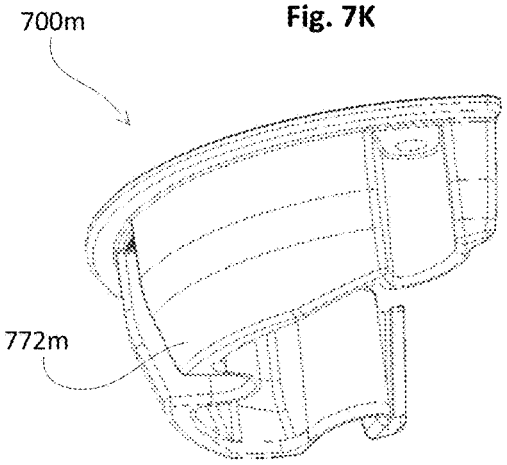
Figure 7N:
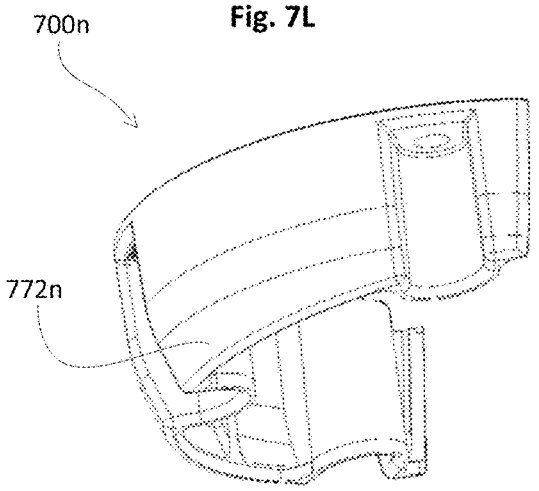
Figure 7P:
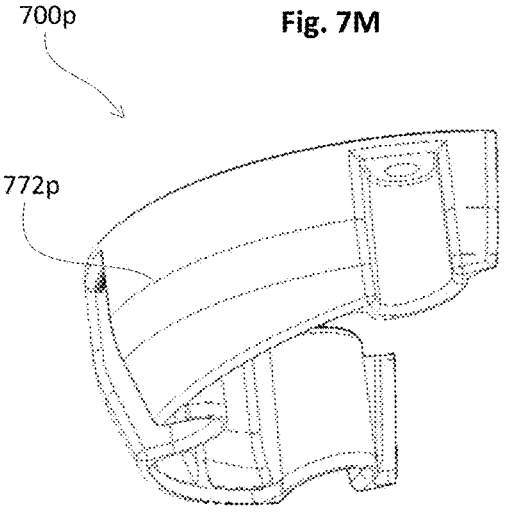
Figure 7Q:
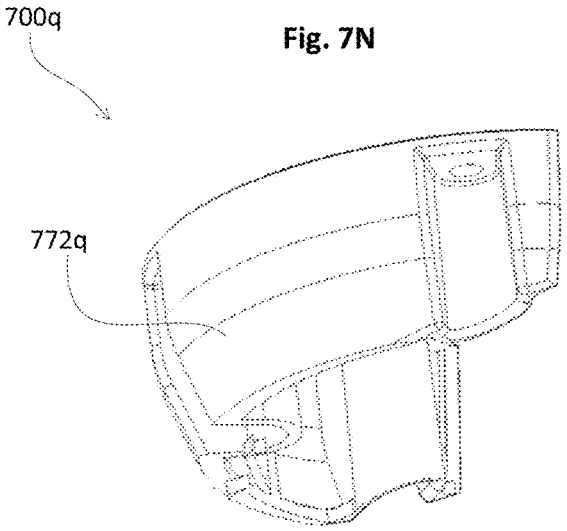
Figure 8A:
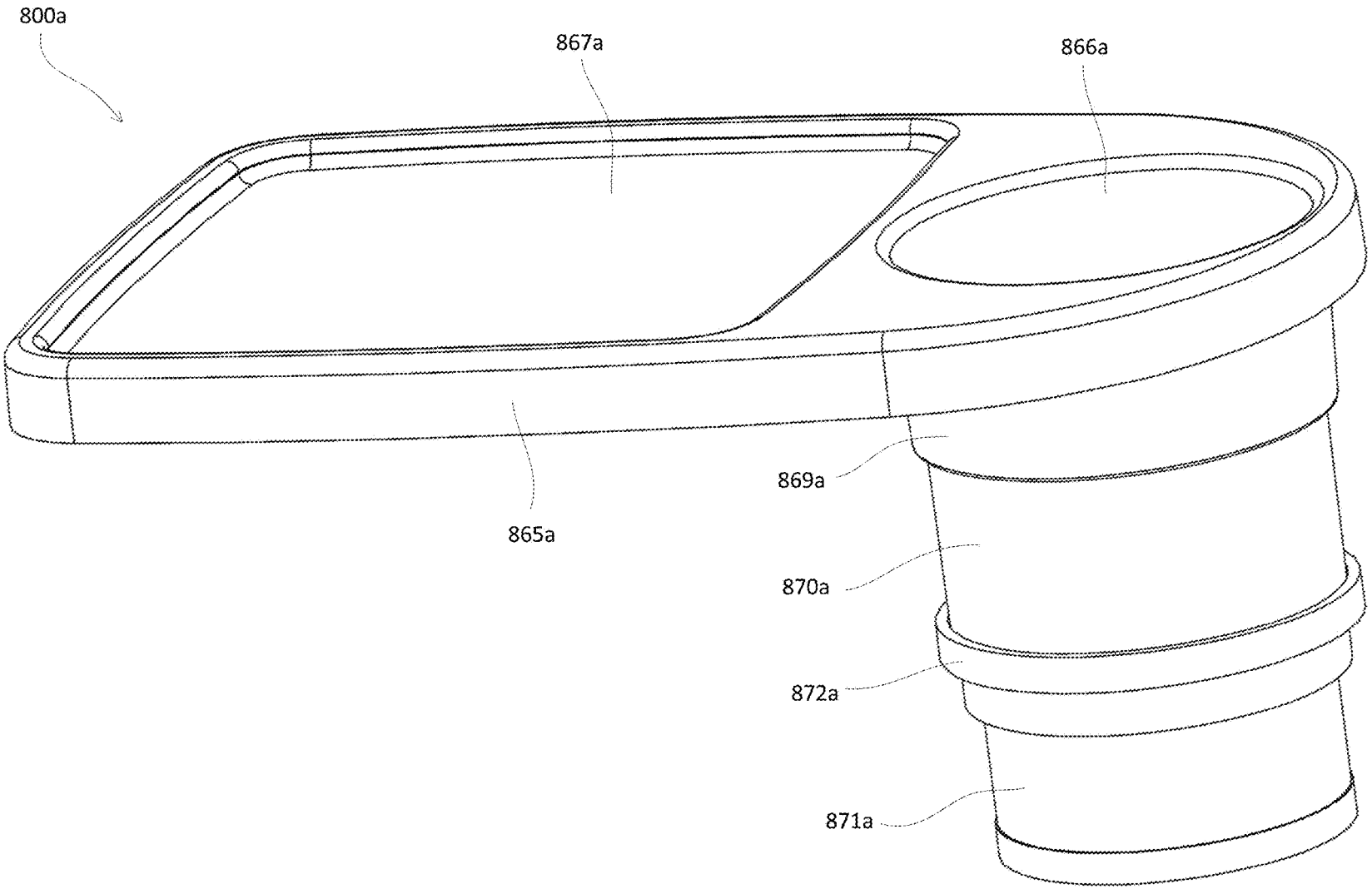
FIGS. 8A-G depict various view of an example removable tray assembly.
Figure 8B:
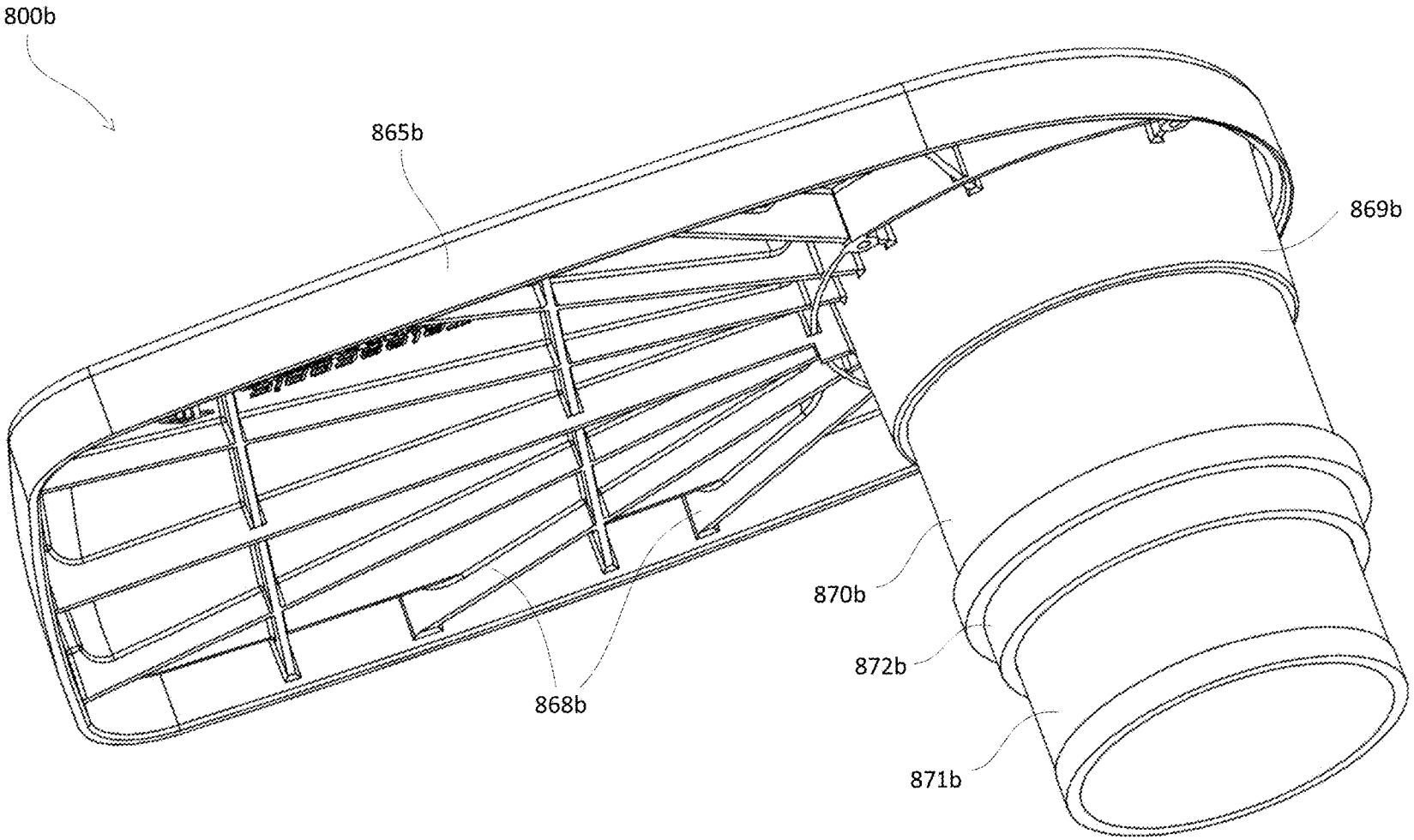
Figure 8C:
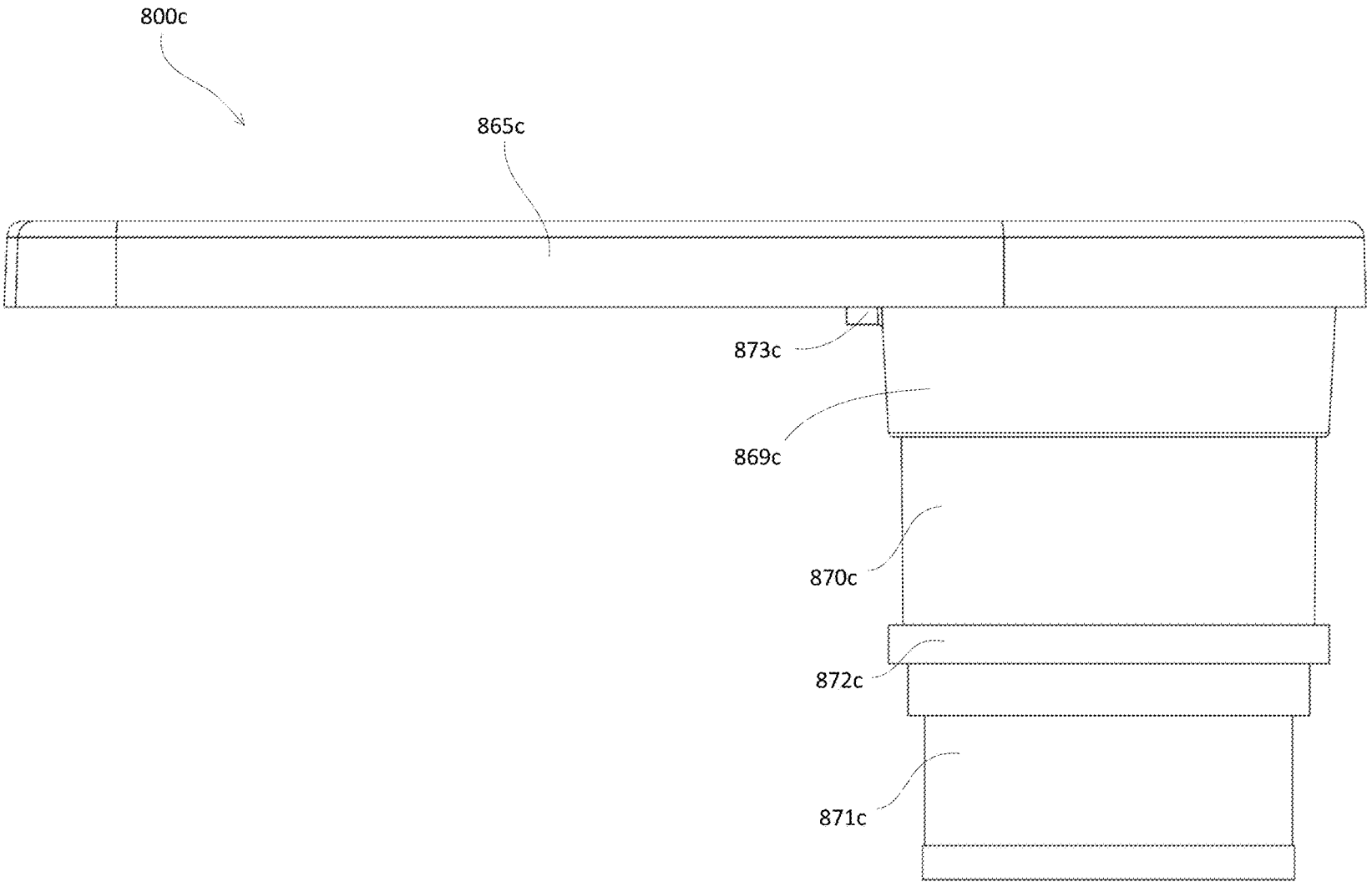
Figure 8D:
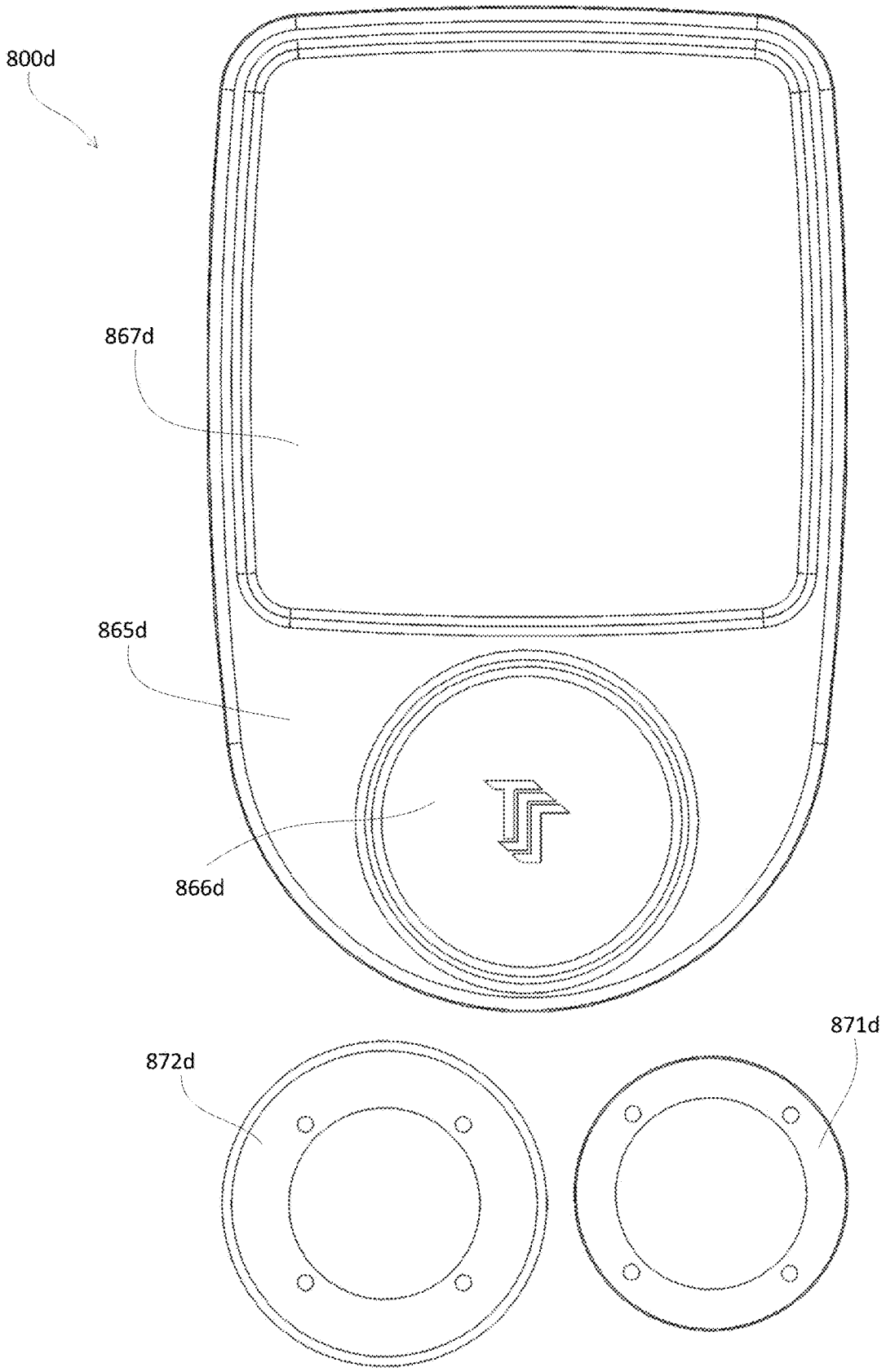
Figure 8E:
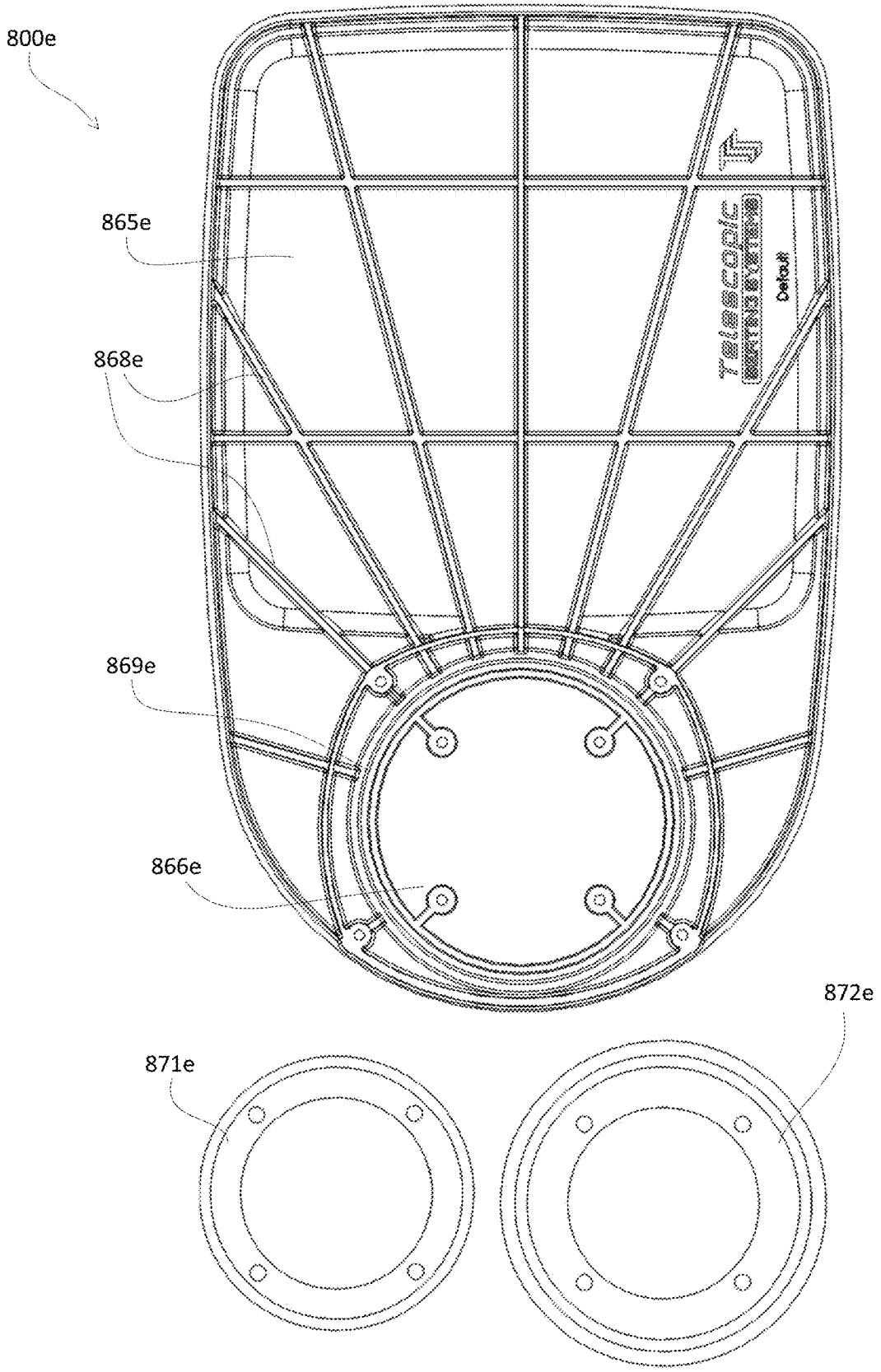
Figure 8F:
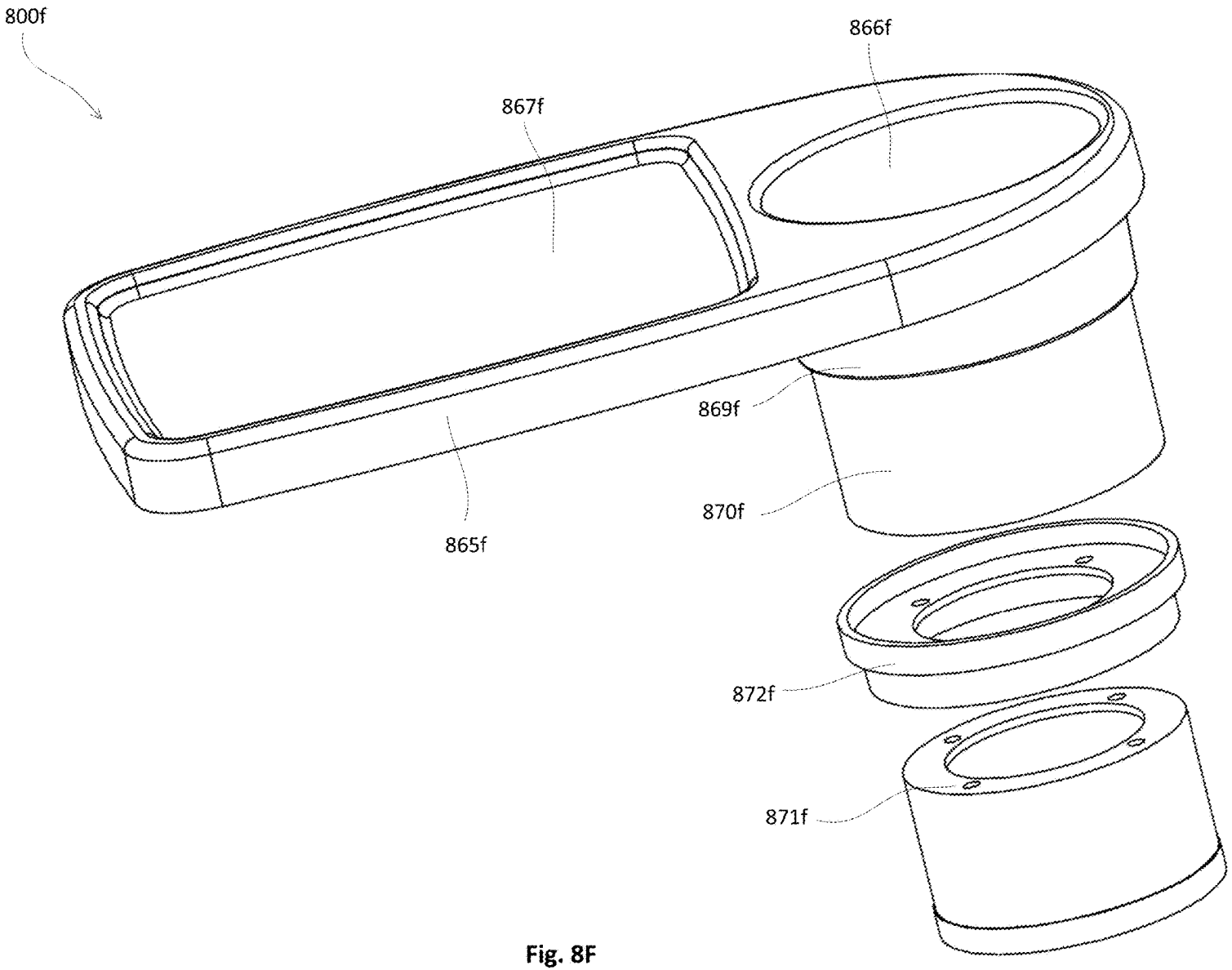
Figure 8G:
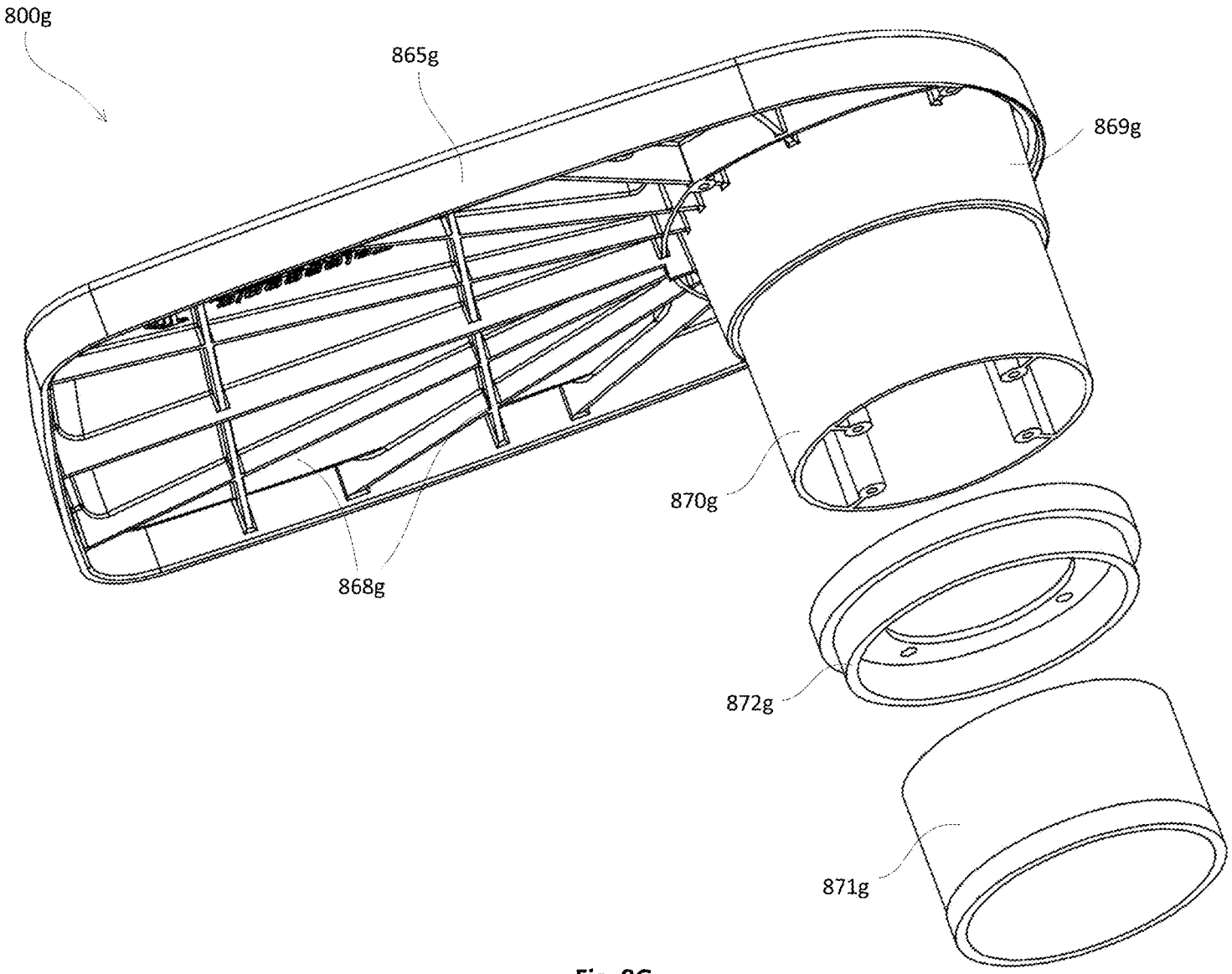
Figure 9A:
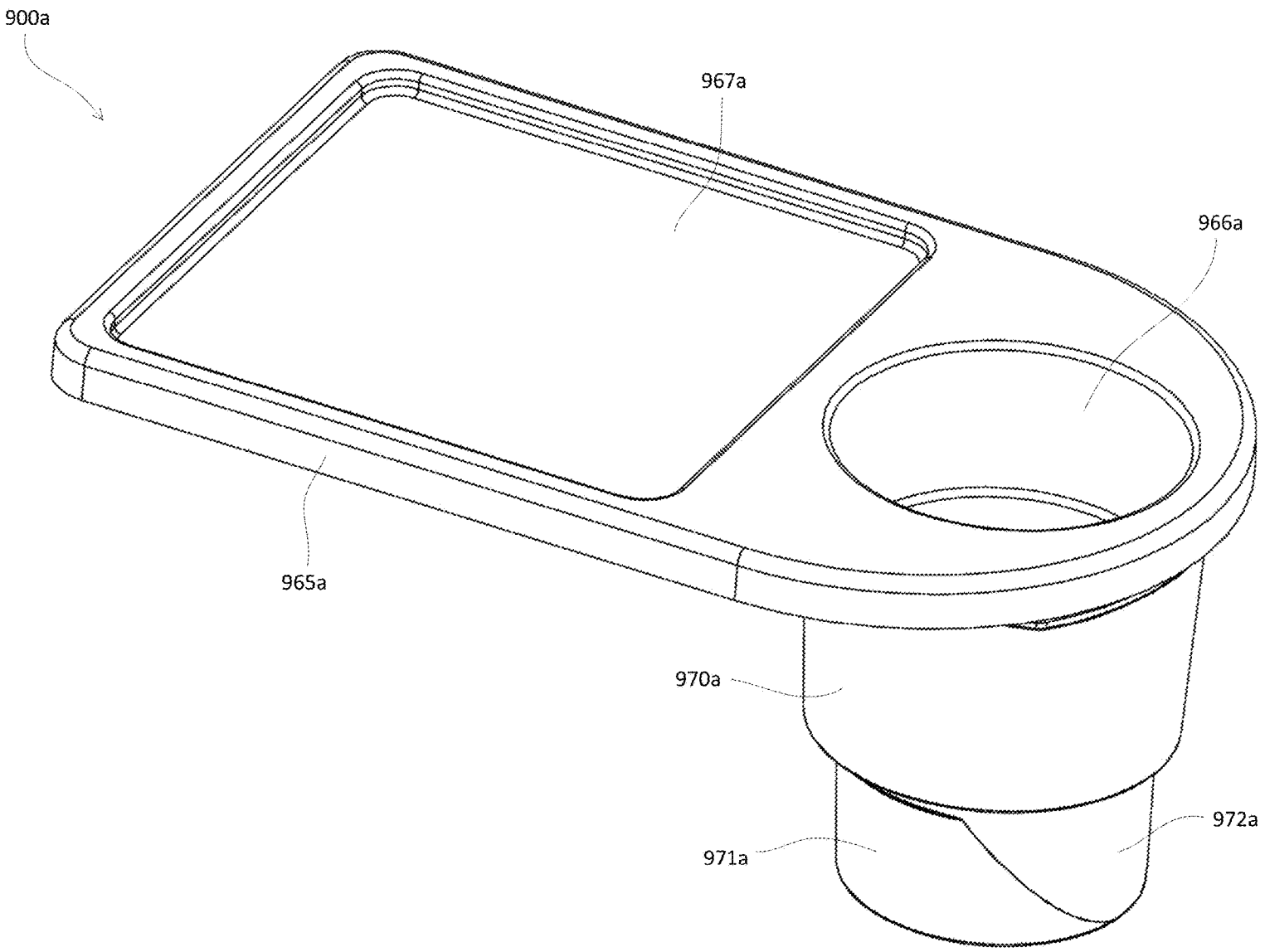
FIGS. 9A-G depict various view of an example removable tray assembly.
Figure 9B:
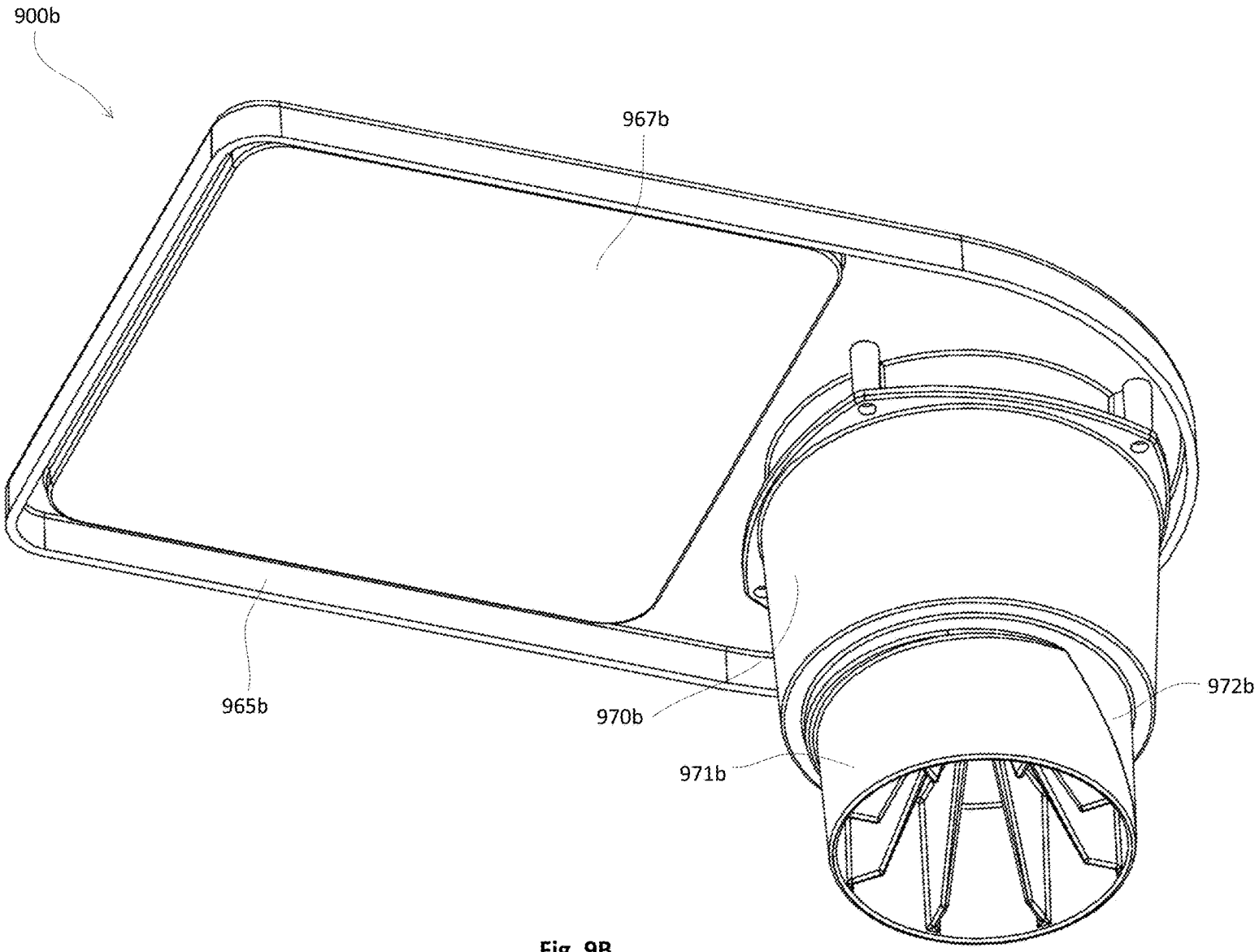
Figure 9C:
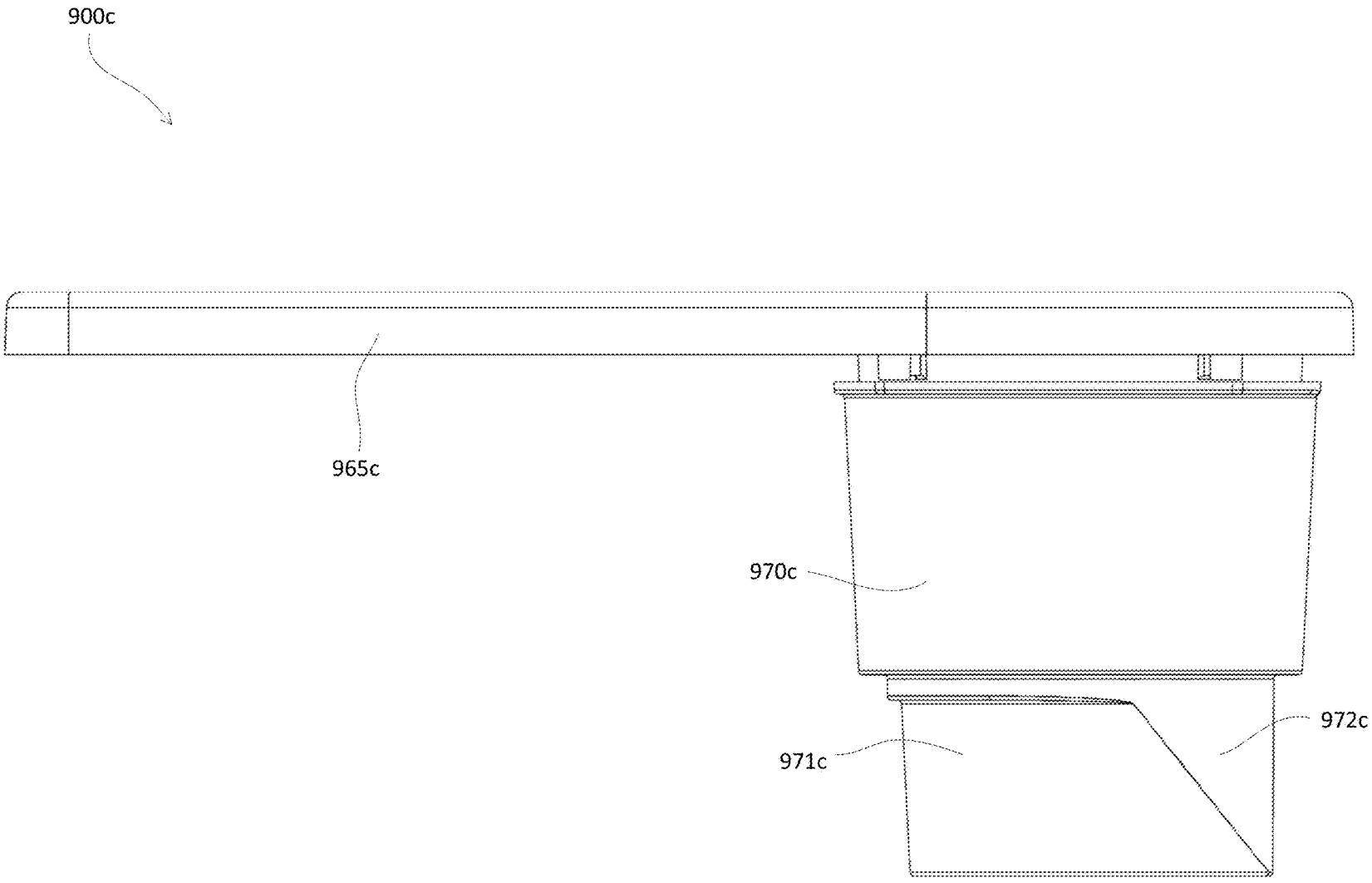
Figure 9D:
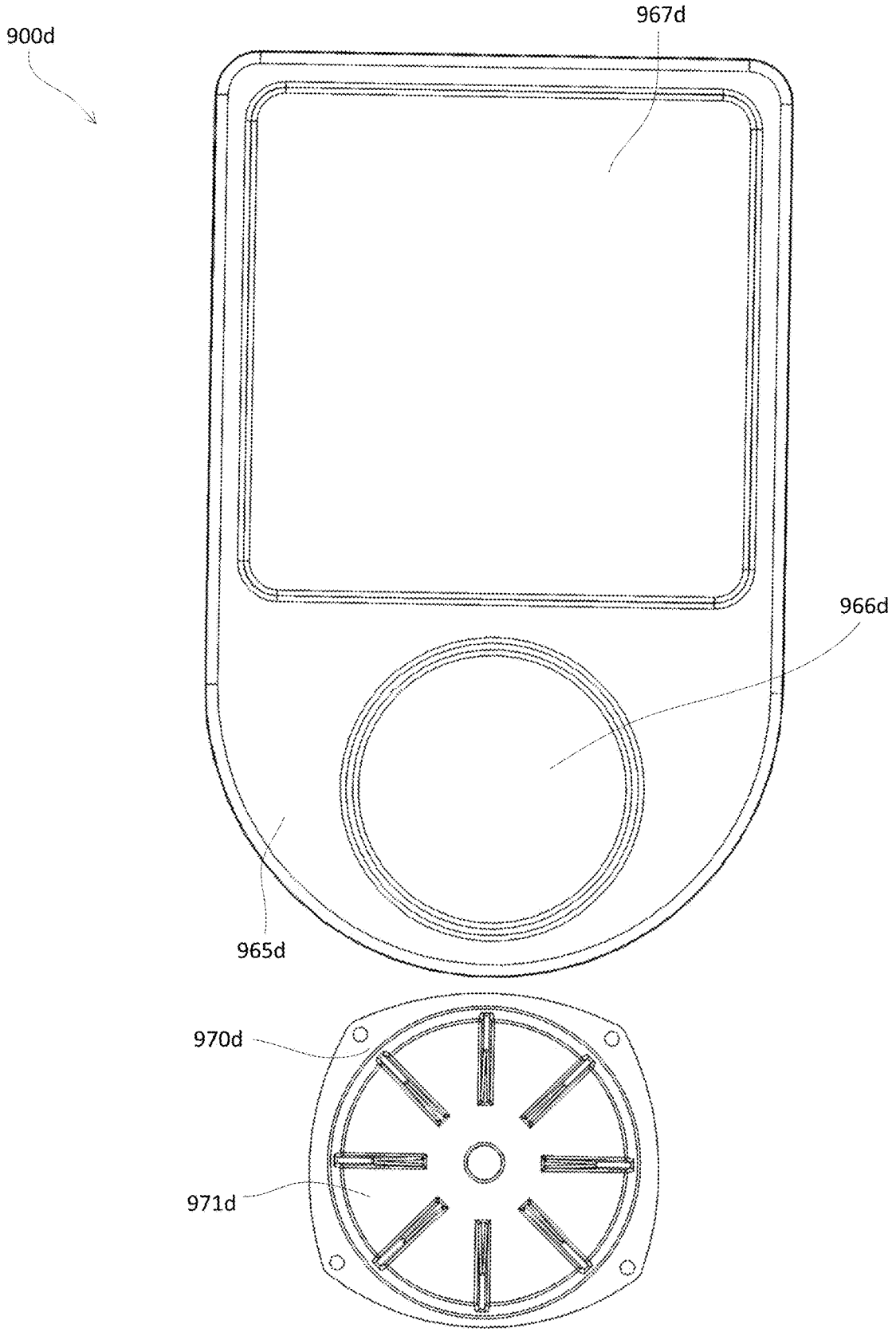
Figure 9E:
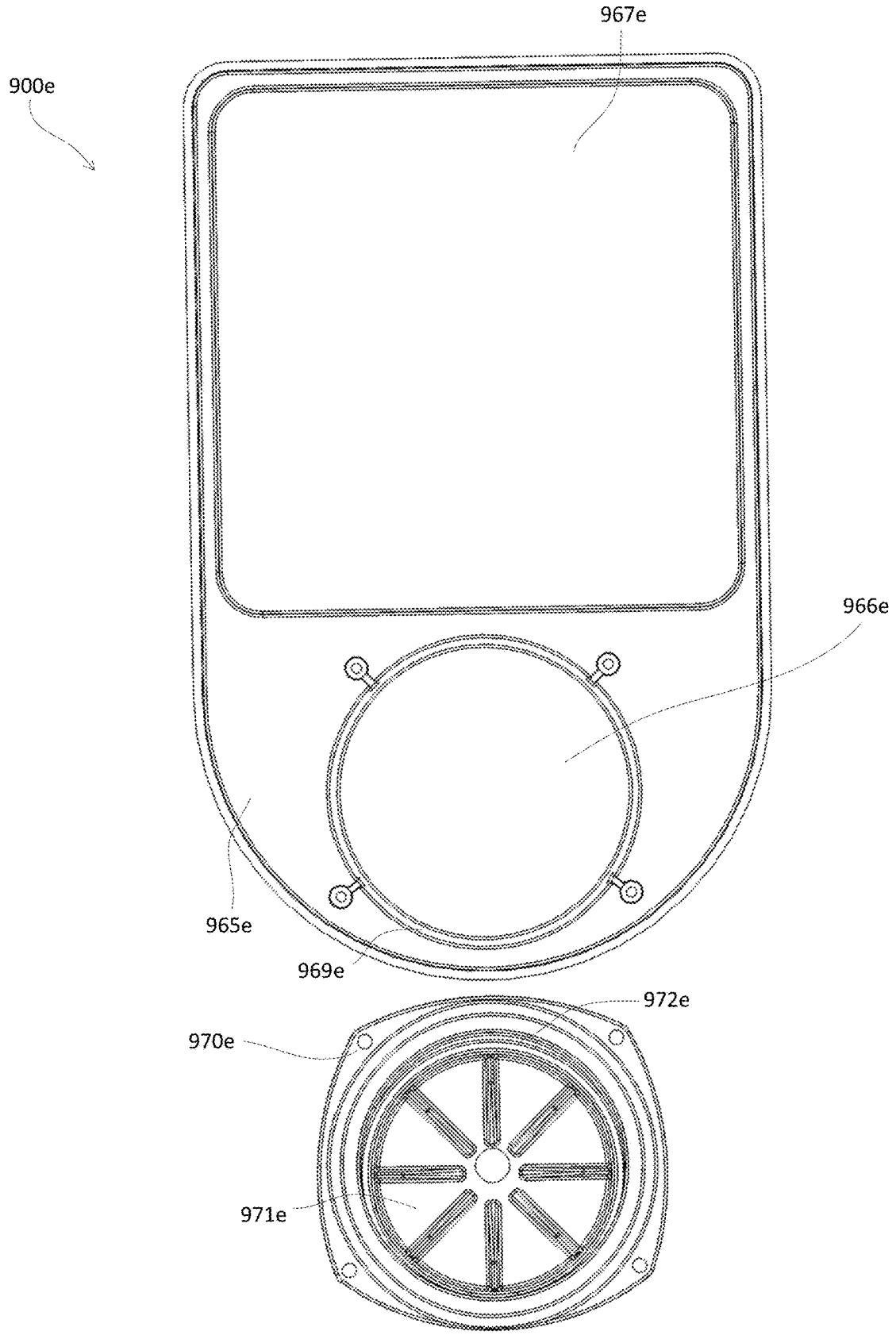
Figure 9F:
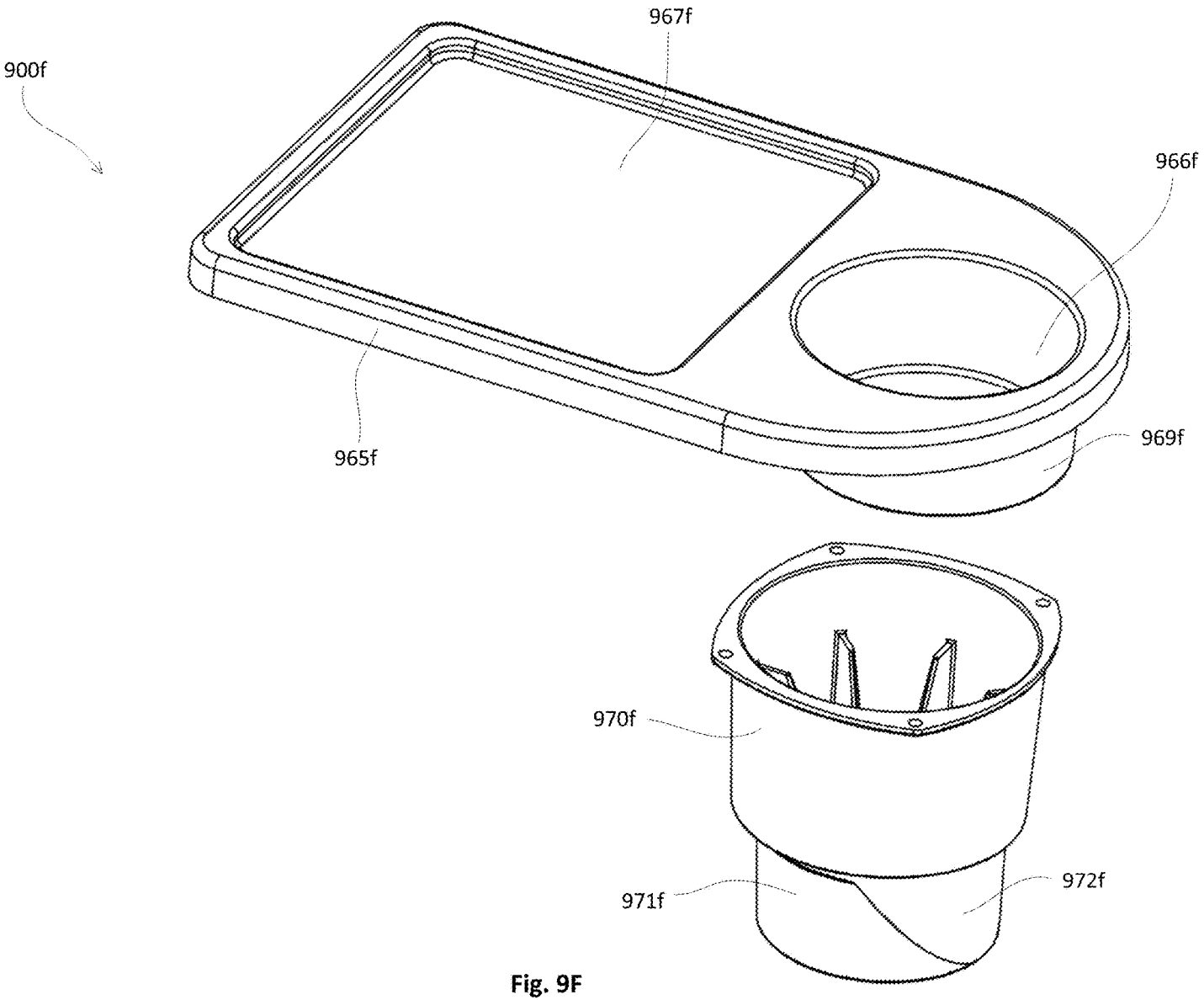
Figure 9G:
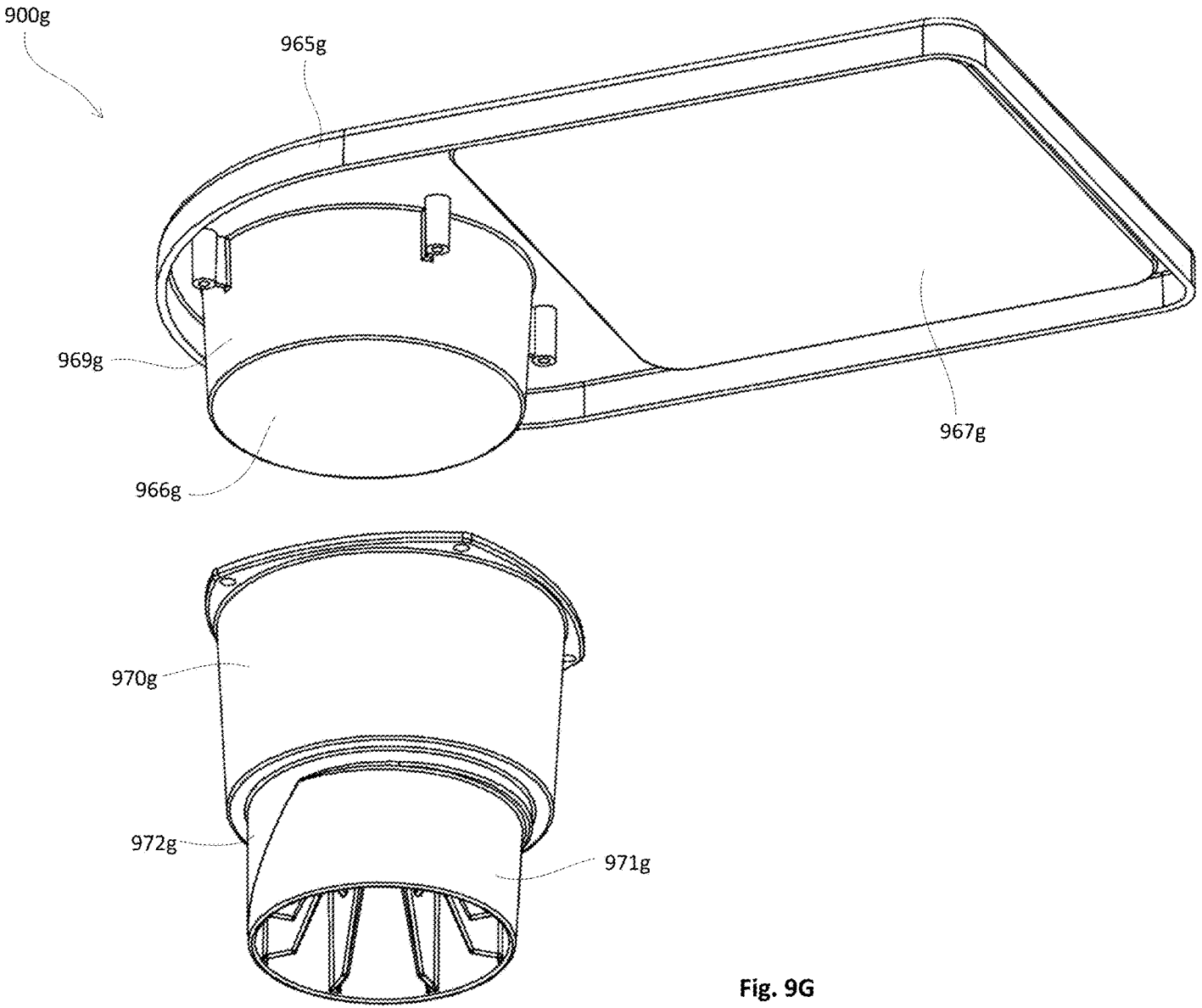

With reference to FIGS. 7A-H, J-N, P and Q, a removable tray assembly 700*a-h,j-n,p,q* may include a tray 765*a-j* having a recessed area 767*a,c,f,g,* strengthening ribs 768*b, dg,j,* a locating feature 773*b,d,e-h,j,* an adaptor 769*h,j,* and a cup receptacle 766*a,c,f,g,h,j.* The removable tray assembly 700*a-h,j-n,p,q* may also include a first cup holder extension post 770*a,b,d-h,j,* a second cup holder extension post 771*a, b,d-h,j,* and a cup holder adapter 772*a,b,d-h,j,l-n,p,q.* The removable tray assembly 700*a-h,j-n,p,q* may be removably and swivelably supported relative to an associated chair assembly (e.g., chair assembly 200 of FIG. 2) with the second cup holder extension post 771*a,b,d-h,j* and the cup holder adapter 772*a,b,d-h,j,l-n,p,q* inserted within a cup holder (e.g., cup holder 260 of FIG. 2). The cup holder adapter 772*a,b,d-h,j,l-n,p,q* may include a profile, as shown in any one of FIGS. 7A,B,D-H,J,L-N,P and Q, depending on a range of diameters of cup holders 260 to be accommodated. While the cup holder 260 is shown within an arm box of a powered recliner chair assembly 200 within FIG. 2, the removable tray assembly 700*a-h,j-n,p,q* may be configured to be removably and swivelably supported within a cup holder 260 of any type of chair assembly (e.g., a fixed position chair assembly, a rocker style chair assembly, a beam mounted chair assembly, a reconfigurable seating system chair assembly, etc.) such as those described within the patents and patent applications incorporated herein by reference thereto. The removable tray assembly 700*a-h,j-n, p,q* may resist a downward moment of something placed on the tray 765*a-j.* As illustrated in FIGS. 7A,B,D-H and J, the first cup holder extension post 770*a,b,d-h,j,* the second cup holder extension post 771*a,b,d-h,j,* and the cup holder adapter 772*a,b,d-h,j,l-n,p,q* of the cup holder post feature may be non-concentric (i.e., the cup holder adapter 772*a,b, d-h,j,l-n,p,q* is non-concentrically located on side of the second cup holder extension post 771*a,b,d-h,j* oriented toward the recess 767*a,c,f,h*). The first cup holder extension post 770*a,b,d-h,j* may include a locating feature 773*b,d,e-h,j* that may engage with the second cup holder extension post 771*a,b,d-h,j* to align the cup holder adapter 772*a,b,d-h,j,l-n,p,q* orientation toward the locating feature 773*b,d,e-h,j.*

While the first cup holder extension post 770*a,b,d-h,j,* the second cup holder extension post 771*a,b,d-h,j,* and the cup holder adapter 772*a,b,d-h,j,l-n,p,q* are illustrated within FIGS. 7A-H, J-N, P and Q as being three separate parts with respect to the tray 765*a-h,j,* all of the first cup holder extension post 770*a,b,d-h,j,* the second cup holder extension post 771*a,b,d-h,j,* and the cup holder adapter 772*a,b,d-h,j, l-n,p,q,* or any combination thereof may be formed as a unitary piece. Similarly, the first cup holder extension post 770*abd-h,j* may be integrally formed with an adaptor 769*h,j.* Alternatively, or additionally, the adaptor 769*h,j,* the first cup holder extension post 770*a,b,d-h,j,* the second cup holder extension post 771*a,b,d-h,j,* and/or the cup holder adapter 772*a,b,d-h,j,l-n,p,q* may include snap-connection features such that the adaptor 769*h,j,* the first cup holder extension post 770*a,b,d-h,j,* the second cup holder extension post 771*a,b,d-h,j,* and/or the cup holder adapter 772*a,b,d-h,j,l-n,p,q* may be snap-fit to one another.

Turning to FIGS. 8A-G, a removable tray assembly 800*a-g* may include a tray 865*a-g* having a recessed area 867*a,d,f,* a cup receptacle 866*a,d,e,f,* strengthening ribs 868*b,e,g,* an alignment feature 873*c,* and an adapter 869*a-c,e-g.* The removable tray assembly 800*a-g* may include a first cup holder extension 870*a-g*, an adaptor ring 872*a-g*, and a second cup holder extension 871*a-g* configured to, for example, accommodate a range of different cup holders 260. Thereby, the removable tray assembly 800*a-g* may resist downward moment of something placed on the snack tray 865*a-g*. The first cup holder extension 870*a-g*, the adaptor ring 872*a-g*, and the second cup holder extension 871*a-g* may reduce in size for different components (e.g., ring vs entire part). This may allow the removable tray assembly 800*a-g* to fit different size cup holders. The first cup holder extension 870*a-g*, the adaptor ring 872*a-g*, and the second cup holder extension 871*a-g* may be concentric with respect to the adaptor 969*b,cd-g* and/or with respect to one-another.

While the adaptor 869*a-c,e-g*, the first cup holder extension 870*a-g*, the adaptor ring 872*a-g*, and the second cup holder extension 871*a-g* are illustrated within FIGS. 8A-G as four separate components, all of, or any combination thereof, may be formed integrally. Alternatively, or additionally, the adaptor 869*a-c,e-g*, the first cup holder extension 870*a-g*, the adaptor ring 872*a-g*, and/or the second cup holder extension 871*a-g* may include snap-fit features such that, for example, the adaptor 869*a-c,e-g*, the first cup holder extension 870*a-g*, the adaptor ring 872*a-g*, and/or the second cup holder extension 871*a-g* may be removably snapped together.

With reference to FIGS. 9A-G, a removable tray assembly 900*a-g* may include a tray 965*a-g* having a recessed area 967*a,b,d-g*, a cup receptacle 966*a,c-g*, and an adapter 969*b,c,e-g*. The removable tray assembly 900*a-g* may include a cup holder extension 970*a-g* having a non-concentric adaptor 972*a-c,e-g* located on a lower portion 971*a-g* of the cup holder extension 970*a-g* configured to, for example, accommodate a range of different cup holders 260. Thereby, the removable tray assembly 900*a-g* may resist downward moment of something placed on the snack tray 965*a-g*. The cup holder extension 970*a-g* having a non-concentric adaptor 972*a-c,e-g* located on a lower portion 971*a-g* of the cup holder extension 970*a-g* may reduce in size for different components. This may allow the removable tray assembly 900*a-g* to fit different size cup holders 260.

While the adaptor 969*b,c,e-g* and the cup holder extension 970*a-g* having a non-concentric adaptor 972*a-c,e-g* located on a lower portion 971*a-g* of the cup holder extension 970*a-g* are illustrated within FIGS. 8A-G as two separate components, all of, or any combination thereof, may be formed integrally, or separately. Alternatively, or additionally, the adaptor 969*b,c,e-g* and the cup holder extension 970*a-g* having a non-concentric adaptor 972*a-c,e-g* located on a lower portion 971*a-g* of the cup holder extension 970*a-g* may include snap-fit features such that, for example, the adaptor 969*b,c,e-g* and the cup holder extension 970*a-g* having a non-concentric adaptor 972*a-c,e-g* located on a lower portion 971*a-g* of the cup holder extension 970*a-g* may be removably snapped together.

The tray assemblies of FIGS. 7A-H,J-N,P and Q, 8A-G and 9A-G may resist downward moment of something placed on a respective snack tray surface. The tray assemblies of FIGS. 7A-H,J-N,P and Q, 8A-G and 9A-G may work with different cup holders of a wide variety of manufactures by changing the adapter rings to fit a respective inside diameter of a respective cup holder, or range of cup holders. The tray assemblies of FIGS. 7A-H,J-N,P and Q, 8A-G and 9A-G may include a cup engagement feature that may be disassembled and modified to define a multi-cup holder engagement feature. A cup engagement feature may be modified by different size components (diameter or height or concentric offset) and/or may include addition of adaptor rings and/or adaptors at multiple locations to improve the engagement within a respective cup holder.

Figure 10:
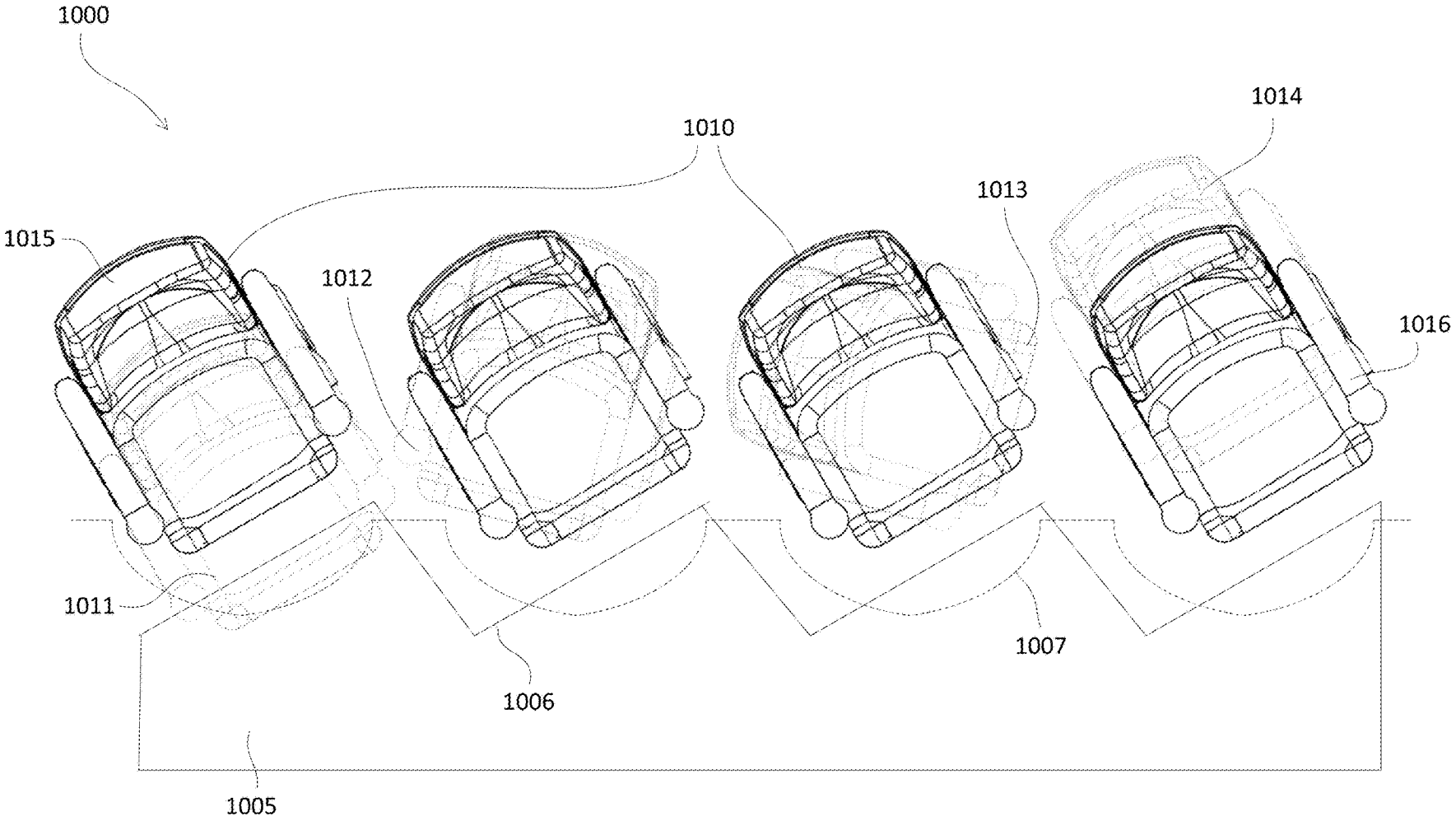
FIG. 10 depicts an example chair assembly/table assembly.

Turning to FIG. 10, a chair assembly/table assembly 1000 may include a plurality of chair assemblies 1010 proximate a table assembly 1005. Any given chair assembly 1010 may include a biased orientation 1015 which may be, for example, an orientation to which the chair assembly 1010 automatically reorients when not reoriented by a user. For example, a chair assembly 1010 may include a biasing spring (not shown in FIG. 10) configured to automatically reorient a respective chair assembly 1010 to the biased orientation 1015. Any given biased orientation 1015 may be, for example, predetermined by a chair manufacturer. Alternatively, or additionally, any given biased orientation 1015 may be user selectable. In any event, a chair assembly 1010 may be linearly reorientable from the biased orientation 1015 to a rearward orientation 1014 and/or to a forward orientation 1011. Similarly, a chair assembly 1010 may be rotationally reorientable from the biased orientation 1015 to a right-hand rotation orientation 1012 and/or to a left-hand rotation orientation 1013. Any given chair assembly 1010 may be configured to rotate 360°. Additionally, or alternatively, a chair assembly 1010 may include a pivotable chair seat and/or any other features as disclosed in, for example, commonly assigned U.S. Pat. Nos. 10,070,724, 9,943,174, 9,730,518, 9,655,458, 9,993,080, 9,808,085, 9,631,384, 9,526,340, 9,326,610, 9,693,631, and 9,693,630, the entire disclosures of which are incorporated herein by reference thereto.

The table assembly 1005 may include, for example, an edge (e.g., a saw-tooth edge 1006, an edge with a series of concave spaces 1007, a semi-circular edge, an elliptical edge, a straight edge, etc.) orientated toward the chair assemblies 1010. While not shown in FIG. 10, a table assembly 1005 may include linearly sliding and/or rotationally reorientable portions (e.g., similar to the linear slide and/or rotational reorientation of the table assembly 600*a-e* of FIGS. 6A-6E). In any event, the table assembly 1005 may be incorporated into a venue 100*b-g* (e.g., within a box seating area, within a deck area, within a dine-in area, within a loge, etc.). Either the chair assemblies 1010, the table assembly 1005, or both may be reorientable or fixed in place.

A chair assembly/table assembly 1000 may be, for example, arranged in groups to facilitate fan interaction between chair occupants. A chair assembly/table assembly 1000 may be, for example, arranged to facilitate event watching/participation. A chair assembly/table assembly 1000 may be, for example, arranged to facilitate server access while patron occupied while minimizing total space. An example of this is the previously disclosed spring return and/or combination(s) of linear and rotary motions. A chair assembly/table assembly 1000 may be, for example, arranged to facilitate improved sight lines by having egress and or server access ways on different levels. A chair assembly/table assembly 1000 may be, for example, arranged to facilitate access from the rear. A chair assembly/table assembly 1000 may be, for example, arranged to facilitate access from the front. A chair assembly/table assembly 1000 may be, for example, arranged to facilitate access from the side. A chair assembly/table assembly 1000 may be, for example, arranged to facilitate a combination of above.

Figure 11A:
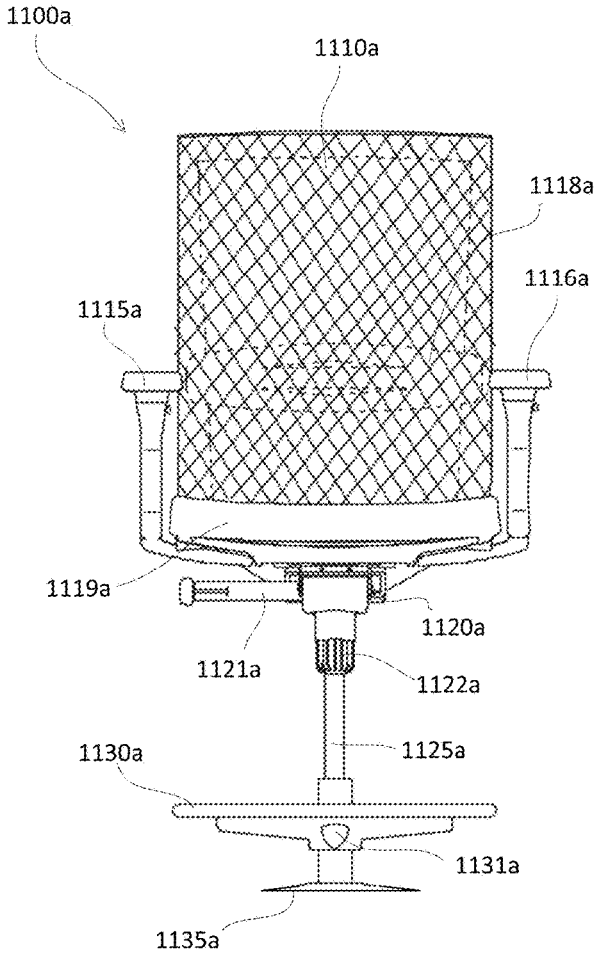
FIGS. 11A and B depict example chair assemblies having mesh fabric chair backs and/or chair seats.
Figure 11B:
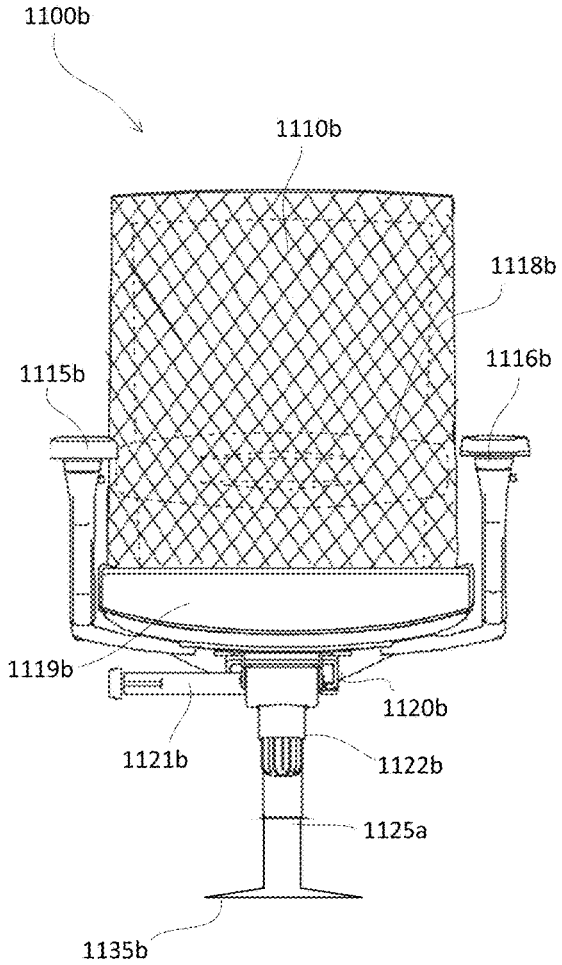

With reference to FIGS. 11A and B, chair assemblies 1100*a,b* may include a mesh fabric chair back 1010*a,b* and/or a mesh fabric chair seat 1019*a,b*. The chair assemblies 1100*a,b* may be similar to, for example, the chair assemblies 145*b-g* of FIGS. 1B-G or 1010 of FIG. 10. The chair assemblies 1100*a,b* may include a lower lumbar support 1118*a,b* (e.g., a mechanically repositionable lower lumbar support, an inflatable lower lumbar support, etc.). The chair assemblies 1100*a,b* may include a first arm rest 1115*a,b* and a second arm rest 1116*a,b*. The chair assemblies 1100*a,b* may include a mechanism 1120*a,b* that may be, for example, configured to provide linear and/or rotational reorientation of the chair assembly 1100*a,b*. Additionally, or alternatively, the mechanism 1120*a,b* may be, for example, configured to provide recliner and/or rocker functionality. In any event, a chair assembly 1100*a,b* may include a first user selectable adjustment (e.g., a linear movement adjustment, a rotational movement adjustment, a recline adjustment, or a rocker adjustment) 1121*a,b* and a second user selectable adjustment (e.g., a linear movement adjustment, a rotational movement adjustment, a recline adjustment, or a rocker adjustment) 1122*a,b*. A chair assembly 1100*a,b* may include a support structure 1125*a,b* attached to a mounting foot 1135*a,b*. The support structure 1125*a,b* may be, for example, telescopic and enable a user to raise/lower the chair assembly 1100*a,b*. The first or second user selectable adjustment 1121*a,b*, 1122*a,b* may allow a user to adjust a height of the chair assembly 1100*a,b*. The chair assembly 1100*a* may include a foot rest 1130*a*. The foot rest 1130*a* may include a height adjustment 1131*a*.

Figure 12:
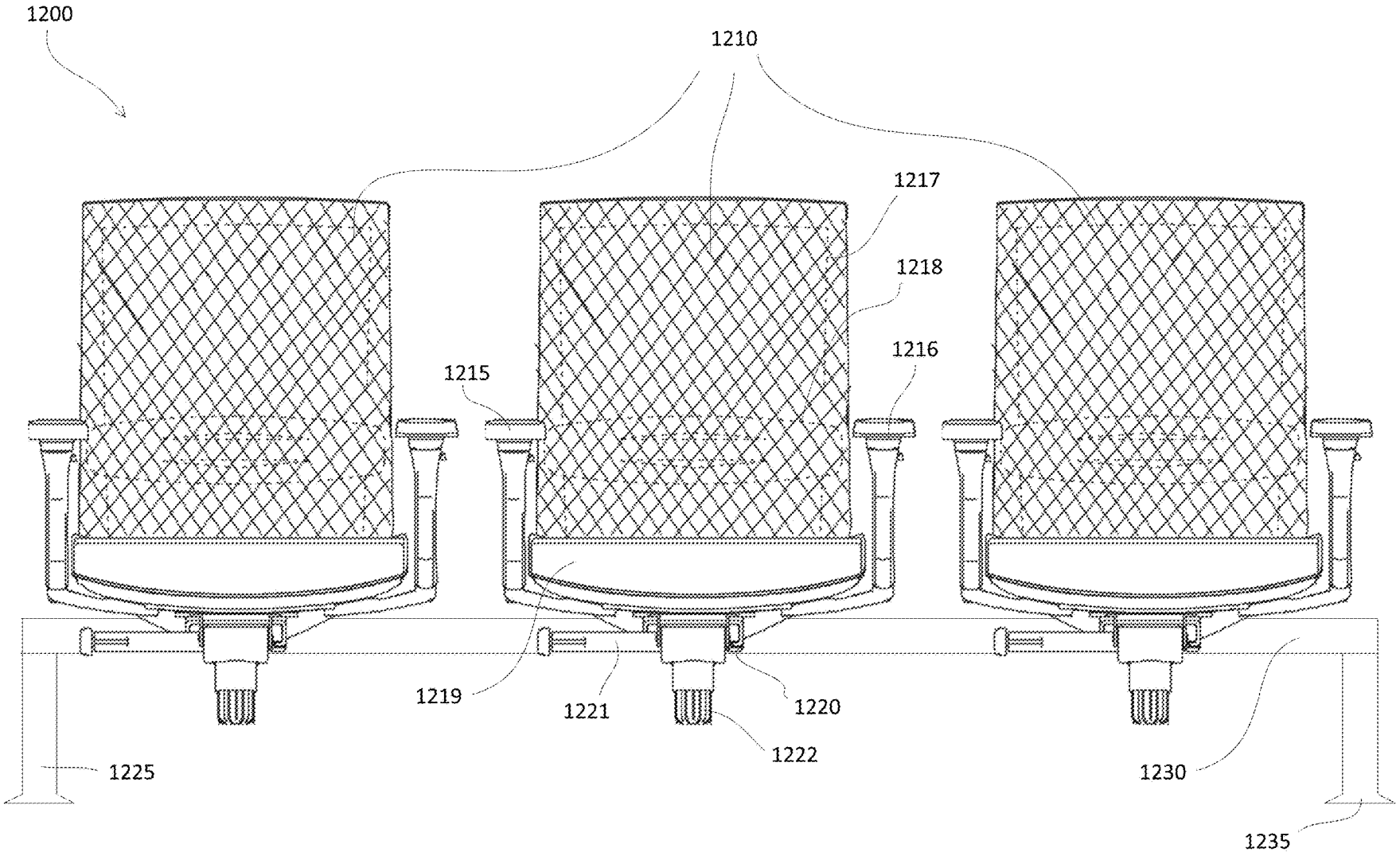
FIG. 12 depicts an example beam mounted chair assembly with chair assemblies having mesh fabric chair backs and/or chair seats.

Turning to FIG. 12, a beam mounted chair assembly 1200 may include chair assemblies 1210 having mesh fabric chair backs 1217 and/or chair seats 1219. A beam mounted chair assembly may be similar to, for example, a beam mounted chair assembly as disclosed in any one of commonly assigned U.S. Pat. Nos. 9,693,630, 9,808,085, 9,631,384, and 9,993,080, the entire disclosures of which are incorporated herein by reference thereto. The chair assemblies 1210 may be similar to, for example, the chair assemblies 1010 of FIG. 10 or 1100*a,b* of FIGS. 11A and B. The chair assemblies 1210 may include a lower lumbar support 1218 (e.g., a mechanically repositionable lower lumbar support, an inflatable lower lumbar support, etc.). The chair assemblies 1210 may include a first arm rest 1215 and a second arm rest 1215. The chair assemblies 1210 may include a mechanism 1220 that may be, for example, configured to provide linear and/or rotational reorientation of the chair assembly 1210. Additionally, or alternatively, the mechanism 1220 may be, for example, configured to provide recliner and/or rocker functionality. In any event, a chair assembly 1210 may include a first user selectable adjustment (e.g., a linear movement adjustment, a rotational movement adjustment, a recline adjustment, or a rocker adjustment) 1221 and a second user selectable adjustment (e.g., a linear movement adjustment, a rotational movement adjustment, a recline adjustment, or a rocker adjustment) 1222. A beam mounted chair assembly 1200 may include a plurality of chair assemblies 1210 supported on a beam 1230. The beam 1230 may be supported by at least one support structure 1225 attached to a mounting foot 1235. The support structure 1125*a,b* may be, for example, telescopic and enable a user to raise/lower the chair assembly 1100*a,b*.

Figure 13A:
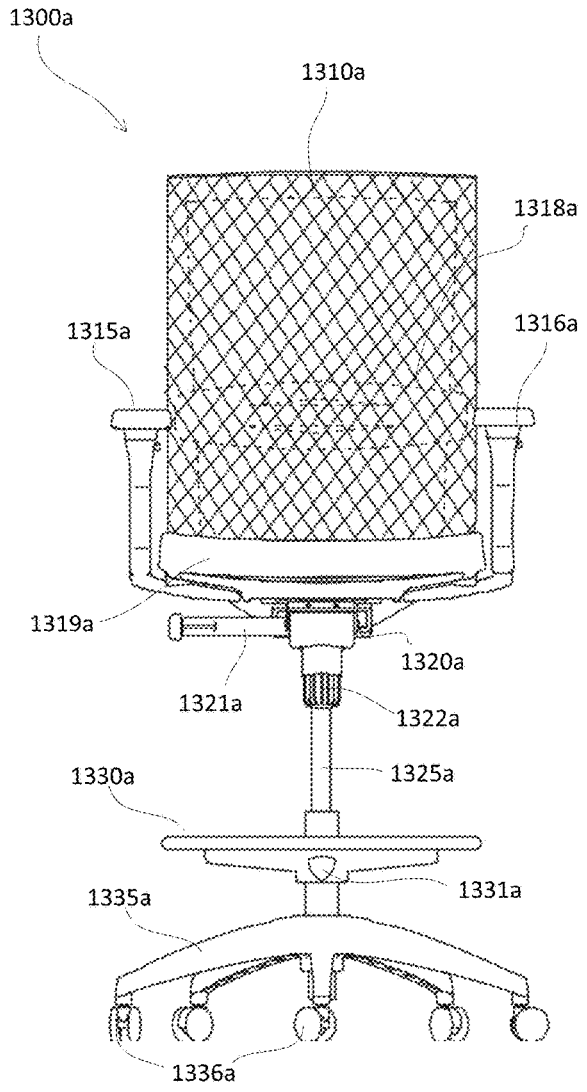
FIGS. 13A and B depict an example chair assembly having a mesh fabric chair back and/or chair seat.
Figure 13B:
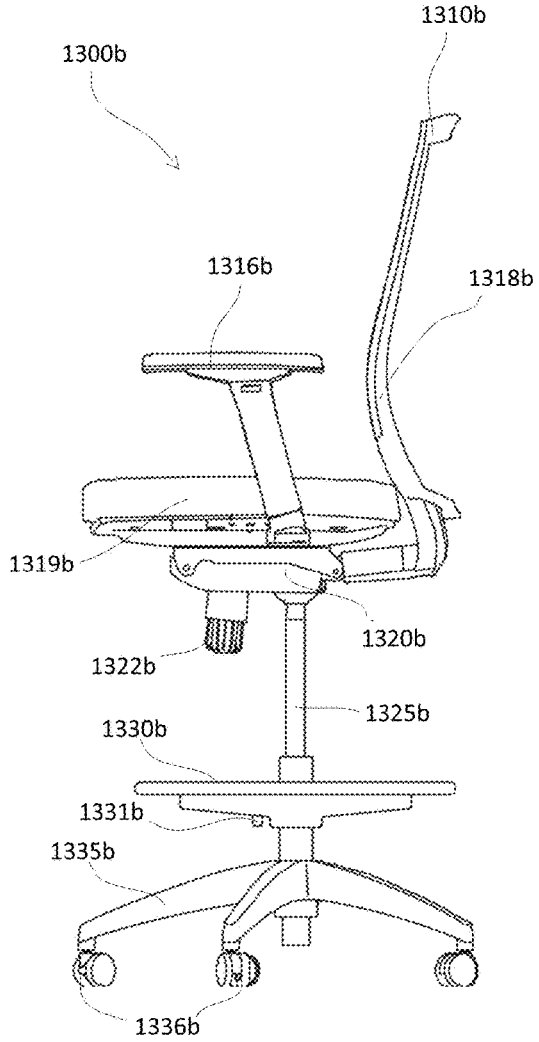

With reference to FIGS. 13A and 13B, chair assemblies 1300*a, b* may include a mesh fabric chair back 1310*a,b* and/or a mesh fabric chair seat 1319*a,b*. The chair assemblies 1300*a,b* may be similar to, for example, the chair assemblies 148*b-g* of FIGS. 1B-G or 1010 of FIG. 10. The chair assemblies 1300*a,b* may include a lower lumbar support 1318*a,b* (e.g., a mechanically repositionable lower lumbar support, an inflatable lower lumbar support, etc.). The chair assemblies 1300*a,b* may include a first arm rest 1315*a* and a second arm rest 1316*a,b*. The chair assemblies 1300*a,b* may include a mechanism 1320*a,b* that may be, for example, configured to provide linear and/or rotational reorientation of the chair assembly 1300*a,b*. Additionally, or alternatively, the mechanism 1320*a,b* may be, for example, configured to provide recliner and/or rocker functionality. In any event, a chair assembly 1300*a,b* may include a first user selectable adjustment (e.g., a linear movement adjustment, a rotational movement adjustment, a recline adjustment, or a rocker adjustment) 1321*a* and a second user selectable adjustment (e.g., a linear movement adjustment, a rotational movement adjustment, a recline adjustment, or a rocker adjustment) 1322*a,b*. A chair assembly 1300*a,b* may include a support structure 1325*a,b* attached to a caster structure 1335*a,b*. The caster structure 1335*a,b* may include a plurality of casters 1336*a,b*. The support structure 1325*a,b* may be, for example, telescopic and enable a user to raise/lower the chair assembly 1300*a,b*. The first or second user selectable adjustment 1321*a*, 1322*a,b* may allow a user to adjust a height of the chair assembly 1300*a,b*. The chair assembly 1300*a,b* may include a foot rest 1330*a,b*. The foot rest 1330*a,b* may include a height adjustment 1331*a,b*.

Figure 14A:
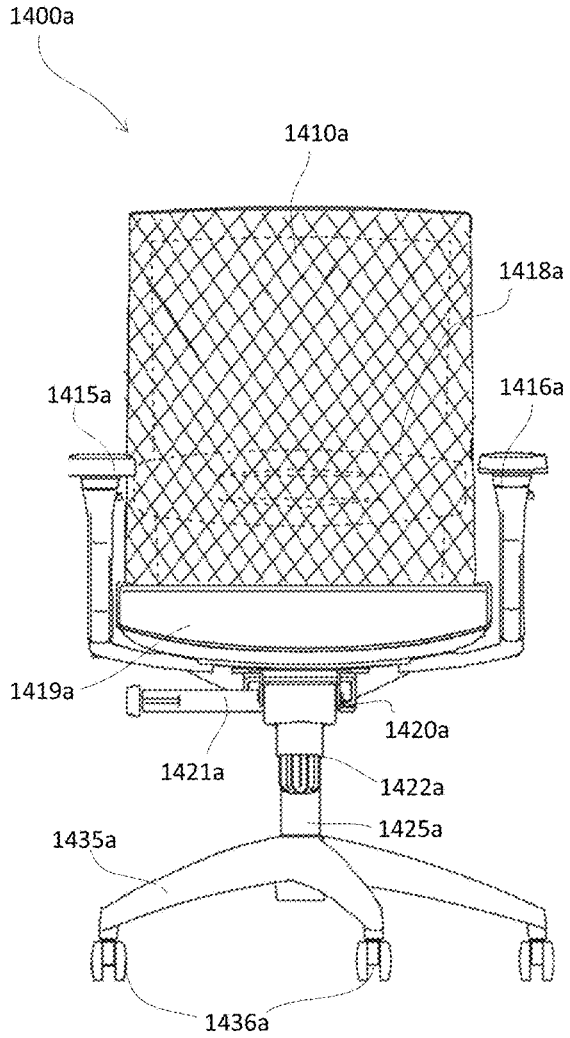
FIGS. 14A and B depict an example chair assembly having a mesh fabric chair back and/or chair seat.
Figure 14B:
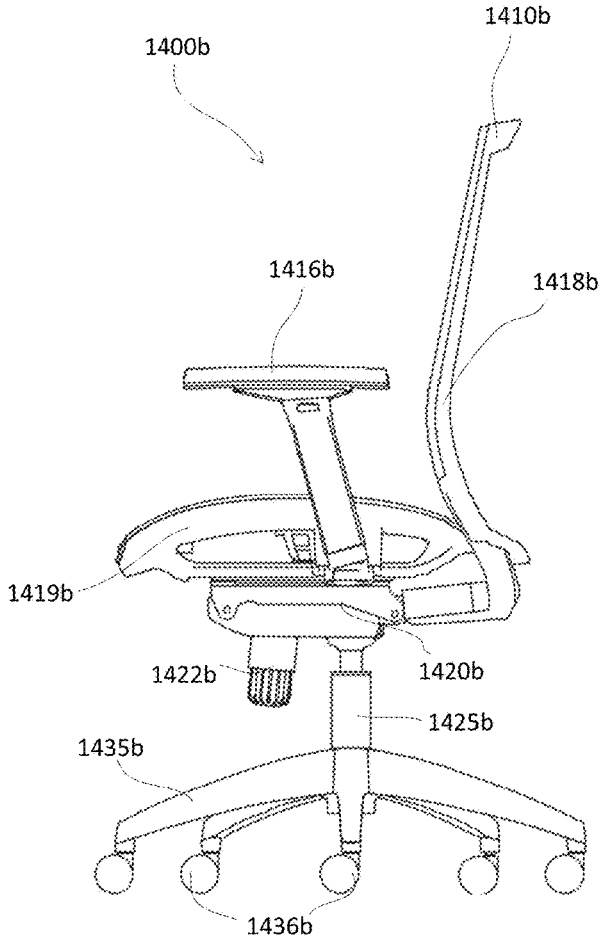

Turning to FIGS. 14A and B, chair assemblies 1400*a,b* may include a mesh fabric chair back 1410*a,b* and/or a mesh fabric chair seat 1419*a,b*. The chair assemblies 1400*a,b* may be similar to, for example, the chair assemblies 148*b-g* of FIGS. 1B-G or 1010 of FIG. 10. The chair assemblies 1400*a,b* may include a lower lumbar support 1418*a,b* (e.g., a mechanically repositionable lower lumbar support, an inflatable lower lumbar support, etc.). The chair assemblies 1400*a,b* may include a first arm rest 1415*a* and a second arm rest 1416*a,b*. The chair assemblies 1400*a,b* may include a mechanism 1420*a,b* that may be, for example, configured to provide linear and/or rotational reorientation of the chair assembly 1400*a,b*. Additionally, or alternatively, the mechanism 1420*a,b* may be, for example, configured to provide recliner and/or rocker functionality. In any event, a chair assembly 1400*a,b* may include a first user selectable adjustment (e.g., a linear movement adjustment, a rotational movement adjustment, a recline adjustment, or a rocker adjustment) 1421*a* and a second user selectable adjustment (e.g., a linear movement adjustment, a rotational movement adjustment, a recline adjustment, or a rocker adjustment) 1422*a,b*. A chair assembly 1400*a,b* may include a support structure 1425*a,b* attached to a mounting structure 1435*a,b*. The support structure 1425*a,b* may be, for example, telescopic and enable a user to raise/lower the chair assembly 1400*a,b*. The first or second user selectable adjustment 1421*a*, 1422*a,b* may allow a user to adjust a height of the chair assembly 1400*a,b*.

With reference to FIGS. 15A-D, a dolly and mobile chair and table assembly 1500*a-d* may include a chair assembly 1535*d* and a table assembly 1540*d* mounted to a dolly. The chair assembly 1535*d* may be similar to, for example, any one of the chair assemblies 145*b-g* of FIGS. 1B-G, 200 of FIG. 2, or as disclosed in, for example, commonly assigned U.S. Pat. Nos. 10,070,724, 9,943,174, 9,730,518, 9,655,458, 9,993,080, 9,808,085, 9,631,384, 9,526,340, 9,326,610, 9,693,631, and 9,693,630, the entire disclosures of which are incorporated herein by reference thereto. The table assembly 1540*d* may be similar to, for example, any one of the table assemblies 146*b-g* of FIGS. 1B-G or the table assembly 600*a-e* of FIGS. 6A-E. The chair assembly 1535*d* may be, for example, attached to the dolly via a chair mount 1505*a, b,d* and a combination chair/table mount 1525*b-d*. The table assembly 1540*d* may be, for example, attached to the dolly via a table attachment 1530*b,d* of the combination chair/table mount 1525*b-d*.

The chair mount 1505*a,b,d* and the combination chair/table mount 1525*b-d* may be secured together via, for example, cross members 1515*a-c*. The chair mount 1505*a, b,d* and the combination chair/table mount 1525*b-d* may include retractable casters 1510*a,c*. The retractable casters 1510*a,c* may be repositioned via a respective raise/lower mechanism 1520*b*. The chair mount 1505*a,b,d* and the combination chair/table mount 1525*b-d* may be similar to, for example, the mechanisms as illustrated and described with respect to FIGS. 42A-C of commonly assigned U.S. patent application Ser. No. 16/181,585, the entire disclosure of which is incorporated herein by reference thereto.

Turning to FIGS. 16A-D, a dolly and mobile multi-chair and multi-table assembly 1600*a-d* may include a first chair assembly 1635*d*, a second chair assembly 1645*d*, and a dual table assembly 1540*d*, 1550*d* mounted to a dolly. The chair assemblies 1635*d*, 1645*d* may be similar to, for example, any one of the chair assemblies 145*b-g* of FIGS. 1B-G, 200 of FIG. 2, or as disclosed in, for example, commonly assigned U.S. Pat. Nos. 10,070,724, 9,943,174, 9,730,518, 9,655,458, 9,993,080, 9,808,085, 9,631,384, 9,526,340, 9,326,610, 9,693,631, and 9,693,630, the entire disclosures of which are incorporated herein by reference thereto. The dual table assembly 1640*d*, 1650*d* may be similar to, for example, any one of the table assemblies 146*b-g* of FIGS. 1B-G or the table assembly 600*a-e* of FIGS. 6A-E. The first chair assembly 1635*d* may be, for example, attached to the dolly via a first chair mount 1605*a,b,d* and a combination chair/table mount 1625*b,c*. The second chair assembly 1645*d* may be, for example, attached to the dolly via a second chair mount 1605*a,b,d* and the combination chair/table mount 1625*b,c*. The dual table assembly 1640*d*, 1650*d* may be, for example, attached to the dolly via a table attachment 1630*b,d* of the combination chair/table mount 1625*b-d*.

The first and second chair mounts 1605*a,b,d* and the combination chair/table mount 1625*b-d* may be secured together via, for example, cross members 1615*a-c*. The chair mounts 1605*a,b,d* and the combination chair/table mount 1625*b-d* may include retractable casters 1610*a,c*. The retractable casters 1610*a,c* may be repositioned via a respective raise/lower mechanism 1620*b*. The chair mounts 1605*a, b,d* and the combination chair/table mount 1625*b-d* may be similar to, for example, the mechanisms as illustrated and described with respect to FIGS. 42A-C of commonly assigned U.S. patent application Ser. No. 16/181,585, the entire disclosure of which is incorporated herein by reference thereto.

Figure 17A:
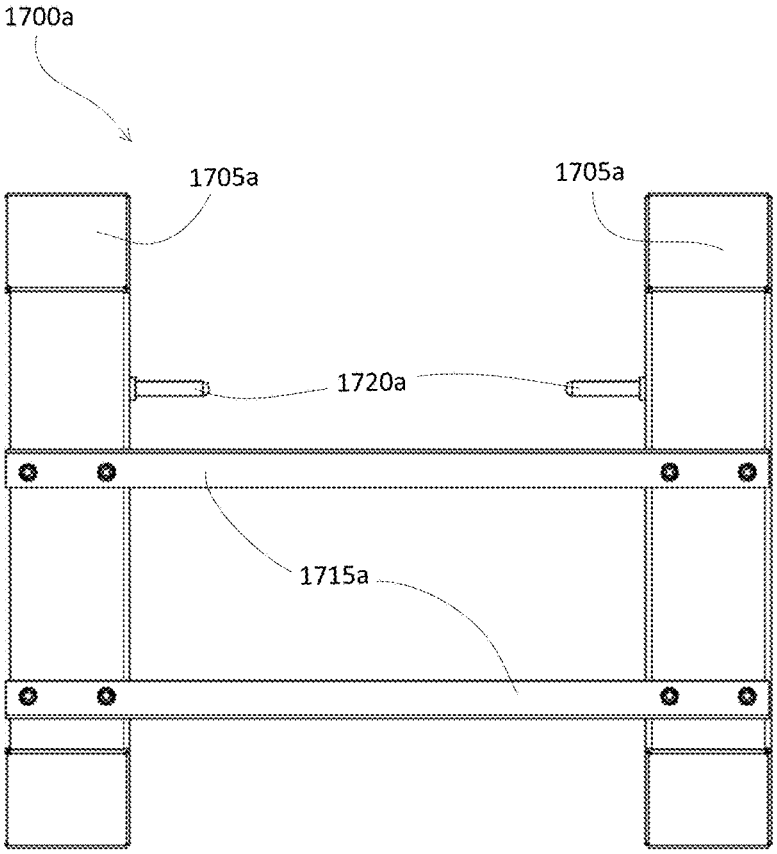
FIGS. 17A-C depict various views of an example chair assembly dolly.
Figure 17C:
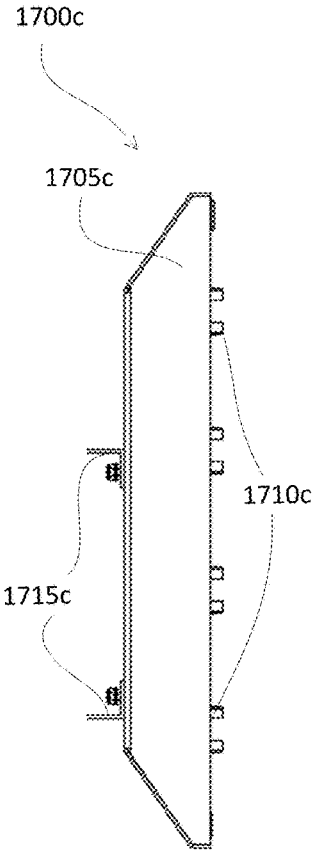
Figure 17B:
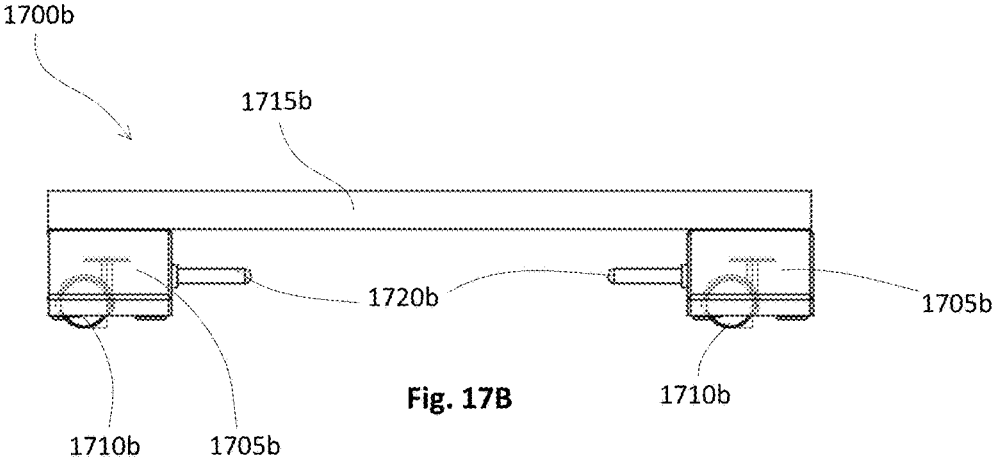

With reference to FIGS. 17A-C, a chair assembly dolly 1700*a-c* may include first and second chair mounts 1705*a-c* secured together via, for example, cross members 1715*a-c*. The chair mounts 1705*a-c* may include retractable casters 1710*b,c*. The retractable casters 1710*b,c* may be repositioned via a respective raise/lower mechanism 1720*a,b*. The chair mounts 1705*a-c* may be similar to, for example, the mechanisms as illustrated and described with respect to FIGS. 42A-C of commonly assigned U.S. patent application Ser. No. 16/181,585, the entire disclosure of which is incorporated herein by reference thereto.

Figure 18B:
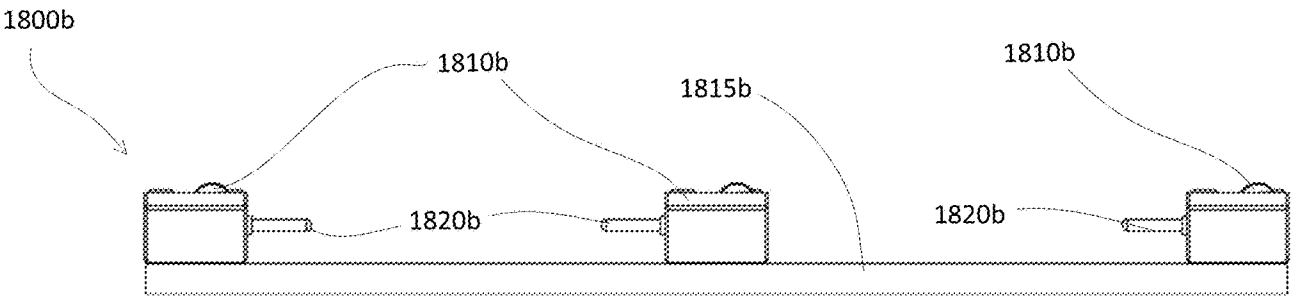
FIGS. 18A-C depict various views of an example multi-chair assembly dolly.
Figure 18A:
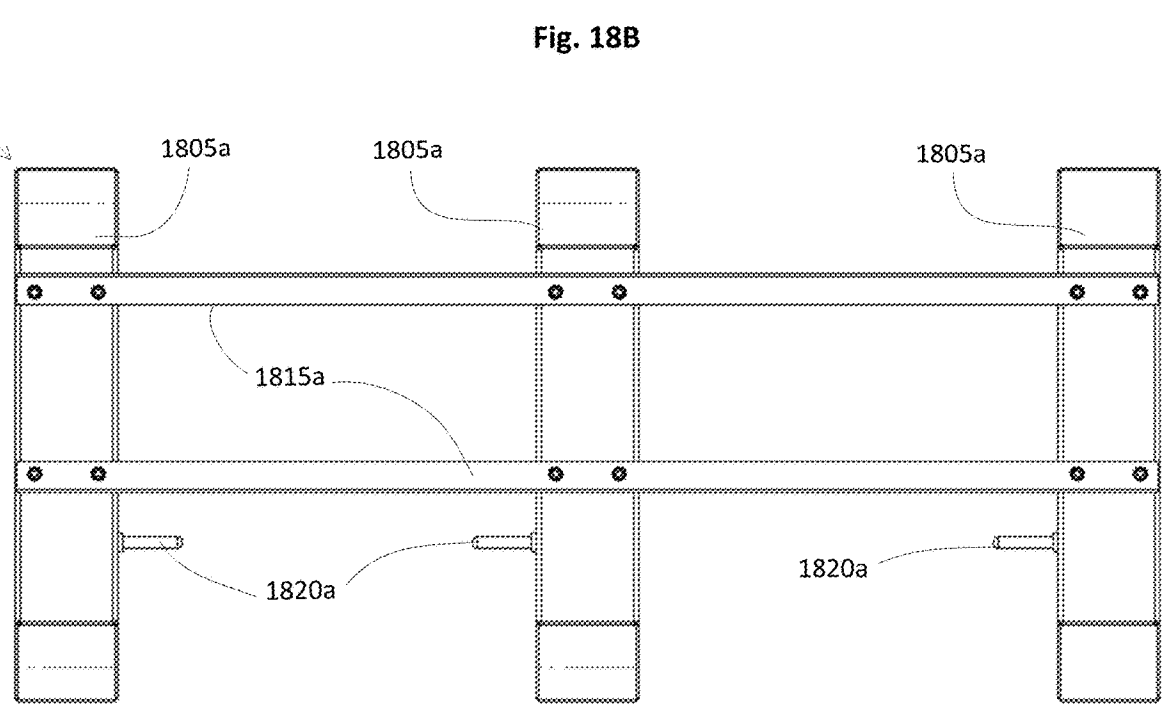
Figure 18C:
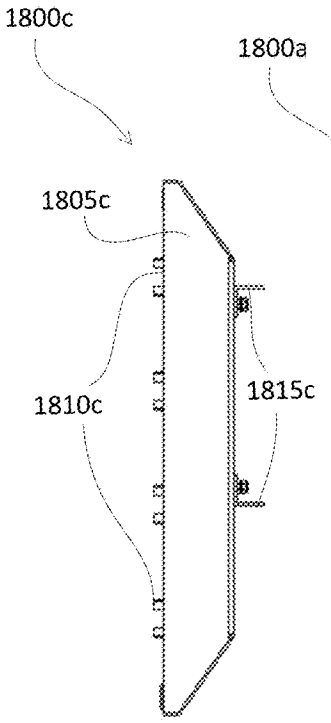
Figure 19A:
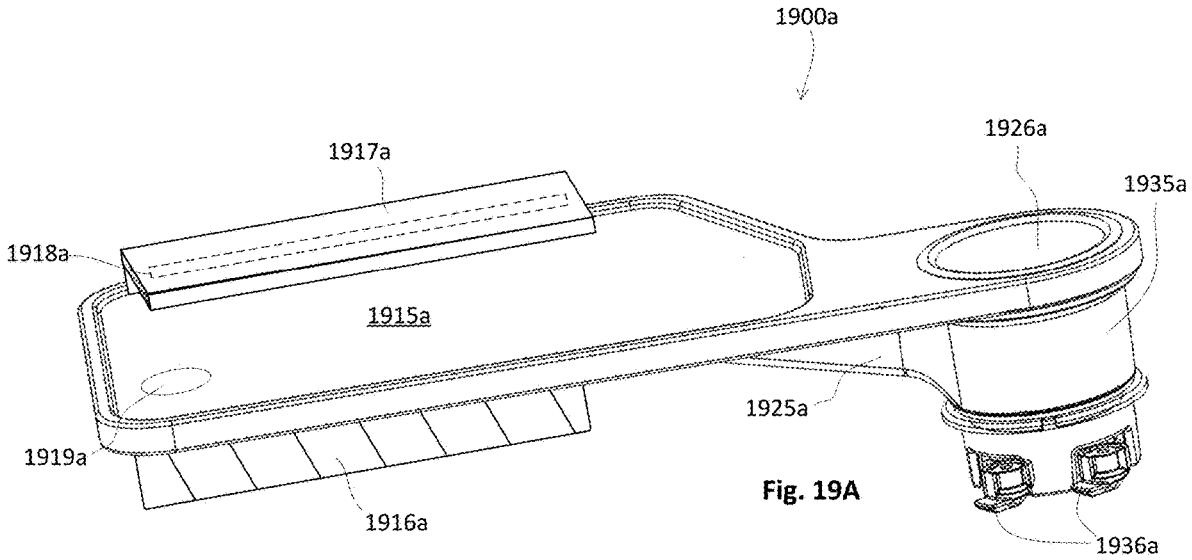
FIGS. 19A-19D depict various views of an example accessory tray assembly.
Figure 19B:
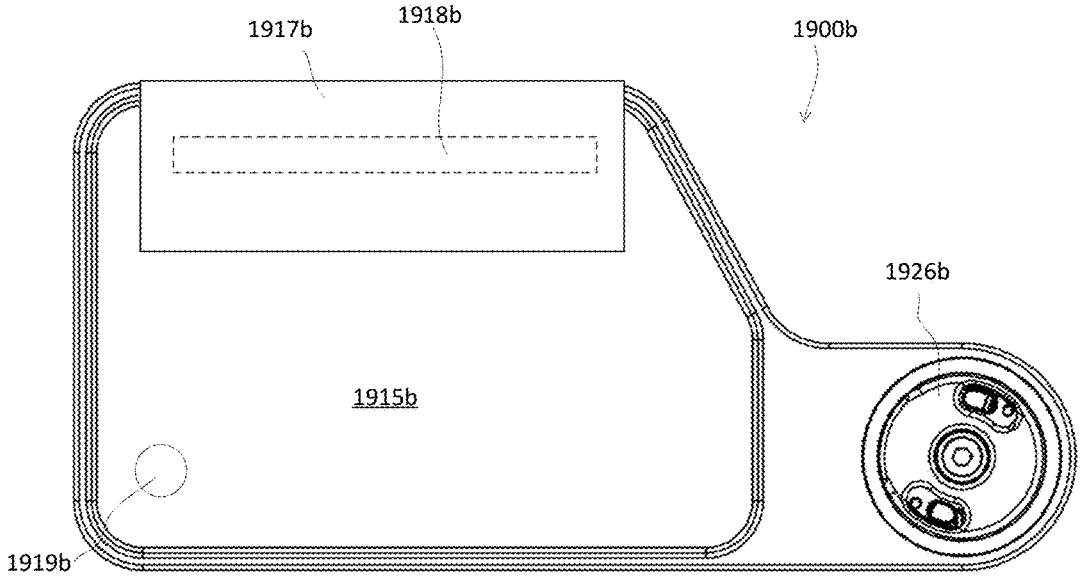
Figure 19C:
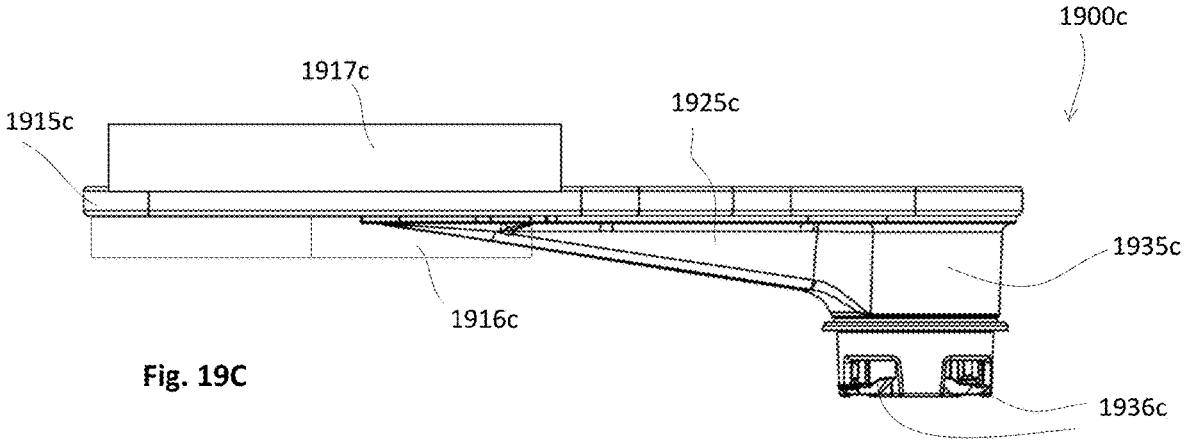
Figure 19D:
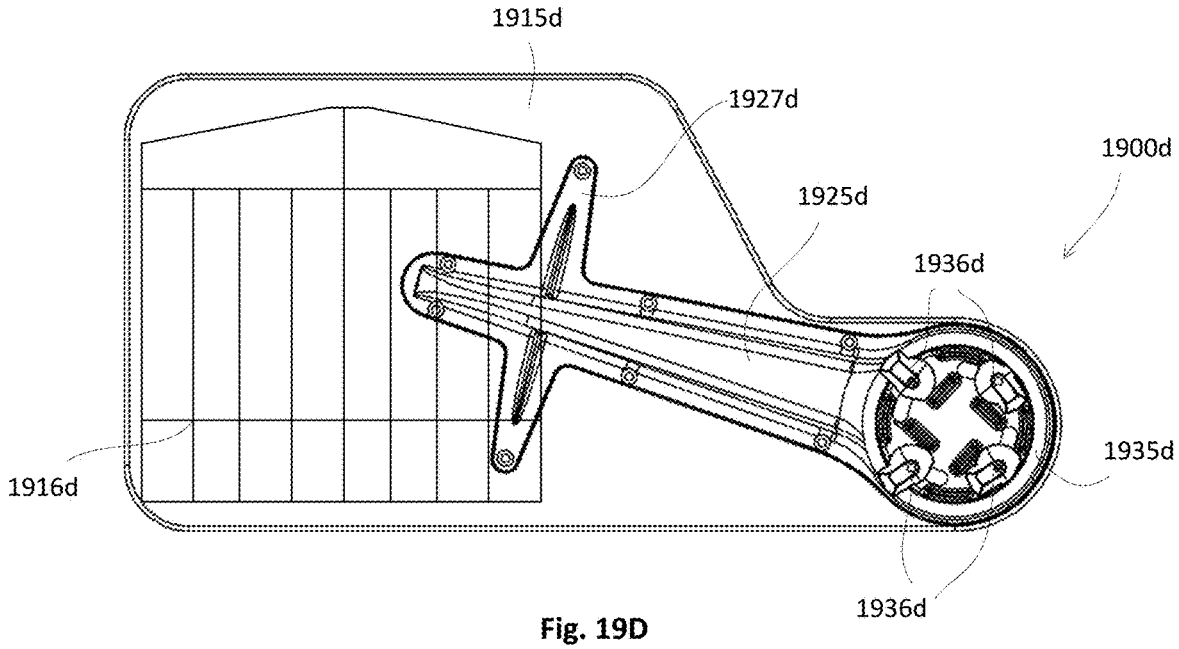

Turning to FIGS. 18A-C, a multi-chair assembly dolly 1800*a-c* may include first, second, and third chair mounts 1805*a-c* secured together via, for example, cross members 1815*a-c*. The chair mounts 1805*a-c* may include retractable casters 1810*b,c*. The retractable casters 1810*b,c* may be repositioned via a respective raise/lower mechanism 1820*a, b*. The chair mounts 1805*a-c* may be similar to, for example, the mechanisms as illustrated and described with respect to FIGS. 42A-C of commonly assigned U.S. patent application Ser. No. 16/181,585, the entire disclosure of which is incorporated herein by reference thereto.

With reference to FIGS. 19A-19D, an accessory tray assembly 1900*a-d* may include a tray 1915*a-d* secured to a tray support 1925*a,c,d* via, for example, fasteners 1927*c* (e.g., screws, bolts, adhesive, co-molding, etc. The tray support 1925*a,c,d* may be a casting (e.g., a steel casting, an iron casting, an aluminum casting, a composite material casting, etc.). Alternatively, the tray support 1925*a,c,d* may be a stamping (e.g., a metal stamping), a molded plastic, or may be a composite structure. The accessory tray assembly 1900*a-d* may include a storage area 1916*a,c,d* (e.g., a wire rack, an open ended box, a suspended surface, etc.) underneath the tray 1915*a-d*. The storage area 1916*a,c,d* may be configured to receive a venue information brochure, a menu, a concessions order form, a venue event brochure, a venue evaluation card, a tablet, an interactive question/answer sheet, a writing instrument, a recording instrument, a tablet computing device, etc.

The accessory tray assembly 1900*a-d* may include an overhang portion 1917*a-c* with an illumination source 1918*a,b* (e.g., a strip of LEDs, an LED, individual LEDs with individual optical structures, etc.). The illumination source 1918*a,b* may be capable of emitting multiple colors of light (e.g., individual LEDs of a RGB array of LEDs may be independently controllable). The illumination source 1918*a,b* may be turned on/off in response to reorientation of the accessory tray assembly 1900*a-d* from, for example, an in-use orientation to a chair-exit orientation. The accessory tray assembly 1900*a-d* may include a concessions button 1919*a,b*. The concessions button 1919*a,b* may be illuminated.

The accessory tray assembly 1900*a-d* may include a tray base 1935*a,c,d* and lock dogs 1936*a,c,d*. Alternatively, the tray 1900*a-d* may be configured with a cup holder adapter similar to any one of the tray assemblies of FIGS. 7A-9G. Additionally, the accessory tray assembly 1900*a-d* may include wire routed through the tray base as described in conjunction with, for example, FIGS. 23B-E of commonly assigned U.S. Pat. No. 9,943,174, the entire disclosure of which is incorporated herein by reference. Associated wiring may, for example, provide electrical connections between the illumination 1918*a,b* and/or the concessions button 1919*a,b* and a chair/table controller (e.g., chair/table device 301 of FIG. 3).

The accessory tray assembly 1900*a-d* may include a concessions button 1919*a,b* that, when actuated by a user, an indication may be activated (e.g., either the illuminated button may be activated or the illumination source 1918*a,b* may be activated). The indication may be representative of a desire of the user related to concessions. When the accessory tray assembly 1900*a-d* illumination source 1918*a,b* is activated, at least a portion of an area proximate the movable surface may be illuminated. When the concessions button 1919*a,b* is actuated by a venue staff member, an indication, that may be representative of a desire of the user related to concessions, may be deactivated. A movable surface assembly may include at least two concessions buttons. When at least one of the at least two concessions buttons is actuated by a user, an indication is activated, and wherein the indication is representative of a desire of the user related to concessions, and at least one information plague. The at least one information plague may contain information related to use of the concessions button.

Alternatively, or additionally, the illumination source 1918*a,b* may be controlled by a venue control. For example, an intensity of the illumination source 1918*a,b* and/or 1919*a,b* may be controlled based upon an ambient venue lighting (e.g., an intensity of the illumination source 1918*a,b* and/or 1919*a,b* may be proportional to the venue ambient lighting). Thereby, activation of an illumination source 1918*a,b* and/or 1919*a,b* may be more detectable by, for example, venue concessions personnel when the venue lighting is on. Additionally, or alternatively, activation of an illumination source 1918*a,b* and/or 1919*a,b* may be strobed on and off to, for example, indicate which concessions button 1919*a,b* was activated first (i.e., relative to other concessions buttons 1919*a,b* within the associated venue). Additionally, or alternatively, a color of an illumination source 1918*a,b* and/or 1919*a,b* may be changed to indicate which concessions button 1919*a,b* was activated first (i.e., relative to other concessions buttons 1919*a,b* within the associated venue).

Alternatively, or additionally, a concessions button 1919*a,b* may be configured to, for example, activate an end of row display/illumination source (e.g., display/illumination source 3700a-d of FIGS. 37A-D of commonly assigned U.S. Pat. No. 10,357,107, the entire disclosure of which is incorporated herein by reference). For example, the end of row display/illumination source may be configured to indicate which concessions button(s) 1919*a,b* within an associated row of chairs has been activated and/or provide an indication of when any give concessions button 1919*a,b* was activated relative to any other concessions button 1919*a,b*. Thereby, venue concessions staff may provide improved service.

Alternatively, or additionally, a concessions button 1919*a,b* may be configured to, for example, activate an indication on a tablet computer (e.g., a venue staff tablet computer). In fact, any given concessions button 1919*a,b* may include functionality similar to a tablet computer or user interface. For example, a concessions button 1919*a,b* may enable a user to view a venue menu and further enable a user to select items from the menu. The concessions button 1919*a,b* may, thereby, provide an indication to a venue device as to which seat within the venue has requested which items. In any event, once a user has placed a first order, a venue concessions system (e.g., system 100*a* of FIG. 1A) may enable venue staff to, for example, anticipate future orders of the particular user.

An accessory tray assembly 1900*a-d* may include at least two illumination sources 1918*a,b,* 1919*a,b.* When a first one of the at least two movable surface illumination sources is activated, at least a portion of an area proximate a first movable surface may be illuminated. When a second one of the at least two movable surface illumination sources is activated, at least a portion of an area proximate a second movable surface may be illuminated.

A movable surface assembly may include at least one concessions button interconnected to a network for data collection. For example, an accessory tray assembly 1900*a-d* may include a unique identifier (e.g., a QR code, an ID chip, etc.) that may be identifiable by physical location within a venue as described herein. An accessory tray assembly 1900*a-d* may be linked to a venue ticket purchaser and/or to an individual occupying a particular chair. An accessory tray assembly 1900*a-d* may include information that may be communicated to, within said network and actions can be initiated based on this information. An accessory tray assembly 1900*a-d* may be interconnected with a concession inventory record entry, recording, and automatic reorder system. An accessory tray assembly 1900*a-d* may be interconnected with a concession activity record entry, recording, and analysis system that may be, for example, configured to track concession ordering and/or delivery activity (e.g., time of concession order, time of concession delivery, customer satisfaction information, dollar amount of concession orders, etc.).

Figure 20:
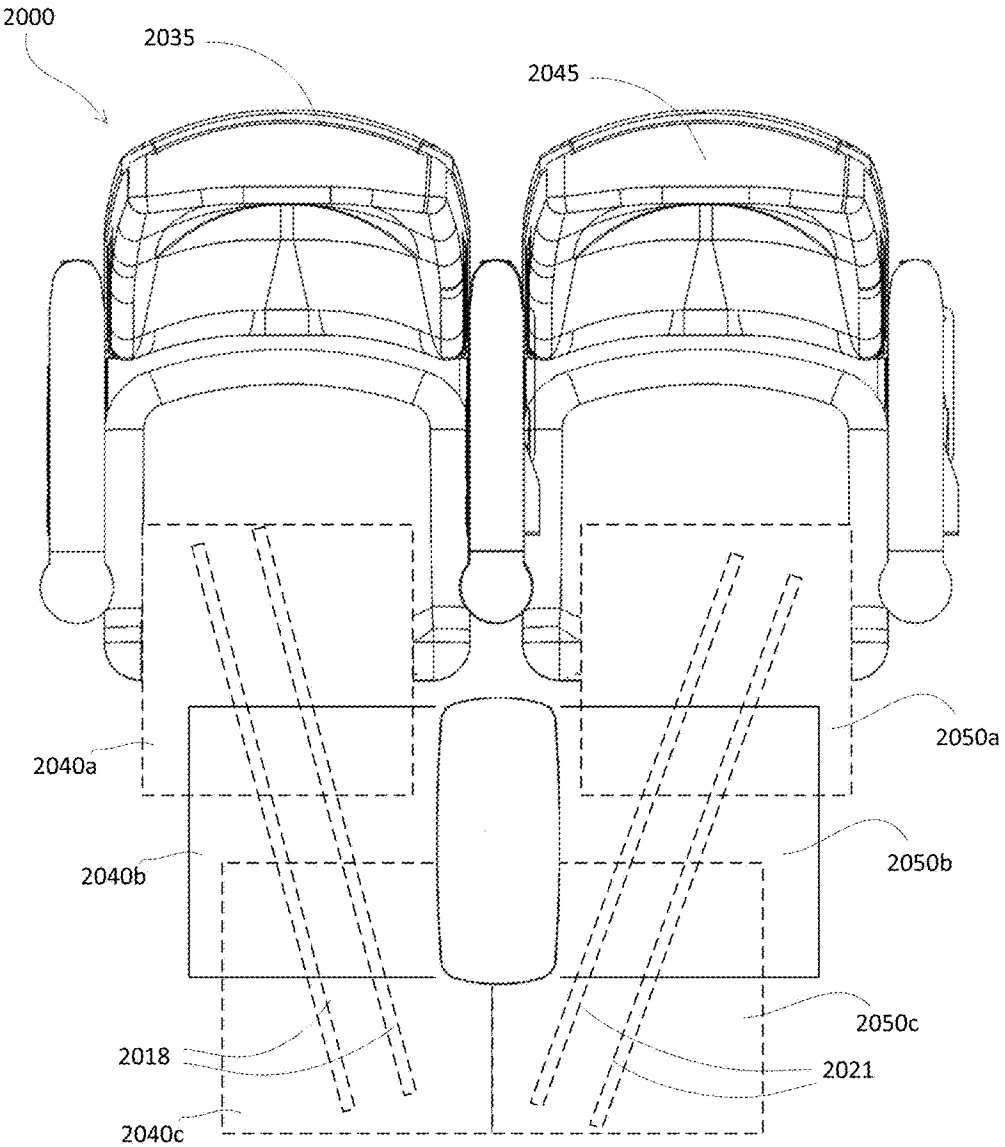
FIG. 20 depicts an example dual chair and dual table assembly.
Figure 21A:
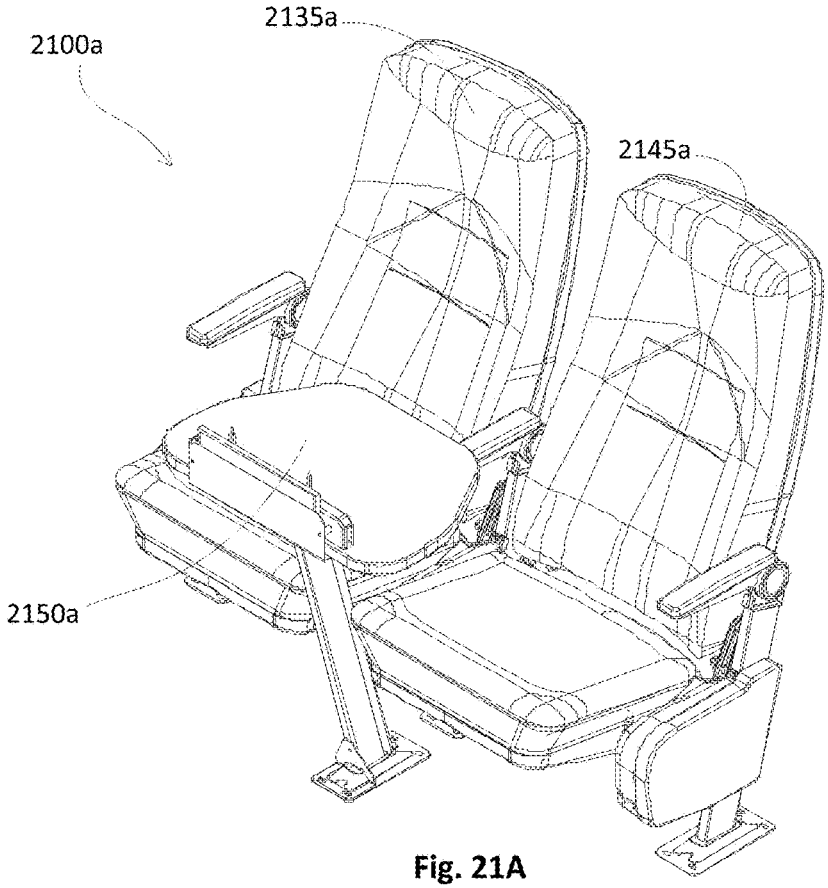
FIGS. 21A-H and J depict various views of an example dual chair and single table assembly.
Figure 21B:
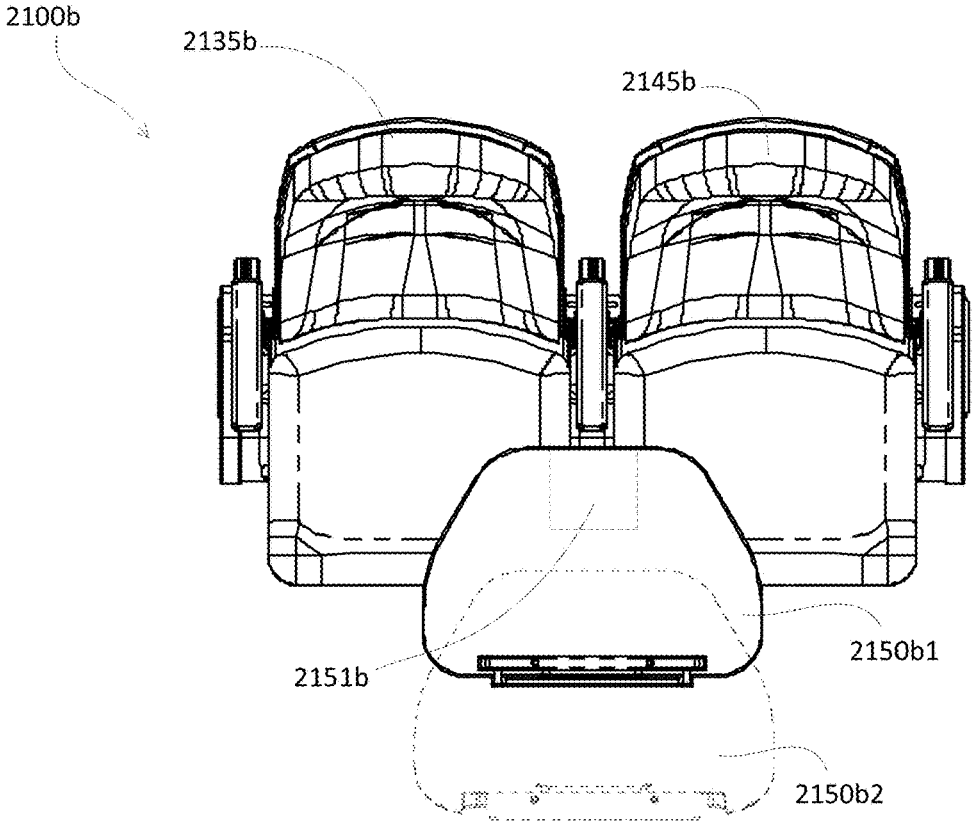
Figure 21C:
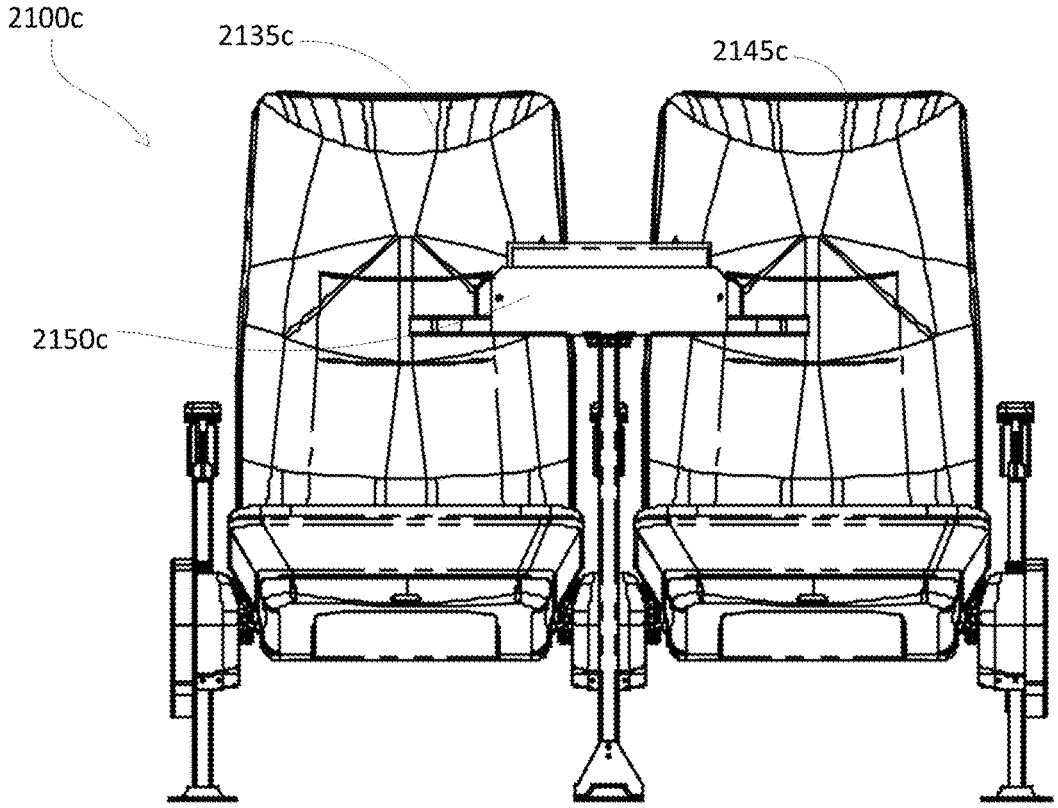
Figure 21D:
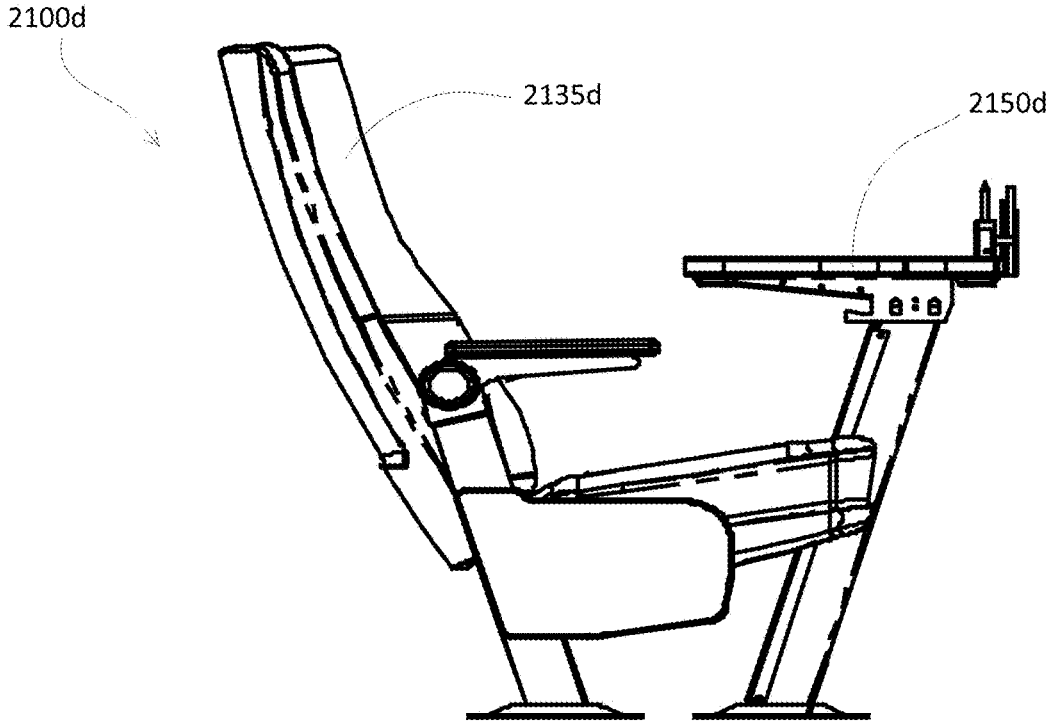
Figure 21E:
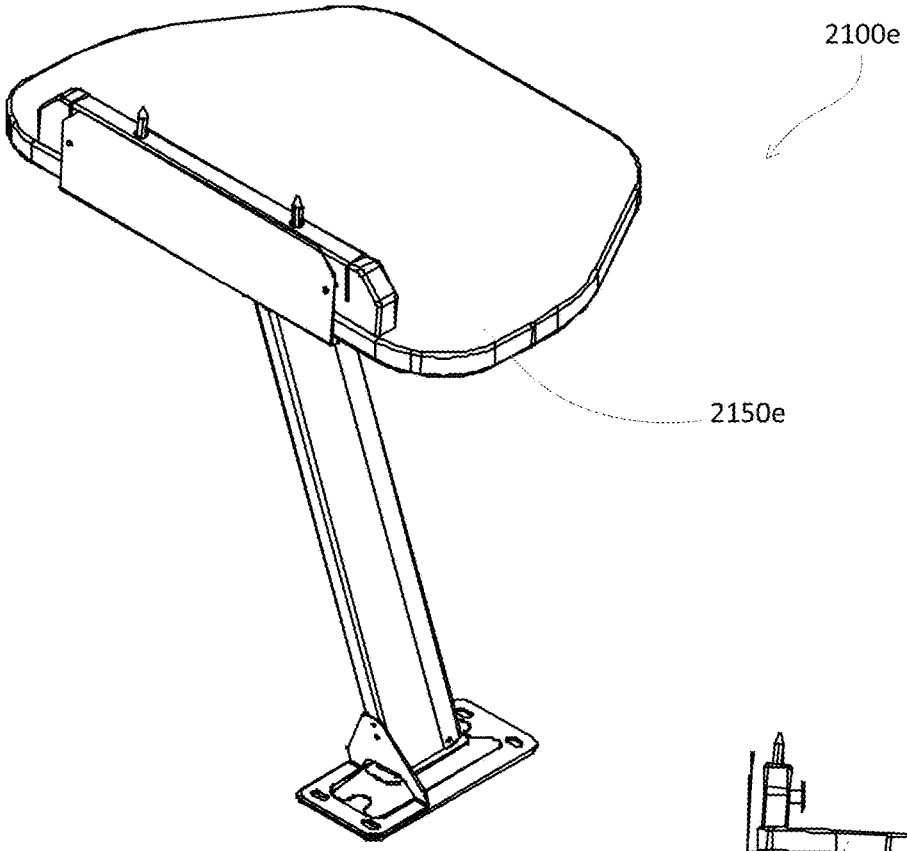
Figure 21F:
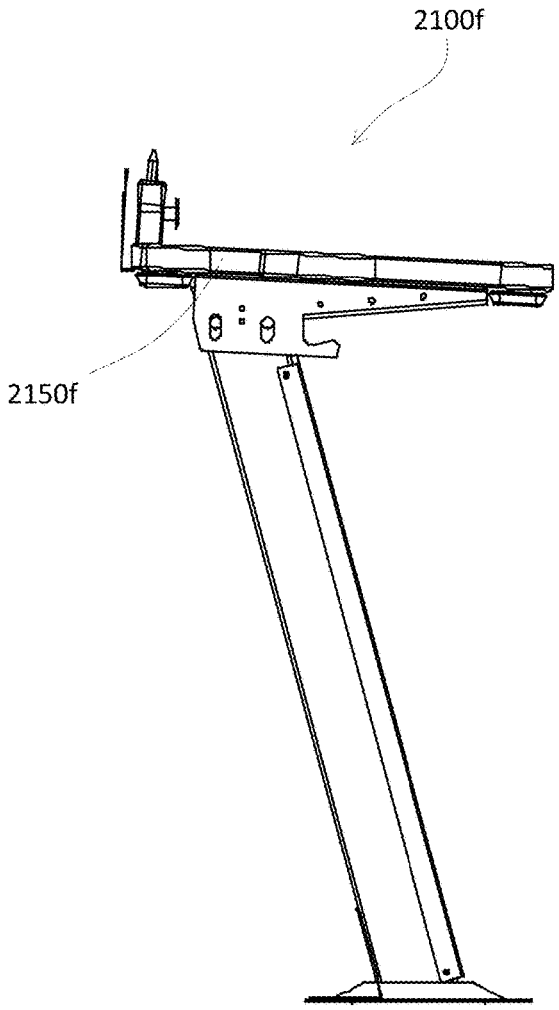
Figure 21G:
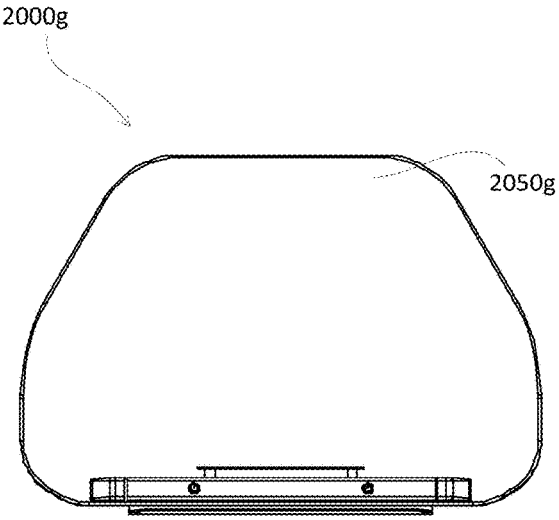
Figure 21H:
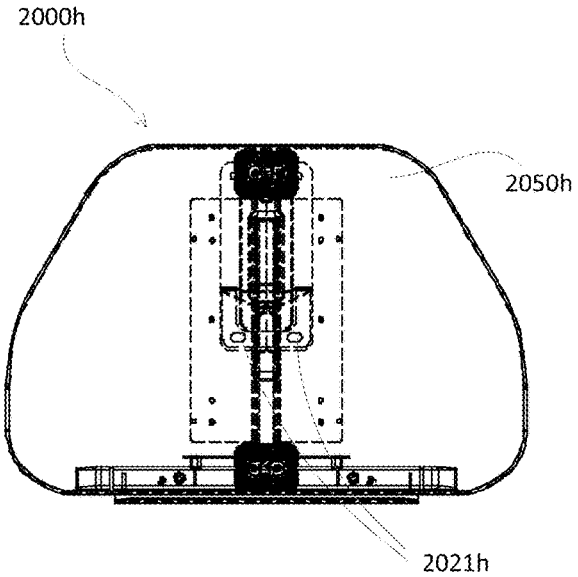
Figure 21J:
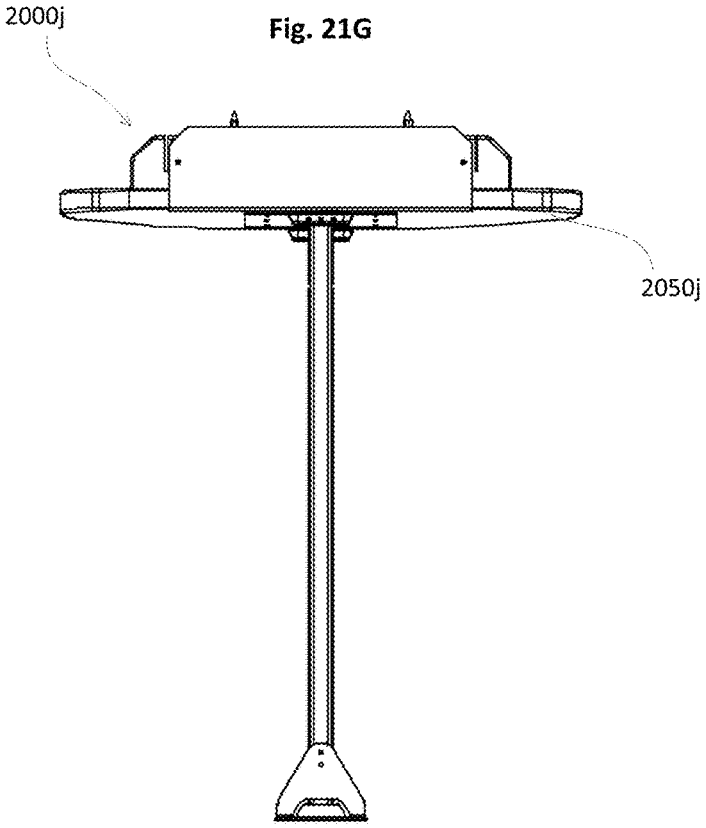

Turning to FIG. 20, a chair/table assembly 2000 may include a first chair assembly 2035 and a second chair assembly 2045. The first chair assembly 2035 and the second chair assembly 2045 may be any type of chair assembly (e.g., a fixed position chair assembly, a rocker style chair assembly, a chair assembly with a pivotable seat, a powered recliner chair assembly, etc.), such as, disclosed within the commonly assigned patent applications and patents, the entire disclosures of which are incorporated herein by reference. The chair/table assembly 2000 may include a first table assembly 2040 and a second table assembly 2050.

The table assemblies 2040, 2050 may include an exit position 2040*c*, 2050*c* with tables shifted such that their common edge is in close proximity to a center line of a shared arm box (or arm rest). The exit position 2040*c*, 2050*c* may maximize chair occupant egress space along a side of the respective table assembly 2040, 250. While each table assembly 2040, 2050 may be illustrated to include a square shaped table, any given table assembly 2040, 2050 may include a table with a different shape (e.g., a table shape as illustrated in FIGS. 6A-E).

In any event, as the table assemblies 2040, 2050 move away from center line of the shared arm box the table assemblies may move toward an in-use position 2040*a*, 2050*a*. The associated movement may be accomplished by, for example, draw slides (or glides) 2018, 2021 placed at a diagonal to the chair access (i.e., "diagonal" is a line segment joining two vertices of a polygon or polyhedron, when those vertices are not on the same edge). The draw slides 2018, 2021 may include features for increased friction as the table assembly moves from the exist position 2040*c*, 2050*c*, through the neutral position 2040*b*, 2050*b*, to the in-use position 2040*a*, 2050*a*. The table assemblies 2040, 2050 may include a return mechanism, lighting, with or without a center console, etc. as described, for example, with respect to FIGS. 6A-E.

With reference to FIGS. 21A-H and J, a dual chair and single table assembly 2100*a-h,j* may include a first chair assembly 2135*a-d,* a second chair assembly 2145*a-c,* and a table assembly 2150*a-h,j*. Either one, or both of the first and second chair assemblies 2135*a-d,* 2145*a-c* may be a fixed position chair assembly, a beam mounted chair assembly, a chair assembly with a pivotable seat, a rocker style chair assembly, a powered recliner chair assembly, etc. similar to, for example, those described elsewhere herein along with the chair assemblies described within any one of the commonly assigned patents and patent applications of which the entire disclosures are incorporated herein by reference. Likewise, the table assembly 2150*a-h,j* may be similar, for example, those described elsewhere herein along with the chair assemblies described within any one of the commonly assigned patents and patent applications of which the entire disclosures are incorporated herein by reference. However, the table assembly 2150*a-h,j* of the dual chair and single table assembly 2100*a-h,j* may be include a linear slide mechanism 2021*h* configured to, for example, allow a user to linearly reposition the table assembly 2150*a-h,j* from an in-use orientation 2150*b*1 to a chair ingress/egress orientation 2150*b*2 and/or vice versa. The table assembly 2150*a-h,j* may include a cup holder slot 2151*b* configured to accommodate a cup remaining in an associated cup holder of either or both of the first and second chair assemblies 2135*a-d,*

2145*a-c* while the table assembly 2150*a-h,j* is reoriented from an in-use orientation 2150*b*1 to a chair ingress/egress orientation 2150*b*2 and/or vice versa.

Figure 22A:
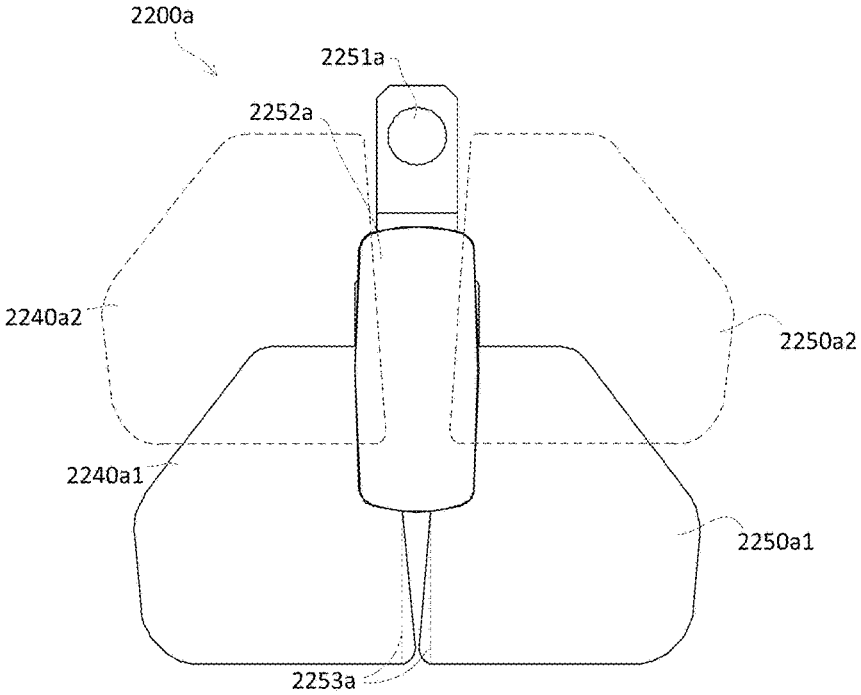
FIGS. 22A-C depict various views of an example dual table assembly.
Figure 22B:
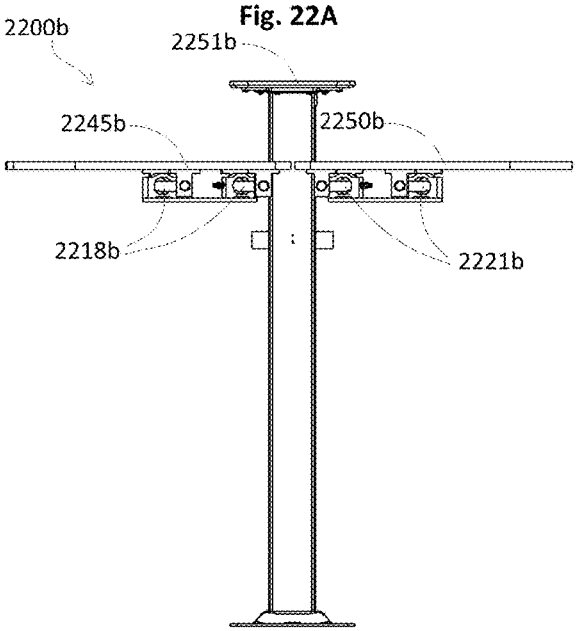
Figure 22C:
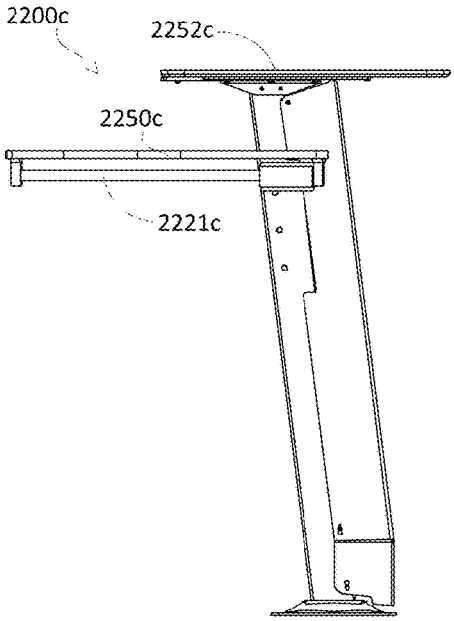

Turning to FIGS. 22A-C, a dual table assembly 2200*a-c* may include a first table 2240*a*1,*a*2,*b* with a first table slide mechanism 2218*b*, a second table 2250*a* 1-*c* with a second table slide mechanism 2221*b,c,* a raised center console 2252*a-c,* and a fixed position cup holder 2251*a*. The dual table assembly 2200*a-c* may be similar to, for example, the dual table assemblies described elsewhere herein along with the chair assemblies described within any one of the commonly assigned patents and patent applications of which the entire disclosures are incorporated herein by reference.

The first slide mechanism 2218*b* and the second table slide mechanism 2221*b,c* may be oriented at angle relative to a center line of the raised center console 2252*a-c*. Thereby, a cup may remain within the cup holder 2251*a* when the first table is reoriented to an in-use orientation 2240*a*2 and/or the second table is reoriented to an in-use orientation 2250*a*2. In order to increase chair ingress/egress space, a portion of either or both table 2253*a* may be omitted (i.e., the raised center console 2252*a-c* may move further toward a center line of the raised center console 2252*a-c* when the first table is reoriented to a chair ingress/egress orientation 2240*a*1 and/or the second table is reoriented to a chair ingress/egress orientation 2250*a*1. Additionally, or alternatively, a portion 2253*a* of a first table 2240*a*1 may overlap with a proximate portion 2253*a* of a second table 2250*a*1 when the first table 2240*a*1 and the second table 2250*a*1 are oriented in a chair ingress/egress orientation. Likewise, a shape (e.g., a width, a length, an angle of a corner, etc.) of any given table may be modified to alter an associated ingress/egress space. Additionally, or alternatively, any given table assembly described herein may include a table portion that is movable relative to another table portion (e.g., a table may include a portion that is hinged relative to another portion, a table may include a portion that is telescopically movable relative to another portion, a table may include a portion that is removable relative to another portion, etc.).

Figure 23A:
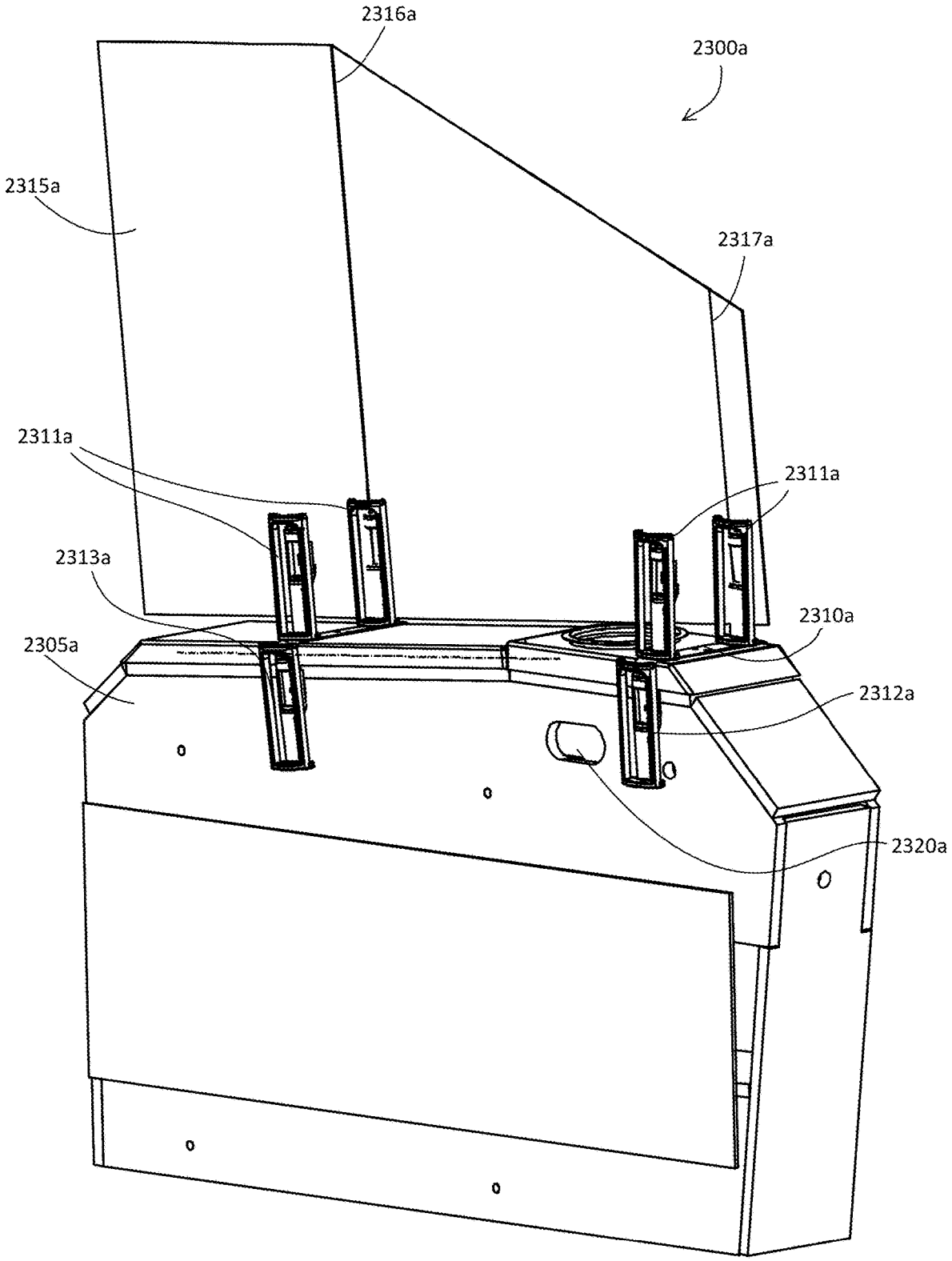
FIGS. 23A-C depict various views of an example partition removably attached to a chair arm box.
Figure 23C:
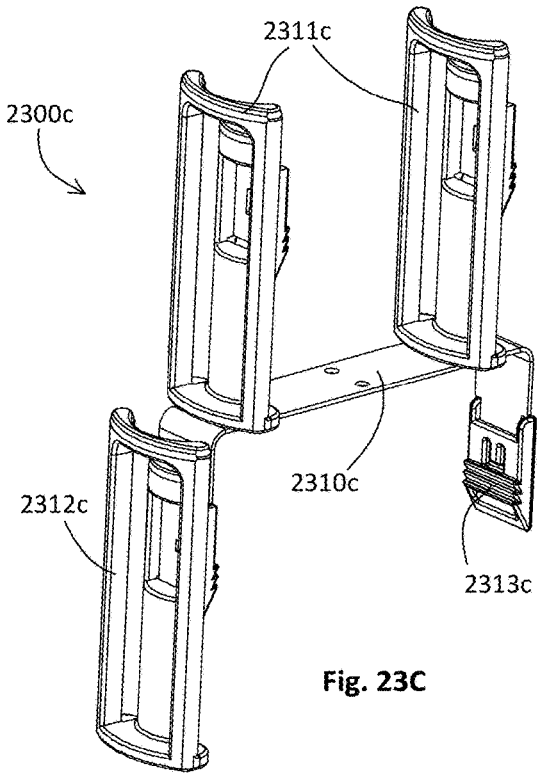
Figure 23B:
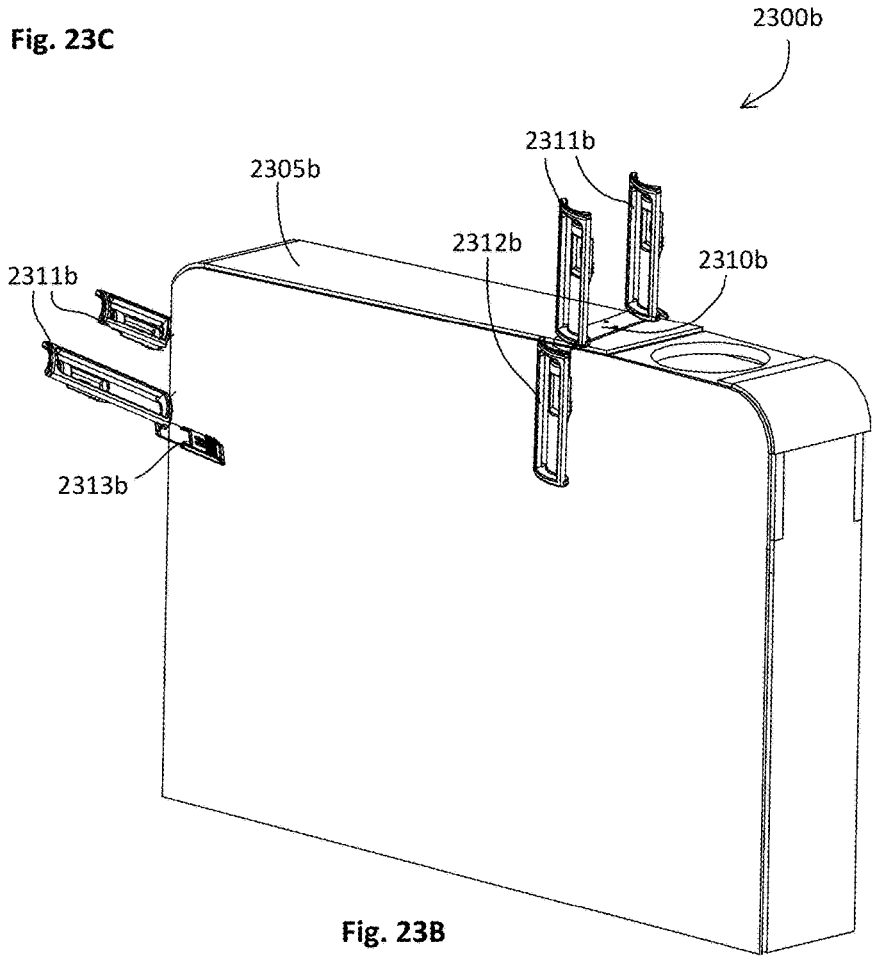

With reference to FIGS. 23A-C, a partition 2315*a* may be removably attached to a chair arm box 2305*a,b* via at least one clamp 2310*a-c*. The partition 2315*a* may be similar to, for example, partition 180*f* of FIG. 1F. A partition 2315*a* may be made of a paper material and may include at least one fold (or crease) 2316*a*, 2317*a*. The at least one fold (or crease) 2316*a*, 2317*a* may impart structural stability for the partition 2315*a*. The clamp 2310*a-c* may include a first and/or second partition receptacle 2311*a-c,* a first arm box grip 2312*a-c,* and a third partition receptacle/second arm box grip 2313*a-c*.

This detailed description is to be construed as exemplary only and does not describe every possible embodiment, as describing every possible embodiment would be impractical, if not impossible. One could implement numerous alternate embodiments, using either current technology or technology developed after the filing date of this application.

What is claimed is:

1. A table assembly for use with a chair, the table assembly comprising:

a mounting structure;

a table slide mechanism attached to the mounting structure, wherein the table slide mechanism includes at least one table orientation automatic return mechanism, and wherein the at least one table orientation automatic return mechanism is configured to bias a table orientation toward at least one of: an ingress orientation, an egress orientation or an in-use orientation; and a table mounted to the table slide mechanism, wherein the table slide mechanism is configured such that, when the table is reoriented from a chair ingress/egress orientation to an in-use orientation, a side-to-side table movement distance is proportional to a backward table movement distance.

2. The table assembly as in claim 1, wherein the table slide mechanism includes at least one linear draw slide, wherein the at least one linear draw slide is mounted to the mounting structure diagonal with respect to a front surface of the chair.

3. The table assembly as in claim 1, wherein, when the table is moved from a chair ingress/egress orientation toward an in-use orientation, the table moves away from a center line of a chair arm.

4. The table assembly as in claim 1, wherein the table slide mechanism includes at least one feature for increasing friction as the table is moved from chair ingress/egress orientation toward an in-use orientation.

5. The table assembly as in claim 1, comprising:

a fist table and a second table, wherein a portion of the first table overlaps with a proximate portion of the second table when the first table and the second table are oriented in a respective chair ingress/egress orientation.

6. The table assembly as in claim 1, further comprising:

at least one electrical device mounted to the table such that the at least one electrical device moves along with the table when the table is reoriented from the ingress/egress orientation to the in-use orientation.

7. The table assembly of claim 1, wherein the mounting structure is at least one of: fixedly attached to a structure of an associated venue, movably supported on a structure of an associated venue, fixedly attached to a structure of an associated chair assembly, or movably supported on a structure of an associated chair assembly.

8. A table assembly for use with a chair, the table assembly comprising:

a mounting structure;

a table slide mechanism, wherein the table slide mechanism includes at least one linear draw slide, wherein the at least one linear draw slide is mounted to the mounting structure diagonal with respect to a front surface of a respective chair, wherein the table slide mechanism includes at least one table orientation automatic return mechanism, and wherein the at least one table orientation automatic return mechanism is configured to bias a table orientation toward at least one of: an ingress orientation, an egress orientation or an in-use orientation; and a table mounted to the table slide mechanism, wherein the table slide mechanism is configured such that, when the table is reoriented from a chair ingress/egress orientation to an in-use orientation, a side-to-side table movement and a backward table movement distance define a diagonal table movement.

9. The table assembly as in claim 8, wherein the table includes a first table portion that is movable relative to a second table portion via at least one of: at least one hinge or at least one telescopically extending structure.

10. The table assembly as in claim 8, further comprising:

at least one electrical device mounted to the table such that the at least one electrical device moves along with the table when the table is reoriented from the ingress/egress orientation to the in-use orientation.

11. The table assembly of claim 8, wherein the mounting structure is at least one of: fixedly attached to a structure of an associated venue, movably supported on a structure of an associated venue, fixedly attached to a structure of an associated chair assembly, or movably supported on a structure of an associated chair assembly.

12. A table assembly for use with at least two chairs, the table assembly comprising:

a mounting structure;

a first table slide mechanism attached to the mounting structure;

a second table slide mechanism attached to the mounting structure;

a first table mounted to the first table slide mechanism, wherein the first table slide mechanism is configured such that, when the first table is reoriented from a chair ingress/egress orientation to an in-use orientation, a side-to-side first table movement distance is proportional to a backward first table movement distance; and a second table mounted to the second table slide mechanism, wherein the second table slide mechanism is configured such that, when the second table is reoriented from a chair ingress/egress orientation to an in-use orientation, a side-to-side second table movement distance is proportional to a backward second table movement distance, and wherein a side-to-side first table movement is opposite a side-to-side second table movement.

13. The table assembly as in claim 12, wherein the first table slide mechanism includes at least one first linear draw slide, wherein the at least one first linear draw slide is mounted to the mounting structure diagonal with respect to a front surface of a respective chair.

14. The table assembly as in claim 12, further comprising:

at least one electrical device mounted to the table such that the at least one electrical device moves along with the table when the table is reoriented from the ingress/egress orientation to the in-use orientation.

15. The table assembly of claim 12, wherein the mounting structure is at least one of: fixedly attached to a structure of an associated venue, movably supported on a structure of an associated venue, fixedly attached to a structure of an associated chair assembly, or movably supported on a structure of an associated chair assembly.

16. The table assembly as in claim 12, wherein a portion of the first table overlaps with a proximate portion of the second table when the first table and the second table are oriented in a respective chair ingress/egress orientation.

17. The table assembly of claim 12, wherein at least one of: the first table or the second table includes a light source mounted to the respective table, wherein the light source includes light directing optics or a light shield to prevent and/or reduce light from being project beyond a desired field of view.

18. The table assembly of claim 12, comprising:

at least two movable chairs and at least one table, wherein the at least two movable chairs are repositionable relative to the at least one table such that occupants of the at least two movable chairs have a similar view of an event within an associated venue, and wherein the at least two movable chairs are repositionable relative to the at least one table such that occupants of the at least two movable chairs have a view of one another.

19. The table assembly of claim 12, further comprising:

an electrical charging station or an electrical outlet fixedly mounted to either the first table or the second table, wherein the electrical outlets are either AC or DC, and wherein the electrical outlets are either high or low voltage.

* * * * *